US011041703B2

(12) United States Patent
Mahnke

(10) Patent No.: US 11,041,703 B2
(45) Date of Patent: Jun. 22, 2021

(54) PROJECTILE WITH ENHANCED BALLISTICS

(71) Applicant: G9 Holdings, LLC, Lakewood, CO (US)

(72) Inventor: Joshua Mahnke, Post Falls, ID (US)

(73) Assignee: G9 Holdings, LLC, Lakewood, CO (US)

( * ) Notice: Subject to any disclaimer, the term of this patent is extended or adjusted under 35 U.S.C. 154(b) by 0 days.

(21) Appl. No.: 16/707,820

(22) Filed: Dec. 9, 2019

(65) Prior Publication Data

US 2020/0116462 A1 Apr. 16, 2020

Related U.S. Application Data

(60) Division of application No. 15/406,781, filed on Jan. 16, 2017, now Pat. No. 10,502,536, which is a (Continued)

(51) Int. Cl.

| | |
|---|---|
| ***F42B 10/24*** | (2006.01) |
| ***F42B 12/06*** | (2006.01) |
| ***F42B 12/02*** | (2006.01) |
| ***F42B 12/74*** | (2006.01) |
| ***F42B 10/22*** | (2006.01) |

(Continued)

(52) U.S. Cl.

CPC ..... *F42B 12/02* (2013.01); *F42B 10/22* (2013.01); *F42B 10/24* (2013.01); *F42B 10/26* (2013.01); *F42B 10/46* (2013.01); *F42B 12/06* (2013.01); *F42B 12/74* (2013.01); *F42B 30/02* (2013.01)

(58) Field of Classification Search

CPC ..... F42B 12/00; F42B 12/02; F42B 30/02; F42B 30/00; F42B 6/08; F42B 6/10; F42B 14/00; F42B 14/02; F42B 14/06; F42B 12/04; F42B 12/06; F42B 12/08; F42B 12/34

USPC ..... 102/501, 517, 506, 507, 508, 522, 519, 102/520, 521, 523

See application file for complete search history.

(56) References Cited

U.S. PATENT DOCUMENTS

| | | | |
|---|---|---|---|
| 760,338 | A | 5/1904 | Kwiatkowski |
| 1,169,704 | A | 1/1916 | Wesner |

(Continued)

FOREIGN PATENT DOCUMENTS

| | | |
|---|---|---|
| CA | 577406 | 6/1959 |
| DE | 2641021 | 3/1978 |

(Continued)

OTHER PUBLICATIONS

U.S. Appl. No. 15/407,102, filed Jan. 16, 2017, Mahnke.

(Continued)

*Primary Examiner* — Jonathan C Weber

(74) *Attorney, Agent, or Firm* — Sheridan Ross P.C.

(57) ABSTRACT

The present invention provides a projectile device and a method of manufacture of a projectile device and in particular to a pistol bullet and a rifle bullet and method of manufacture of same. In one embodiment, the projectile apparatus has a cylindrical body portion having a diameter, a front nose section tapering from a most proximal point of the projectile to the cylindrical body portion, and a rear tail section connected to the body portion and extending to the most distal point of the projectile, in which the front nose portion comprises a plurality of twisting depressions forming troughs.

20 Claims, 50 Drawing Sheets

Related U.S. Application Data continuation-in-part of application No. 14/701,519, filed on Apr. 30, 2015, now Pat. No. 9,709,368.

(60) Provisional application No. 61/986,296, filed on Apr. 30, 2014, provisional application No. 62/145,814, filed on Apr. 10, 2015.

(51) Int. Cl.

| | |
|---|---|
| ***F42B 10/26*** | (2006.01) |
| ***F42B 10/46*** | (2006.01) |
| ***F42B 30/02*** | (2006.01) |

(56) References Cited

U.S. PATENT DOCUMENTS

| | | | |
|---|---|---|---|
| 1,596,180 | A | 8/1926 | Henderson |
| 2,342,006 | A | 2/1944 | Moore |
| 2,612,108 | A | 9/1952 | Schmidt |
| 2,941,469 | A | 6/1960 | Barnhart |
| 3,557,702 | A | 1/1971 | Benson |
| 3,580,179 | A | 5/1971 | Gawlick et al. |
| 3,901,158 | A | 8/1975 | Ferb |
| 3,949,677 | A | 4/1976 | Voss |
| D244,448 | S | 5/1977 | Bonine et al. |
| 4,301,733 | A | 11/1981 | Blanco |
| 4,643,435 | A | 2/1987 | Musacchia, Sr. |
| 4,644,866 | A | 2/1987 | Sullivan |
| 4,700,630 | A | 10/1987 | Sullivan |
| 4,829,904 | A | 5/1989 | Sullivan |
| 4,829,906 | A | 5/1989 | Kaswer |
| 4,867,065 | A | 9/1989 | Kaltmann et al. |
| H770 | H | 4/1990 | Kline et al. |
| D310,553 | S | 9/1990 | Kania et al. |
| 4,958,572 | A | 9/1990 | Martel |
| D314,416 | S | 2/1991 | Rezmer |
| 5,020,438 | A | 6/1991 | Brown |
| 5,069,139 | A | 12/1991 | Denis |
| 5,094,464 | A | 3/1992 | Musacchia, Sr. |
| 5,116,224 | A | 5/1992 | Kelsey, Jr. |
| 5,133,261 | A | 7/1992 | Kelsey, Jr. |
| 5,198,616 | A | 3/1993 | Anderson |
| D343,439 | S | 1/1994 | Kuczewski |
| D363,335 | S | 10/1995 | Dixon |
| 5,493,975 | A | 2/1996 | Franzini et al. |
| 5,496,043 | A | 3/1996 | Ester |
| 5,641,937 | A | 6/1997 | Carter |
| 5,841,058 | A | 11/1998 | Manis |
| 5,907,121 | A | 5/1999 | Fritze |
| 5,932,836 | A | 8/1999 | White |
| 6,070,532 | A | 6/2000 | Halverson |
| 6,074,454 | A | 6/2000 | Abrams et al. |
| D435,886 | S | 1/2001 | Benini |
| 6,182,574 | B1 | 2/2001 | Giannoni |
| 6,263,798 | B1 | 7/2001 | Benini |
| D447,208 | S | 8/2001 | Benini |
| 6,306,053 | B1 | 10/2001 | Liechty, II |
| 6,439,123 | B1 | 8/2002 | Dionne et al. |
| 6,439,125 | B1 | 8/2002 | Carter |
| 6,536,352 | B1 | 3/2003 | Nadkarni et al. |
| 6,581,522 | B1 | 6/2003 | Julien et al. |
| 6,772,695 | B2 | 8/2004 | Kellner |
| 6,776,818 | B1 | 8/2004 | Nilsson |
| 6,971,315 | B2 | 12/2005 | Knappworst et al. |
| 7,204,191 | B2 | 4/2007 | Wiley et al. |
| 7,207,276 | B1 | 4/2007 | Dindl |
| 7,213,519 | B2 | 5/2007 | Wiley et al. |
| D563,100 | S | 3/2008 | Epling et al. |
| D566,805 | S | 4/2008 | Earl |
| 7,380,502 | B2 | 6/2008 | Emary |
| D583,897 | S | 12/2008 | Ward |
| 7,484,459 | B2 | 2/2009 | Fichot et al. |
| D621,468 | S | 8/2010 | Nilsson |
| D625,380 | S | 10/2010 | Walter et al. |
| D626,619 | S | 11/2010 | Gogol et al. |
| D632,357 | S | 2/2011 | Dixon |
| D652,472 | S | 1/2012 | Klement |
| 8,161,885 | B1 | 4/2012 | Emary |
| 8,186,277 | B1 | 5/2012 | King |
| 8,365,672 | B2 | 2/2013 | Calero Martinez et al. |
| 8,393,273 | B2 | 3/2013 | Weeks et al. |
| D689,975 | S | 9/2013 | Carlson et al. |
| D707,785 | S | 6/2014 | Seecamp |
| 8,763,535 | B2 | 7/2014 | Padgett |
| D710,962 | S | 8/2014 | Pedersen |
| D713,919 | S | 9/2014 | Rager |
| D717,909 | S | 11/2014 | Thrift et al. |
| D722,126 | S | 2/2015 | Bray |
| D723,653 | S | 3/2015 | Peterson |
| D724,690 | S | 3/2015 | Carson et al. |
| D726,281 | S | 4/2015 | Powers, Jr. |
| 9,003,974 | B2 | 4/2015 | Muskat et al. |
| D733,252 | S | 6/2015 | Burczynski et al. |
| D733,834 | S | 7/2015 | Burczynski et al. |
| D733,835 | S | 7/2015 | Burczynski et al. |
| D733,836 | S | 7/2015 | Burczynski et al. |
| D733,837 | S | 7/2015 | Burczynski et al. |
| D734,419 | S | 7/2015 | Burczynski et al. |
| D735,289 | S | 7/2015 | Burczynski et al. |
| 9,121,677 | B2 | 9/2015 | Emary |
| D743,500 | S | 11/2015 | Pedersen |
| D747,781 | S | 1/2016 | Alculumbre |
| D748,220 | S | 1/2016 | Fricke |
| D750,723 | S | 3/2016 | Rager |
| D751,166 | S | 3/2016 | Seecamp |
| D751,167 | S | 3/2016 | Chua et al. |
| D752,702 | S | 3/2016 | Arnedo Vera et al. |
| D752,703 | S | 3/2016 | Arnedo Vera et al. |
| D753,258 | S | 4/2016 | Arnedo Vera et al. |
| D754,222 | S | 4/2016 | Pederson et al. |
| D754,223 | S | 4/2016 | Pederson et al. |
| 9,316,468 | B2 | 4/2016 | Rall et al. |
| D759,189 | S | 6/2016 | Pederson et al. |
| D764,624 | S | 8/2016 | Masinelli |
| D768,798 | S | 10/2016 | Loa |
| D768,802 | S | 10/2016 | Bowers |
| D770,005 | S | 10/2016 | Christiansen et al. |
| D774,159 | S | 12/2016 | Holtmeyer et al. |
| D775,305 | S | 12/2016 | Fiocchi et al. |
| D780,876 | S | 3/2017 | Boatright |
| D781,980 | S | 3/2017 | Wallace |
| 9,709,368 | B2 | 7/2017 | Mahnke |
| 9,863,746 | B2 | 1/2018 | Peterson |
| D821,536 | S | 6/2018 | Christiansen et al. |
| D863,492 | S | 10/2019 | Mahnke |
| D868,199 | S | 11/2019 | Mahnke |
| 1,050,253 | A1 | 12/2019 | Mahnke |
| 1,057,841 | A1 | 3/2020 | Mahnke |
| 2002/0055404 | A1 | 5/2002 | Liechty, II |
| 2005/0005807 | A1 | 1/2005 | Wiley et al. |
| 2005/0241523 | A1 | 11/2005 | Schikora et al. |
| 2006/0027128 | A1 | 2/2006 | Hober |
| 2006/0030438 | A1 | 2/2006 | Hajek |
| 2006/0096491 | A1 | 5/2006 | Fichot |
| 2006/0124022 | A1 | 6/2006 | Eberhart et al. |
| 2009/0308275 | A1 | 12/2009 | Nilsson |
| 2010/0224093 | A1 | 9/2010 | Wilhelm et al. |
| 2013/0263754 | A1 | 10/2013 | Neme |
| 2015/0075400 | A1 | 3/2015 | Lemke et al. |
| 2015/0204639 | A1 | 7/2015 | Riley |
| 2015/0268020 | A1 | 9/2015 | Emary |
| 2015/0308800 | A1 | 10/2015 | Schnabel |
| 2016/0047638 | A1 | 2/2016 | Golloher et al. |
| 2016/0097619 | A1 | 4/2016 | Emary |
| 2016/0169645 | A1 | 6/2016 | Emary et al. |
| 2016/0223307 | A1 | 8/2016 | Bray |
| 2016/0231093 | A1 | 8/2016 | Lemke et al. |
| 2017/0205215 | A1 | 7/2017 | Sloff et al. |
| 2017/0219325 | A1 | 8/2017 | Smith |
| 2017/0248396 | A1 | 8/2017 | Riess |

(56) References Cited

U.S. PATENT DOCUMENTS

| | | | |
|---|---|---|---|
| 2017/0336186 | A1 | 11/2017 | Smith |
| 2018/0135950 | A1 | 5/2018 | Agazim |

FOREIGN PATENT DOCUMENTS

| | | |
|---|---|---|
| DE | 10042719 | 3/2001 |
| EP | 0015574 | 9/1980 |
| EP | 0502221 | 9/1992 |
| EP | 2498046 | 9/2012 |
| GB | 451031 | 7/1936 |
| WO | WO 86/06827 | 11/1986 |
| WO | WO 99/37971 | 7/1999 |
| WO | WO 2008/048224 | 4/2008 |
| WO | WO 2013/086544 | 6/2013 |
| WO | WO 2013/096848 | 6/2013 |
| WO | WO 2015/048102 | 4/2015 |

OTHER PUBLICATIONS

U.S. Appl. No. 29/709,402, filed Oct. 14, 2019, Mahnke.
U.S. Appl. No. 29/714,930, filed Nov. 26, 2019, Mahnke.
U.S. Appl. No. 16/806,860, filed Mar. 2, 2020, Mahnke
"ELD® Match," Hornady Manufacturing Company, 2016, retrieved from http://www.hornady.com/store/BELD-Match-New, 3 pages.
"ELD-X®," Hornady Manufacturing Company, 2016, retrieved from http://www.hornady.com/store/ELD-X-New, 2 pages.
"Hornady® BLACK™," Hornady Manufacturing Company, 2016, retrieved from http://www.hornady.com/store/Black-new, 3 pages.
"Inceptor ARX Product Sheet," PolyCase Ammunition, Jan. 2015, 1 page.
"Inceptor Preferred Defense," Polycase Ammunition, retrieved from http://www.polycaseammo.com/project/inceptor-arx, retrieved on Nov. 2016, 2 pages.
"Inceptor Preferred Hunting®," Polycase Ammunition, retrieved from http://www.polycaseammo.com/project/inceptor-preferred-hunting, retrieved on Nov. 2016, 2 pages.
"Match™," Hornady Manufacturing Company, 2016, retrieved from http://www.hornady.com/store/Match-newammo, 3 pages.
"Polycase Ammo Shows Off New Ammo at SHOT Show 2014," Matt Alpert, 2014, retrieved from https://www.youtube.com/watch?v=Y9Pp9gRNqal, retrieved on May 2, 2016, 1 page. (screen shot of YouTube video web page).
"PolyCase ARX + RNP Product Sheet," PolyCase Ammunition, Jan. 2015, 1 page.
"Ruger® Ammunition," Sturm, Ruger & Co., Inc., retrieved from http://www.ruger.com/micros/ammo/index.html?r=y, retrieved on Nov. 2016, 3 pages.
ES P201331387 (priority document for WO 2015/048102), filed Sep. 24, 2013, 21 pages, English translation unavailable.
Horman, "Tested: The Polycase ARX Bullet," American Rifleman, 2015, 6 pages.
International Search Report and Written Opinion for International (PCT) Patent Application No. PCT/US15/28661, dated Jan. 7, 2016, 11 pages.
International Preliminary Report on Patentability for International (PCT) Patent Application No. PCT/US15/28661, dated Oct. 12, 2016, 9 pages.
Official Action for Australia Patent Application No. 2015288295, dated Mar. 6, 2019 6 pages.
Extended European Search Report for European Patent Application No. 15819768.1, dated Dec. 1, 2017, 11 pages.
Official Action for Israel Patent Application No. 248588, dated Feb. 7, 2018 7 pages.
Notice of Allowance for Israel Patent Application No. 248588, dated Jun. 16, 2019 3 pages.
Official Action for U.S. Appl. No. 14/701,519, dated Apr. 5, 2016, 7 pages, Restriction Requirement.
Official Action for U.S. Appl. No. 14/701,519, dated Aug. 26, 2016, 9 pages.
Notice of Allowance for U.S. Appl. No. 14/701,519, dated Mar. 24, 2017, 8 pages.
Restriction Requirement for U.S. Appl. No. 15/406,781, dated Feb. 28, 2018, 7 pages.
Official Action for U.S. Appl. No. 15/406,781, dated Sep. 5, 2018 6 pages Restriction Requirement.
Official Action for U.S. Appl. No. 15/406,781, dated Feb. 1, 2019 7 pages.
Notice of Allowance for U.S. Appl. No. 15/406,781, dated Jul. 25, 2019 8 pages.
Official Action for U.S. Appl. No. 29/612,522, dated Mar. 8, 2019 6 pages Restriction Requirement.
Notice of Allowance for U.S. Appl. No. 29/612,522, dated Jul. 11, 2019 6 pages.
Official Action for U.S. Appl. No. 29/590,952, dated Jul. 12, 2018 7 pages Restriction Requirement.
Official Action for U.S. Appl. No. 29/590,952, dated Dec. 14, 2018 7 pages.
Notice of Allowance for U.S. Appl. No. 29/590,952, dated May 22, 2019 5 pages.
Official Action for U.S. Appl. No. 15/651,997, dated May 14, 2018 7 pages Restriction Requirement.
Official Action for U.S. Appl. No. 15/651,997, dated Feb. 14, 2019 11 pages.
Notice of Allowance for U.S. Appl. No. 15/651,997, dated Jul. 29, 2019 8 pages.
"HELOSR High Expansion Lawman Ordnance Monolithic Hollow Point," National Police Ammunition, 2018, 5 pages.
Notice of Acceptance for Australia Patent Application No. 2015288295, dated Sep. 12, 2019 4 pages.
Official Action for European Patent Application No. 19182441.6, dated Oct. 21, 2019 5 pages.
Extended Search Report for European Patent Application No. 19182441.6, dated Mar. 2, 2020 10 pages.
Official Action with English Translation for Israel Patent Application No. 269160, dated Nov. 28, 2019 6 pages.

PROJECTILE WITH ENHANCED BALLISTICS

CROSS REFERENCE TO RELATED APPLICATIONS

This application is a Divisional application of U.S. patent application Ser. No. 15/406,781 filed on Jan. 16, 2017, entitled "Projectile with Enhanced Ballistics," which is a Continuation-In-Part application of U.S. patent application Ser. No. 14/701,519 filed on Apr. 30, 2015, entitled "Projectile with Enhanced Ballistics," now U.S. Pat. No. 9,709,368, which claims the benefit of priority from U.S. Provisional Patent Application Ser. No. 61/986,296, filed Apr. 30, 2014, entitled "Projectile with Enhanced Ballistics," and U.S. Provisional Patent Application Ser. No. 62/145,814, filed Apr. 10, 2015, entitled "Projectile with Enhanced Ballistics," the entire disclosures of which are hereby expressly incorporated by reference in their entireties.

FIELD OF THE INVENTION

Embodiments of the present invention are generally related to a projectile device and a method of manufacture of the same and in particular to a pistol bullet and a rifle bullet and method of manufacture of the same.

BACKGROUND OF THE INVENTION

Conventional projectiles, such as bullets, typically comprise a smooth uniform shank or body portion and an axially-symmetrical front or nose portion. Bullet performance is traditionally assessed with respect to parameters including velocity, ballistic coefficient (BC), trajectory, accuracy, and target penetration. Conventional bullets, after leaving the barrel and once under unpowered free-flight, substantially degrade in flight characteristics. For example, conventional bullets begin to wobble during flight, thereby losing accuracy and velocity. Upon striking a target, such reduced velocity and wobbling limits target penetration.

Various efforts have been made to improve projectile performance and/or enable additional projectile features. For example, U.S. Pat. No. 4,829,904 to Sullivan ("Sullivan") issued May 16, 1989, discloses a substantially full bore diameter bullet that has a plurality of elongated grooves either helically formed or parallel with the longitudinal axis of the bullet and a sabot, which has a body and fingers that engage with the grooves and seal the bullet in a casing. The sabot is configured with a slightly larger diameter than the bullet such that the sabot is engraved by the rifling slots in the barrel through which the round is fired, imparting a rotation to the bullet. In alternative embodiments the grooves contain elongated elements or a plurality of spherical elements to prevent the conically tapered slug or bullet from tilting or cocking in the barrel after firing. However, Sullivan fails to teach several novel features of the present invention, including a projectile design that retains if not enhances the spin of a projectile in flight, so as to achieve flatter and faster external ballistics and further yield improved target penetration. Sullivan is incorporated herein by reference in its entirety.

U.S. Pat. No. 6,439,125 to Carter ("Carter") issued Aug. 27, 2002, relates to a bullet having a tapered nose and a cylindrical base. The base is provided with an annular groove having a diameter less than the bore diameter of the barrel of the gun to reduce the force required to move the bullet through the barrel, thereby increasing the muzzle velocity and kinetic energy of the bullet. However, Carter fails to teach several novel features of the present invention, including a projectile design that retains if not enhances the spin of a projectile in flight, to achieve flatter and faster external ballistics and further yield improved target penetration. Carter is incorporated herein by reference in its entirety.

U.S. Pat. No. 6,581,522 to Julien et al., ("Julien") issued Jun. 24, 2003, discloses a projectile comprising a cylindrical body of Type 55 Nitinol material that has a soft martensitic state that is readily deformed by rifling in the bore of a gun barrel to form grooves which ride on the rifling to spin the projectile. The Nitinol material has a low coefficient of friction with the steel barrel and is sufficiently strong to prevent shedding projectile material in the bore. On impact with the target, the Nitinol material undergoes a strain-induced shift to an ultra-high strength state in which the projectile is capable of remaining intact and concentrating its full energy on the small area of contact for maximal penetration and damage to the target. In contrast, a conventional bullet typically mushrooms widely and spreads its energy over a side area. Projectiles in the form of bullets, shotgun slugs, penetrating warheads, caseless ammunition, and artillery shells are described. However, Julien fails to teach several novel features of the present invention, including a projectile design that retains if not enhances the spin of a projectile in flight, to achieve flatter and faster external ballistics and further yield improved target penetration. Julien is incorporated herein by reference in its entirety.

U.S. Patent Application Publication No. 2006/0027128 to Hober ("Hober") published Feb. 9, 2006, discloses a projectile for small munitions comprising a bullet with an integral housing formed from a resilient, shape-retaining material. The projectile comprises a bullet having a tapered front section, a cylindrical middle section and a tapered end section. The middle section includes a recessed retaining portion over which the resilient housing is securely positioned or formed. The maximum diameter of the bullet is less than the primary bore diameter of the firearm barrel, and the outer diameter of the housing when positioned around the bullet is slightly greater than the primary bore diameter. Thus, rifling in the barrel scores the housing and not the bullet, and imparts spin to the housing during firing and hence to the bullet, which is integral therewith, achieving enhanced gas checking efficiency, accuracy and velocity. The integral housing remains on the bullet after firing and downrange to its ultimate destination. However, Hober fails to teach several novel features of the present invention, including a projectile design that retains if not enhances the spin of a projectile in flight, so as to achieve flatter and faster external ballistics and further yield improved target penetration. Hober is incorporated herein by reference in its entirety.

U.S. Pat. No. 5,116,224 to Kelsey, Jr. ("Kelsey I") issued on May 26, 1992 and U.S. Pat. No. 5,133,261 to Kelsey, Jr. ("Kelsey II") issued on Jul. 28, 1992 and disclose a small arms bullet having a truncated conical nose with radial rearwardly extending ribs. The ribs have a flat edge and form grooves between the ribs. The Kelsey I ribs are formed along a radial, whereas the Kelsey II ribs are curved. In both Kelsey I and Kelsey II, the ribs are engineered to form a flat planar structure defining a rib thickness. However, each of Kelsey I and Kelsey II fail to teach several novel features of the present invention, including a projectile design that retains if not enhances the spin of a projectile in flight, to achieve flatter and faster external ballistics and further yield improved target penetration. Both Kelsey I and Kelsey II are incorporated herein by reference in entirety.

U.S. Statutory Invention Registration No. H770 to Kline et al., ("Kline") discloses a tracer training bullet which can be assembled into a conventional cartridge case and fired in a conventional M2 machine gun. The bullet consists of a main body of relatively low strength material which is segmented so that, if not restrained, it will bend under the centrifugal rotational force imparted to the segments by the spinning action of the projectile when fired. The bending of the projectile segments away from their central axis is ordinarily prevented by a retainer in the form of a spider. The spider is made of a relatively low temperature melting material, preferably aluminum, having a given thermal mass. The burn of the tracer material during the flight of the bullet toward a target weakens the retainer to the point of rupture after the bullet has traveled a given distance toward a target position. After the target position is passed, the securement member is destroyed by the high temperature burning action and the segments of the projectile bend or flex apart. This destroys the aerodynamic characteristics of the bullet and reduces its maximum range beyond the target distance. However, Kline fails to teach several novel features of the present invention, including a projectile design that retains if not enhances the spin of a projectile in flight, so as to achieve flatter and faster external ballistics and further yield improved target penetration. Kline is incorporated herein by reference in its entirety.

Thus, there is a long-felt need for a projectile design, and method of making the same, that retains, enhances, or counters the spin of a projectile in flight, to achieve flatter and faster external ballistics and further yield improved target penetration, as provided in embodiments of the present invention. The projectile design of the present invention may be configured to create several embodiments, for example to include rifle embodiments and pistol embodiments.

SUMMARY OF THE INVENTION

What is needed is a projectile that does not substantially degrade in flight characteristics once leaving the gun barrel, so as to achieve flatter and faster external ballistics and further yield improved target penetration. The present invention solves these needs by providing a projectile that retains if not enhances the spin of a bullet in flight and, in some embodiments, provides a cutting edge to promote and enhance target penetration and/or expansion in soft targets.

It is one aspect of the present invention to provide a projectile device and a method of manufacture of a projectile device. In particular, a pistol bullet and a rifle bullet are provided, along with methods of manufacture of the same.

Another aspect of the present invention is to provide a projectile with improved accuracy and performance.

In general, a projectile with a non-congruent twist penetrates less into the target and the larger end mill cut penetrates less into the target. These projectiles create a cavitation and slow down in soft tissue. The advantages generally include the ease of manufacturing and the non-expanding bullet (i.e., no housing and cavities). Further, the projectile does not deflect in auto glass, it shoots through sheet metal and body armor using its cutting edges, and it creates a cavitation in tissue to help it slow down in the soft tissue. A congruent twist will increase the depth of the projectile's penetration in soft media. The shorter the distance the projectile travels in the target, the more energy is released in that short distance. Thus, a wider tissue area is affected in order to absorb the energy.

In one embodiment of the invention, a projectile with enhanced performance characteristics adapted for use with a firearm is disclosed, the projectile comprising: a cylindrical body portion having a predetermined diameter; a front nose section tapering from a forward most point of the projectile to the cylindrical body portion; and a rear tail section connected to the body opposite the front nose portion; and wherein the front nose portion comprises at least one twisting depression forming a trough at a predetermined angle oriented with respect to a longitudinal centerline of the projectile.

In one embodiment, a projectile device is disclosed comprising: a cylindrical body with a longitudinal axis and a first end and a second end which defines a first length therebetween; a nose integrally interconnected to the second end of said cylindrical portion and having a second length, said nose further comprising: a) a plurality of cutout portions originating proximate to an apex of said nose and having a predetermined angle with respect to the longitudinal axis of the cylindrical body; b) a non-distorted nose portion positioned between each of the cutout portions, and wherein the intersection of the plurality of cutout portions and each of the non-distorted nose portions form a distinct edge which extends proximate to the apex of the nose portion.

In another embodiment, a projectile with enhanced performance characteristics for use with a firearm is disclosed, the projectile comprising: a first end having a tip; a second end having a base, the second end opposite the first end; a cylindrical portion having a predetermined diameter, the cylindrical portion positioned between the first end and the second end; a nose portion tapering from the tip to the cylindrical portion, wherein the nose portion is integrally interconnected to the cylindrical portion at a first junction; a first depression forming a first trough extending from a portion of the projectile proximate the first junction proximate to the tip of the projectile, wherein a first centerline of the first depression is positioned at a first angle relative to a longitudinal centerline of the projectile, and wherein the first trough has a first radius of curvature; a second depression forming a second trough extending from the portion of the projectile proximate the first junction proximate to the tip of the projectile, wherein a second centerline of the second depression is positioned at a second angle relative to the longitudinal centerline of the projectile, and wherein the second trough has a second radius of curvature; a first remaining nose portion positioned between the first depression and the second depression, the first remaining nose portion having a substantially triangular shape and forming a first cutting edge proximate the tip; a third depression forming a third trough extending from the portion of the projectile proximate the first junction proximate to the tip of the projectile, wherein a third centerline of the third depression is positioned at a third angle relative to the longitudinal centerline of the projectile, and wherein the third trough has a third radius of curvature; a second remaining nose portion positioned between the second depression and the third depression, the second remaining nose portion having a substantially triangular shape and forming a second cutting edge proximate the tip; and a third remaining nose portion positioned between the first depression and the third depression, the third remaining nose portion having a substantially triangular shape and forming a third cutting edge proximate the tip.

In yet another embodiment, a projectile device is disclosed comprising: a cylindrical body with a longitudinal axis defined therethrough; a nose integrally interconnected to a forward end of the cylindrical body; an alternating pattern of arcuate shaped cutout portions extending from approximately the tip of the nose to the cylindrical body and non-distorted nose portions having a substantially triangular shape, the intersection defining a cutting edge which is oriented at a specific angle with respect to the longitudinal axis of the cylindrical body.

In some embodiments, further features comprise: wherein the non-distorted nose portion has a substantially triangular shape; wherein the plurality of cutout portions has a length of approximately the nose second length; three distinct cutting edges formed at the intersection of the cutout portions; wherein the cutout portions have either a right or a left twist with respect to the longitudinal axis of the projectile; wherein the metallic projectile comprises three twisting cutout portions and three non-distorted nose portions; wherein the first length of the cylindrical portion is greater than the second length of the nose; wherein the projectile is made of a metallic material; wherein the metallic projectile has a caliber of at least one of 0.380 inch, 9 mm, 0.40 inch, and 0.45 inch and is adapted for use with a handgun; wherein the projectile is comprised of at least one of lead, copper, steel, magnesium, titanium, and other alloy; a second cutting edge formed at the intersection of the first depression and second depression and the second depression and third depression, and positioned above the first cutting edge; a second cutting edge defined by the intersection if each cutout portion above the non-distorted nose portion and extending upwardly to the apex of the nose; and wherein there are three distinct cutout portions and three distinct non-distorted nose portions.

In one embodiment, a projectile for use in a handheld weapon is provided comprising: a cylindrical body with a longitudinal axis, a first end substantially perpendicular to said longitudinal axis, a second end, and a first length extending from said first end to said second end; a nose integrally interconnected at a junction to said second end of said cylindrical body, said nose having a tip on a forward-most portion and a second length between said tip and said junction, wherein said second length is longer than said first length, said nose further comprising: (a) a plurality of cutout portions originating at said tip of said nose and terminating proximate said junction, wherein each cutout portion in said plurality of cutout portions forms a curved trough with a radius of curvature, and wherein a lowermost portion of each of said troughs is positioned at a predetermined angle with respect to said longitudinal axis of said cylindrical body; (b) plurality of non-distorted nose portions, wherein each non-distorted nose portion is positioned between two of said cutout portions, and wherein said plurality of non-distorted nose portions extends to said tip of said nose portion; and (c) wherein said tip of said nose portion is substantially parallel to said first end of said cylindrical body.

In further embodiments, each non-distorted nose portion has a substantially triangular shape with a narrow portion of said substantially triangular shape proximate said tip and a wide portion of said substantially triangular shape proximate said junction; each cutout portion in said plurality of cutout portions has a third length as measured along said longitudinal axis that is slightly less than or equal to said second length; and/or each cutout portion in said plurality of cutout portions has a radius of curvature of between about 0.05 inches and about 0.25 inches. In some embodiments, the projectile also comprises a chamfer portion extending from said first end of said cylindrical body to a point on said cylindrical body, wherein said chamfer is positioned at an angle relative to said longitudinal axis. In further embodiments, said cutout portions have either a right twist or a left twist with respect to said longitudinal axis of said projectile. In some embodiments, said plurality of cutout portions comprises three cutout portions and said plurality of non-distorted nose portions comprises three non-distorted nose portions. In one embodiment, said first length of said cylindrical body is between about 0.11 and 0.285 inches and said second length of said nose is between about 0.20 and 0.45 inches. In some embodiments, each cutout portion in said plurality of cutout portions is oriented at an angle of between about 5 degrees and 15 degrees with respect to said longitudinal axis of said cylindrical body, and said projectile is sized in at least one of a 0.380 inch, a 9 mm, a 0.40 inch, and a 0.45 inch caliber and is adapted for use with a handgun.

In one embodiment, a projectile with enhanced performance characteristics for use with a firearm is provided comprising: a longitudinal axis; a housing comprising: a front end; a rear end having a base, the rear end positioned opposite the front end; a boat tail portion extending from the rear end to a first point of the housing between the front end and the rear end, wherein the boat tail portion tapers inwardly toward the longitudinal axis such that the rear end has a smaller diameter than a diameter at the first point of the housing; a cylindrical portion integrally interconnected on a first end to the boat tail portion at the first point of the housing, the cylindrical portion extending from the first point of the housing to a second point of the housing between the front end and the rear end; a nose portion tapering from the front end to the cylindrical portion at the second point of the housing, wherein the nose portion is integrally interconnected to the cylindrical portion at the second point of the housing; and a cavity for receiving an insert, the cavity extending from the front end to a third point of the housing between the front end and the rear end; and the insert comprising: a first end having a tip; a second end having a base, the second end positioned opposite the first end; a stem portion extending from the second end to a first point of the insert between the first end and the second end; a nose portion tapering from the tip to the stem portion, wherein the nose portion is integrally interconnected to the stem portion at the first point of the insert; a plurality of depressions originating at a second point of the insert between the tip and the first point of the insert and terminating at a third point of the insert between the second point and the base, wherein each depression in the plurality of depressions has a curved shape with a radius of curvature, and wherein each depression has a centerline positioned at an angle relative to the longitudinal axis of the projectile; and a plurality of remaining nose portions, wherein each remaining nose portion in the plurality of remaining nose portions is positioned between two of said depressions.

In further embodiments, the nose portion of the insert has a concave radius of curvature or the nose portion of the insert has a convex radius of curvature. In additional embodiments, a forward portion of the stem of the insert has a first diameter and a rear portion of the stem of the insert has a second diameter, and wherein the first diameter is larger than the second diameter. In various embodiments, the base of the insert has an angled shape terminating in a point; and/or the cylindrical portion of the housing comprises a plurality of angled driving bands and a plurality of angled relief cuts, wherein each angled driving band in the plurality of angled driving bands has a larger diameter than each angled relief cut in the plurality of angled relief cuts, and wherein each angled driving band is positioned between two angled relief cuts.

In one embodiment, a bullet adapted for insertion into a casing filled with an explosive propellant is provided comprising: a longitudinal axis; a front end having a rounded tip; a rear end having a base and positioned opposite the front end; a boat tail portion extending from the rear end to a first point between the front end and the rear end, wherein the boat tail portion tapers inwardly toward the longitudinal axis such that the rear end has a smaller diameter than a diameter at the first point; a cylindrical portion integrally interconnected on a first end to the boat tail portion at the first point, the cylindrical portion extending from the first point to a second point between the front end and the rear end of the bullet, wherein the cylindrical portion comprises a plurality of angled driving bands and a plurality of angled relief cuts, wherein each angled driving band in the plurality of angled driving bands has a larger diameter than each angled relief cut in the plurality of angled relief cuts, and wherein each angled driving band is positioned between two angled relief cuts; and a nose portion tapering from the tip to the cylindrical portion at the second point, wherein the nose portion is integrally interconnected to the cylindrical portion at the second point.

In further embodiments, the bullet further comprises a cavity and an insert, wherein the insert is positioned in the cavity, wherein the insert includes an apex at a first end opposite a base at a second end and a plurality of arcuate-shaped cutout portions extending from the apex of the insert to a point between the apex and the base, and wherein the apex of the insert is positioned a distance behind the rounded tip of the bullet, and the intersection of two arcuate-shaped cutout portions forms a cutter edge that extends to the apex of the insert.

The term "projectile" and variations thereof, as used herein, refers to any object projected into space by the exertion of a force, to include bullets, bombs, and rockets. The term "ballistics" and variations thereof, as used herein, refers to the physics of projecting a projectile into space, to include the range and accuracy of projectiles and the effects of projectiles upon impact with an object.

The term "ballistics coefficient (BC)" and variations thereof, as used herein, refers to the ability of a projectile to overcome air resistance in flight; a high number indicates a greater ability to overcome air resistance.

The term "internal ballistics" and variations thereof, as used herein, refers to the behavior and effects of a projectile from propellant ignition to exit from a gun barrel.

The term "external ballistics" and variations thereof, as used herein, refers to the behavior and effects of a projectile from leaving a gun barrel until striking a target. The term "terminal ballistics" and variations thereof, as used herein, refers to the behavior and effects of a projectile when it hits a target.

This Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claims set forth herein, taken in conjunction with this Summary of the Invention, define the invention.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1A:
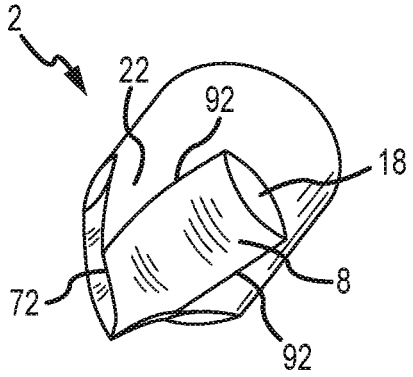
FIGS. 1A-F show a projectile according to a first embodiment of the invention.

To assist in the understanding of the embodiments of the present invention, the following list of components and associated numbering found in the drawings is provided herein:

| No. | Component |
|---|---|
| 2 | Projectile |
| 4 | Tip or Apex |
| 6 | Nose Portion (or Front Portion) |
| 8 | Nose Depression (or Cutout or Trough) |

-continued

| No. | Component |
|---|---|
| 10 | Centerline of Nose Depression |
| 12 | Ogive |
| 14 | Secant Ogive |
| 16 | Tangent Ogive |
| 18 | Shoulder |
| 20 | Cylindrical Portion (i.e., Shank) |
| 22 | Nose Remaining Portion (or Non-Distorted Portion or Uncut Portion; i.e., portion between nose depressions) |
| 24 | Cavity |
| 26 | Driving Band |
| 26A | Angled Driving Band |
| 28 | Relief Cut |
| 28A | Angled (or Curved) Relief Cut |
| 30 | Base |
| 32 | Linear Portion |
| 34 | Tail Depression |
| 36 | Centerline of Tail Depression |
| 38 | Boat Tail |
| 38A | Chamfer |
| 40 | Housing |
| 42 | Insert |
| 42A | First Insert |
| 42B | Second Insert |
| 42C | Third Insert |
| 44 | Longitudinal Axis (of Projectile, Insert, or Housing) |
| 46 | Tail Remaining Portion (or Non-Distorted Portion or Uncut Portion; i.e., portion between tail depressions) |
| 48 | Arrowhead (of Insert) |
| 50 | Stem (of Insert) |
| 52 | Lower Portion or Underside (of Arrowhead) |
| 54 | Lower Portion or Underside (of Stem) |
| 56 | Front (of Housing) |
| 58 | Receiving Portion (of Housing) |
| 60 | Rifling Marks |
| 62 | Pealed Portion (of Housing) |
| 64 | Rolled Portion (of Housing) |
| 66 | First Nose Portion (or Front Nose Portion) |
| 68 | Second Nose Portion (or Rear Nose Portion) |
| 70 | Rear Edge (of Housing) |
| 72 | Cutter Edge |
| 74 | Cannelure |
| 76 | Thick Portion of Stem (of Insert) |
| 78 | Thin Portion of Stem (of Insert) |
| 80 | Remaining Portion between Cutouts (of Insert) |
| 82 | Band on Insert |
| 84 | Front Portion of Insert |
| 86 | Rear Portion of Insert |
| 88 | Tip of Rear Portion (of Insert) |
| 90 | Base Portion (of Housing) |
| 92 | Edge (of Nose Depression) |
| 94 | Cutout in Housing |
| 100 | Target/Gel |
| 102 | Hollow-Point Bullet Affected Area |
| 104 | Invention Affected Area |
| $\alpha$ | Alpha Angle, Angle of Nose Depression |
| $\beta$ | Beta Angle |
| $\Delta$ | Delta Angle, Tail Depression Angle |
| $\theta$ | Theta Angle, Boat Tail Angle |
| $\gamma$ | Gamma Angle, Angle between Angled Driving Band and Angled Relief Cut |
| $\sigma$ | Sigma Angle, Angle between Driving Band and Relief Cut |
| $\lambda$ | Lambda Angle, Angle of Underside (of Stem) |
| $\tau$ | Tao Angle, Angle of Step from Thick to Thin Portion (of Stem) |
| D1 | Cylindrical Portion Diameter (i.e., Caliber) |
| D2 | Diameter of Relief Cut |
| D3 | Diameter of Driving Band |
| D4 | Diameter of Insert Stem |
| D5 | Diameter of Arrowhead of Insert |
| D6 | Diameter of Thick Portion of Stem (of Insert) |
| D7 | Diameter of Thin Portion of Stem (of Insert) |
| H1 | Height of Rear Portion of First Nose Portion |
| L1 | Length of Projectile |
| L2 | Length of Nose Portion |
| L3 | Length of Cylindrical Portion |

-continued

| No. | Component |
|---|---|
| L4 | Length of Boat Tail |
| L5 | Length of Housing |
| L6 | Length of Insert |
| L6A | Length of First Insert |
| L6B | Length of Second Insert |
| L6C | Length of Third Insert |
| L7 | Length of Broach-type Cut |
| L8 | Length of First Nose Portion/Length of Nose (of Insert) |
| L9 | Length of Linear Portion |
| L10 | Length of Second Nose Portion |
| L11 | Length of Cut |
| L12 | Length of Thick Portion of Stem (of Insert) |
| L13 | Length of Thin Portion of Stem (of Insert) |
| L14 | Length of Front Portion of Insert |
| L15 | Length of Rear Portion of Insert |
| L17 | Length of the Wide Portion of the Cavity |
| L18 | Length of the Narrow Portion of the Cavity |
| L19 | Length of Projectile from Second Nose Portion to Base |
| W1 | Width of Broach-type Cut |
| R1 | Radius of Curvature of Ogive |
| R2 | Radius of Curvature of Tangent Ogive |
| R3 | Radius of Curvature of Secant Ogive |
| R4 | Radius of Curvature of Nose Depression |
| R5 | Radius of Curvature of Tail Depression |
| R6 | Radius of Curvature of Relief Cut |
| R7 | Radius of Curvature of Tip |
| R8 | Radius of Curvature between Boat Tail and Base |

It should be understood that the drawings are not necessarily to scale, and various dimensions may be altered. However, drawings that are to scale, are so marked or otherwise indicated. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

The accompanying drawings, which are incorporated in and constitute a part of the specification, illustrate embodiments of the invention and together with the general description of the invention given above, and the detailed description of the drawings given below, serve to explain the principals of this invention.

The attached drawings are generally to scale, although there may be certain exceptions. In certain instances, details that are not necessary for an understanding of the invention or that render other details difficult to perceive may have been omitted. It should be understood, of course, that the invention is not necessarily limited to the particular embodiments illustrated herein or specific dimensions.

Embodiments of pistol and rifle projectiles are provided herein. Some embodiments comprise three or more angled cuts or depressions and are manufactured with a circular or a flat cutter. The depressions or cuts are in part defined by multiple angles. The first angle of the depressions or cuts is the alpha angle, which can, in some embodiments, determine the sharpness of the tip and cutter edges and is best viewed from a side elevation view. The alpha angle can also control the depth of penetration of the projectile in its target and the amount of media the projectile will cast off during penetration. A steeper alpha angle will result in deeper penetration and a blunter alpha angle will create a wider wound path. In a preferred embodiment, the alpha angle is between 2 degrees and about 45 degrees; in a more preferred embodiment the alpha angle range is between about 5 and 30 degrees. In some embodiments, this angle is not constant.

Projectiles have been tested with increasing bluntness (i.e., a curve) and resulted in massive terminal ballistics trajectories. The beginning angle was nearly 0 degrees and the end angle was nearly 45 degrees off of centerline. This embodiment was manufactured by running a ball end mill at an angle (which can be the alpha angle) relative to the centerline of the projectile. The size of the cutter varies by caliber, projectile weight, and desired performance characteristics. In some embodiments, the radius of the cutter is roughly one caliber; a cutter smaller than one caliber will result in deeper troughs and sharper ridges.

The beta angle is the amount that the cut is off from a radius line as viewed from the front of the projectile. The beta angle and the alpha angle will determine the spin or rate of twist of the projectile during penetration. Typically, pistol barrel twist rates vary more than rifle barrel twist rates by manufacturer or brand. A barrel twist rate is expressed as one turn per a number of inches of barrel; a 1:10 or "1 in 10 inches" barrel twist means a bullet makes one rotation or twist while traveling 10 inches in a gun barrel. To obtain the greatest penetration possible, the alpha angle matches or exceeds the barrel rate of twist and is in the same direction. This allows the projectile to corkscrew or drill into the media. For most embodiments, the alpha angle is between about 7 to 15 degrees in a right-hand twist and alternating 4-25 degrees. In another embodiment, if a design objective is to have a pistol bullet that penetrates armor and then stops in tissue, the alpha angle will be in the opposite direction of the barrel twist (this condition is also referred to as a "reversed angle to twist rate" or "reversing the barrel twist rate"). From testing, the congruency of barrel twist rate has little effect on penetrating sheet metal, Kevlar, glass, and other hard surfaces. When the barrel twist rate is in the opposite direction as the alpha angle, it has a substantial effect on the depth of penetration in soft media. A reversed angle to barrel twist rate results in permanent wound channels with secondary wounds. A secondary wound is where an object, such as a bone, in the terminal media is cast off the projectile and creates a new wound path.

There are two basic embodiments of pistol projectiles: a two-piece projectile (which may be called a jacketed projectile) and non-jacketed projectile. The non-jacketed embodiment is not intended to change shape during terminal ballistics and has the deepest and straightest penetration. Reversing the barrel twist rate (i.e., an alpha angle in the opposite direction to the barrel twist rate) results in less penetration and greater destruction but not to the same degree as the two-piece projectile. However, typically only pistol projectiles have reversed twist rates because rifle projectiles tend to be unstable with a reversed twist rate. But, one embodiment includes a rifle projectile with a reversed twist rate. Some embodiments have a zero alpha angle and the projectile still displays the characteristics of penetrating hard surfaces and woven material well. FIGS. 1-2, 12, 20-23, and 25-31 present non-jacketed pistol projectile embodiments.

FIGS. 3-11, 13-19, 24, and 32-40 present rifle projectile embodiments.

FIGS. 3-11, 13-19, 24, and 32-40 are scaled drawings of projectile embodiments. Intended users include big game hunters and long range target shooters. Among other things, these embodiments provide deep, straight penetration with transfer of energy.

These embodiments may be manufactured of materials comprising brass, copper, lead, tungsten-carbide, and alloys associated therewith.

The fronts of various embodiments of projectiles are made up of several cuts that form troughs and ridges. The number of ridges may be equal to the number of lands and grooves in a barrel. Generally, the number of ridges should equal the number of lands and grooves in the barrel or be a multiple thereof.

In the rifle projectiles, the twist rate of the ridges will likely correlate to or be greater than the rate of twist in the barrel although by no more than 1-2 degrees. In one preferred embodiment, the twist rate on the front of the projectile varies from 2-16 degrees; in a more preferred embodiment the twist rate on the front of the projectile varies between 4-12 degrees, depending on the rifle barrel's twist rate.

The barrel degree of twist may be referenced as a rate of twist such as 1 revolution in X amount of inches (e.g., 1 in 8" twist rate). The fins at the back of the rifle projectile correspond to—but are not necessarily in line with—the twist rate of the ridges at the front of the projectile. The design of the rifle projectile affects the flight of the projectile (external ballistics) and further affects the time in the barrel (internal ballistics). The depth and length of the twisting depressions, in some embodiments, is not as critical as the rate of twist. The twisting elements cannot extend through the center section or shaft of the projectile. Deeper twisting elements will create sharper ridges between the twisting depressions. The diameter of the trough will change with the caliber of the projectile. These twisting depressions will not only twist around the projectile, but will follow the convex shape of the front of the projectile. In some embodiments, the twist rate is approximately a 7-degree right-hand twist rate, corresponding to a 1-in-8 rate of twist.

When looking at a rifle projectile from a side elevation view, the curve from the tip to the elongated side wall of the cartridge is called the ogive, divided generally into three parts: the tip, the secant ogive and tangent ogive. As bullets are scalable, one refers to the sizes in calibers. Caliber is the diameter of the shaft. The entire ogive of the projectile may be greater in length than the length of two calibers and in other embodiments may be greater than the length of three calibers. This length will be determined by the maximum case length subtracted from the case overall length ("COL"). The COL is typically determined by the internal length of the magazine, but is sometimes limited by the throat of the chamber where the lands and the grooves disappear into the chamber.

As mentioned, the ogive is broken into three distinct parts. The tip is made of a cone with a non-curved profile and extends back for approximately the length of a half caliber or less. The tip is blended into a secant ogive that comprises the majority of the entire ogive. The secant ogive is based on a circle with a radius of approximately 8 times the caliber. There are grooves that run the length of the secant ogive and these grooves match identically the pitch and number of the lands and grooves of the rifling in the barrel. Typically, the secant ogive will be approximately two calibers in length depending on the intended rifle and chambering. These grooves that cut at a 7 to 8 degree angle through the secant ogive in many embodiments, are congruent with the rifling and are produced with a ball end mill and have smooth entrance and exit points. In the center of the secant ogive, the ball cut is at its deepest and forms a ridge with the cuts on either side running parallel to one another. The diameter of the cutter is approximately one third of a caliber. This sharp ridge runs the majority of the secant ogive and is intended to maintain the spin of the projectile in flight and aid in penetration during terminal ballistics. The last portion of the ogive, approximately half of a caliber in length, is comprised of a tangent ogive. The tangent ogive is the curve of a circle with a radius of approximately four calibers. The grooves cut in the secant ogive dissipate before the secant ogive's junction with the tangent ogive, thus ensuring that the grooves will never interact with the rifling, which would create a variable with the free bore portion of the projectile path during firing.

The shaft of the projectile will now be described. The shaft is the cylindrical center section that interfaces with the barrel and the case neck. The proportional length varies with desired weight and is composed of driving bands (i.e., ridges) and relief cuts (i.e., troughs). The junction of these surfaces is angular and smoothed to minimize interaction with the atmosphere during exterior ballistics. The depth of the relief cut is just beyond the inner dimension of the lands. There is a minimal number of driving bands, located at the front and back of the shaft with at least one more in the center section near the end of the case neck near the junction of the case's shoulder and neck. The relief cuts will lower the total friction in the barrel during internal ballistics.

The tail section of the bullet may include many geometric shapes, including a boat tail. The boat tail reduces diameter from the shaft in a cone shape at a 7.5 degree angle. In one embodiment, the boat tail is about .7 of a caliber in length. The boat tail can also extend, at the 7.5 degree reduction, to a point making it over two times a given caliber in length. This section may be grooved with a mill. These tail twisting depressions also run congruent with the pitch of the rifling. In a preferred embodiment, the tail twisting depressions are cut to between a 2-15 degree right-hand twist. In a more preferred embodiment, the tail twisting depressions are cut to between a 4-10 degree right-hand twist. In a most preferred embodiment, the tail twisting depressions are cut at a 7 to 8 degree right-hand twist. In one embodiment, the tail twisting depressions are cut at either a 7 or an 8 degree right-hand twist. In another embodiment, the tail twisting depressions are cut with a left-hand twist. These tail twisting depressions line up with the twisting depressions on the secant ogive, if extended. At the back of the boat tail, the tail twisting depressions come together and form sharp ridges that direct the atmosphere and maintain the projectile's flight. The tail twisting depressions end abruptly, shortly before the junction with the shaft.

The aforementioned tail twisting depressions provide interaction with the rapidly expanding propellant and help to twist the projectile through the rifling, thus greatly reducing friction with the barrel. These reductions in friction produce significantly higher than normal muzzle velocities and allow the barrel to heat at a significantly lower rate. The boat tails that extend all the way to a point may eliminate or reduce the audible supersonic crack of the bullet in flight. The twisting depressions at the front in combination with the tail twisting depressions at the back may reduce the rotational friction with the atmosphere and eliminate the whistle associated with the flight of a bullet. The twisting depressions (front and back) may also maintain the rate of twist during external ballistics, which may reduce the long range deterioration of accuracy.

The two-piece projectile embodiments are comprised of two parts: the housing and the insert. The housing is a cup that holds the insert and forms the bearing surface with the barrel. The housings may be formed by a lathe or swaging process and out of a material suitable for interaction with a barrel (brass or copper, for example). In some embodiments, the leading edge of the housing will intersect with the trailing edge of the ridge on the insert. In various embodiments, the troughs of the insert protrude below the mouth of the housing and into the cavity of the housing. This is an important feature because these troughs are the mechanism that transfer the media into the housing and initiate the deformation or opening of the housing. This process will increase the wound channel and limit the penetration depth. When the barrel twist rate is the opposite (or "reverse") of the alpha angle, the process just described becomes exponentially more rapid and therefore the wound channel increases laterally but penetration is limited and controlled. The housing is in contact with the insert at the housing mouth and the portion at the back designed to hold the insert. The insert can be chemically bonded to the housing at the back or lower surface of the insert in some embodiments. In other embodiments, the insert is compression fit into the housing. There is generally a void or receiving portion through the center section of the housing. This void aids in the uniform deformation of the housing and aids the housing to open unilaterally. The material for the insert is made from, but not limited to, steel, aluminum, brass, and polymers. FIGS. 2, 10, 12-16, 18, 20, 24-31, 33-36, and 38 are embodiments of two-piece projectiles.

Referring to FIGS. 1A-2C, which are pistol projectile embodiments that, among other things, provide deep straight penetration. These projectiles 2 are different from the prior art because they can pierce armor and stop in soft tissue. The sharp tip 4 and sharp cutter edges 72 allow these projectiles 2 to cut through armor, including Kevlar.

Additionally, the shoulders 18 of the projectile 2 enable the projectile 2 to stop in soft tissue because the shoulders slow the projectile 2 down once it hits soft tissue. Further, these projectiles 2 create a lot of cavitation in soft tissue, thus making a wound larger than it would be with a projectile of the prior art. Intended users of these projectiles comprise military and law enforcement.

The construction of these projectiles may be accomplished using a press or mill and lathe. One unique and innovative feature is the shape of the front of the projectile 2, which has a slight radius coming off the bearing surface (the cylindrical portion 20 or the shaft) but is largely formed by angled or slightly twisting depressions 8 pointed to the front. The depressions 8 form troughs and ridges (and remaining portions 22 between the depressions) that possess an angle or a slight radius off the centerline 44 (longitudinal axis) of the projectile 2. In some embodiments, the twist angle of the depressions 8 corresponds to (i.e., is equal to) or is greater than the barrel twist rate (i.e., the twist rate of the rifling in the barrel) and turns in the same direction as the barrel's rifling. In other embodiments, the twist angle of the depressions 8 is equal to or greater than the barrel twist rate and turns in the opposite direction as the barrel's rifling. These depressions 8 do not affect the projectile during internal ballistics but they greatly enhance the performance during external and/or terminal ballistics. In some embodiments, the intersection between the remaining portion 22 and depression 8 forms an edge 92. The edge 92 can be a sharp edge with a sharp corner or the edge can be a rounded curved edge 92. In some embodiments, at the center of the tip 4 or a portion of the nose 6 proximate the tip 4, the depressions 8 meet to form a cutting surface or cutting edge 72. These edges 72 initiate a cut in the target, greatly reducing resistance through media such as sheet metal, fabrics, and soft armor. The twisting troughs 8 move media away from the projectile 2 further reducing resistance and promoting and maintaining the spin to ensure the projectile 2 penetrates deep and straight. The troughs 8 may rapidly move liquids and soft tissue away from the path of the projectile and therefore increase the wound channel.

In one embodiment of the pistol projectile, terminal ballistics traits are emphasized. The tip 4 of the projectile 2 is formed such that the trough 8 is at an angle (alpha or $\alpha$) relative to the longitudinal axis 44 of the projectile. Due to magazine and chamber constraints, projectiles have a maximum length. The density of the material will determine this alpha angle because a steeper alpha angle cuts better, but has a lower weight. The steeper alpha angle will also transfer media at a greater rate into the housing for a faster opening and expansion upon impact with the terminal media for the two-piece projectiles.

In some embodiments, the twist rate of the ridges can equal to or exceeds, by up to double, the twist rate of the barrel. In one embodiment, the projectile would increase the rate of twist once it struck the terminal media. In one embodiment, an insert with a counter twist to (i.e., in the opposite direction of) the rifling is provided, therefore limiting penetration once the projectile cuts through the outer layer of its target. The twist rate in the insert may also be reversed (i.e., in the opposite direction to the barrel twist). Twist rates in most handguns, run from 4-7 degrees, but could be between 2-10 degrees.

Figure 1B:
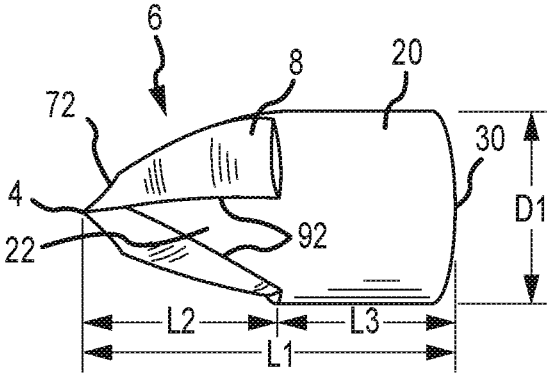
Figure 1C:
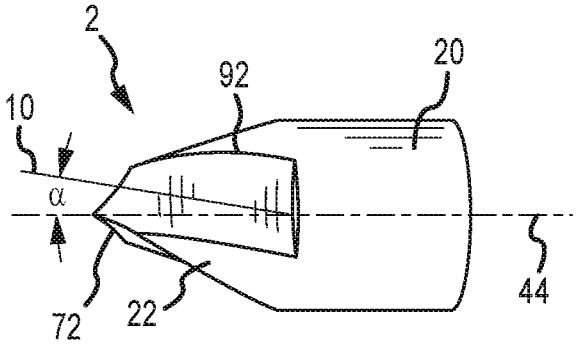
Figure 1D:
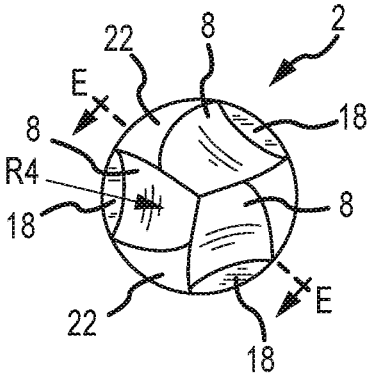
Figure 1E:
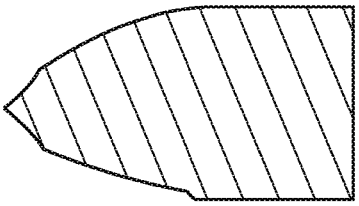
Figure 1F:
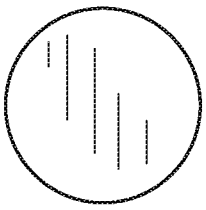

FIGS. 1A-F show a projectile 2 according to a first embodiment. FIG. 1A is a perspective view of the projectile 2. FIG. 1B is a side elevation view of the projectile 2. FIG. 1C is another side elevation view of the projectile 2. FIG. 1D is a top plan view of the projectile 2. FIG. 1E is a cross-sectional view of the projectile 2 taken along cut E-E of FIG. 1D. FIG. 1F is a bottom plan view of the projectile 2. Note that FIGS. 1A-F are to scale.

The projectile 2 is for pistols and comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and nose remaining portions 22 (also called non-distorted portions or uncut portions) between the nose depressions 8, where each nose remaining portion 22 is positioned between two nose depressions 8. The remaining portions 22 are the uncut portions having the projectile's original ogive. The remaining portions 22 have a generally triangular shape with the tip of the triangle positioned proximate to the tip 4 of the projectile and the base of the triangle positioned proximate to the rear of the nose 6 and the forward portion of the cylindrical portion 20. A first edge 92 is formed between a nose depression 8 and a remaining portion 22 and a second edge 72 (i.e., cutter edge) proximate the tip 4 is formed between two nose depressions 8. The first edge 92 can be a sharp edge with a sharp corner or the edge can be a rounded curved edge 92. The nose depressions 8 terminate in a substantially flat shoulder 18 proximate to the junction between the nose portion 6 and the cylindrical portion 20. The nose depressions 8 have a curved shape meaning that the trough or bottom surface of the nose depression 8 is curved and has a radius of curvature R4. In one embodiment, the nose depressions are cut using a ⅜ inch flat end mill.

The longitudinal axis 44 of the projectile 2 is shown in FIG. 1C. Accordingly, the angle $\alpha$ of the nose depressions 8 can be measured relative to the longitudinal axis 44 and the centerline 10 of the nose depression 8. In some embodiments, the angle $\alpha$ is measured relative to the original ogive of the projectile nose portion 6. Alternatively, the orientation of the depressions 8 or cutout portions can be oriented or measured with respect to the ogive of the remaining portion. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. Further, when looking at the projectile from a top plan view (FIG. 1D), the nose depressions 8 appear to turn in a counter-clockwise direction. In one embodiment, the projectile 2 has at least three nose depressions 8. However, the projectile 2 can have more or fewer nose depressions 8.

In one embodiment, the radius of curvature R4 of the nose depressions 8 is between about 1/16 inches and about 0.750 inches. In a preferred embodiment, the radius of curvature R4 of the nose depressions 8 is between about 3/32 inches and about 3/8 inches. In a more preferred embodiment, the radius of curvature R4 of the nose depressions 8 is about 0.1875 inches. In one embodiment, the length L1 of the projectile 2 is between about 0.400 inches and about 0.900 inches. In a preferred embodiment, the length L1 of the projectile 2 is between about 0.550 inches and about 0.750 inches. In a more preferred embodiment, the length L1 of the projectile 2 is about 0.643 inches. In one embodiment, the length L2 of the nose portion 6 is between about 0.150 inches and about 0.500 inches. In a preferred embodiment, the length L2 of the nose portion 6 is between about 0.250 inches and about 0.400 inches. In a more preferred embodiment, the length L2 of the nose portion 6 is about 0.343 inches. In one embodiment, the length L3 of the cylindrical portion 20 is between about 0.100 inches and about 0.500 inches. In a preferred embodiment, the length L3 of the cylindrical portion 20 is between about 0.200 inches and about 0.400 inches. In a more preferred embodiment, the length L3 of the cylindrical portion 20 is about 0.300 inches. The diameter D1 of the projectile 2 (also called the caliber) varies according to the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 35 degrees. In a preferred embodiment, the angle α of the nose depressions 8 is between about 15 degrees and about 25 degrees. In a more preferred embodiment, the angle α of the nose depressions 8 is about 20 degrees.

Figure 2A:
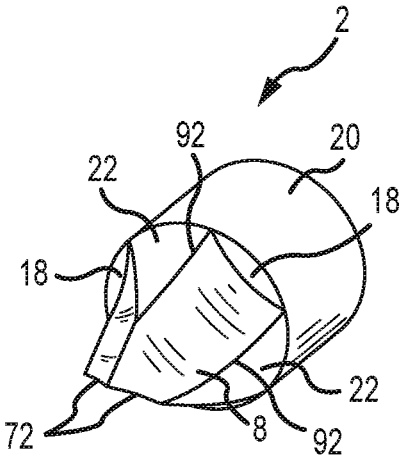
FIGS. 2A-D show a projectile according to a second embodiment of the invention.
Figure 2B:
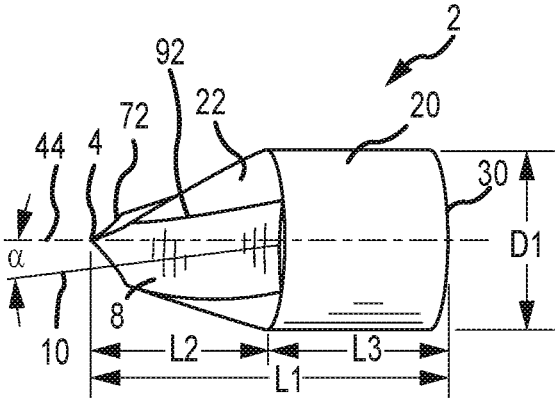
Figure 2C:
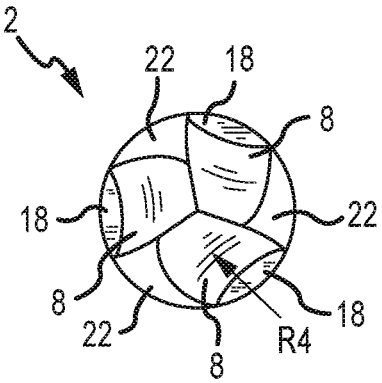
Figure 2D:
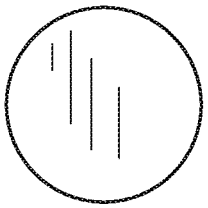

FIGS. 2A-D show a projectile according to a second embodiment of the invention. This projectile is similar to the projectile of FIG. 1, except that this projectile 2 is two pieces: a nose portion 6 insert that is compression fit into a cylindrical portion 20 housing. Each piece may be a different material in one embodiment. For example, the nose portion 6 insert is made of steel and the cylindrical portion 20 housing is made of brass. However, the projectile 2 can be made of any projectile or bullet material, such as any metal alloy, brass, steel, tungsten, polymers, ceramics, aluminum, Inconel, or any other material known in the art. FIG. 2A is a perspective view of the projectile 2. FIG. 2B is a side elevation view of the projectile 2. FIG. 2C is a top plan view of the projectile 2. FIG. 2D is a bottom plan view of the projectile 2. Note that FIGS. 2A-D are to scale.

The projectile 2 comprises a tip 4 on one end opposite a base 30 on the other end. The projectile 2 comprises a nose portion 6 and a cylindrical portion 20. The nose portion 6 includes nose depressions 8 and nose remaining portions 22 between the nose depressions 8. The remaining portions 22 are the uncut portions having the projectile's original ogive. The remaining portions 22 have a generally triangular shape with the tip of the triangle positioned proximate to the tip 4 of the projectile 2 and the base of the triangle positioned proximate to the rear of the nose 6 and the forward portion of the cylindrical portion 20. A first edge 92 is formed between a nose depression 8 and a remaining portion 22 and a second edge 72 (i.e., cutter edge) proximate the tip 4 is formed between two nose depressions 8. The first edge 92 can be a sharp edge with a sharp corner or the edge can be a rounded curved edge. The nose depressions 8 terminate in a substantially flat shoulder 18. The nose depressions 8 have a curved shape meaning that the trough or bottom of the nose depression 8 is curved and has a radius of curvature R4. In one embodiment, the nose depressions are cut using a 3/8 inch flat end mill.

The longitudinal axis 44 of the projectile 2 is shown in FIG. 2B. Accordingly, the angle α of the nose depressions 8 can be measured relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are left-hand nose depressions 8 because the angle α is positioned to the left of the longitudinal axis 44. Further, when looking at the projectile from a top plan view (FIG. 2C), the nose depressions 8 appear to turn in a clockwise direction. In one embodiment, the projectile 2 has at least three nose depressions 8. However, the projectile 2 can have more or fewer nose depressions 8.

In one embodiment, the radius of curvature R4 of the nose depressions 8 is between about 1/16 inches and about 0.750 inches. In a preferred embodiment, the radius of curvature R4 of the nose depressions 8 is between about 3/32 inches and about 3/8 inches. In a more preferred embodiment, the radius of curvature R4 of the nose depressions 8 is about 0.1875 inches. In one embodiment, the length L1 of the projectile 2 is between about 0.400 inches and about 0.900 inches. In a preferred embodiment, the length L1 of the projectile 2 is between about 0.550 inches and about 0.750 inches. In a more preferred embodiment, the length L1 of the projectile 2 is about 0.643 inches. In one embodiment, the length L2 of the nose portion 6 is between about 0.150 inches and about 0.500 inches. In a preferred embodiment, the length L2 of the nose portion 6 is between about 0.250 inches and about 0.400 inches. In a more preferred embodiment, the length L2 of the nose portion 6 is about 0.343 inches. In one embodiment, the length L3 of the cylindrical portion 20 is between about 0.100 inches and about 0.500 inches. In a preferred embodiment, the length L3 of the cylindrical portion 20 is between about 0.200 inches and about 0.400 inches. In a more preferred embodiment, the length L3 of the cylindrical portion 20 is about 0.300 inches. The diameter D1 of the projectile 2 (also called the caliber) varies according to the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 35 degrees. In a preferred embodiment, the angle α of the nose depressions 8 is between about 15 degrees and about 25 degrees. In a more preferred embodiment, the angle α of the nose depressions 8 is about 20 degrees.

FIGS. 3A-11F are projectiles with unique and novel tail geometries. Some embodiments of the present invention include tail depressions 34 cut into the boat tail 38 of the projectile 2. The tail design is almost entirely for the internal ballistics of the projectile, i.e., while the projectile is in the gun barrel. The tail depressions 34 act like a propeller to make the projectile 2 rotate. If the projectile 2 is rotating at the same twist rate or a similar twist rate to the barrel's twist rate, then the projectile 2 will barely slow down when it hits the lands and grooves in the barrel. This reduces the pressure exerted on the barrel of the gun and reduces the wear on the barrel. Typically, if a gun barrel has four lands and grooves, then the projectile will have four tail depressions 34. The same is true for fewer or more lands and grooves, i.e., the number of lands and grooves typically equals the number of tail depressions 34. Additionally, the tail depressions 34 are defined by a delta angle Δ. In one embodiment, the delta angle Δ is congruent to or greater than the twist rate. Nominal twist rates will be between about 3.5 and 9.0 degrees. The delta angle Δ of the tail depressions 34 may exceed the twist rate by about 10.0 degrees. An optimal delta angle will be no more than about 1.5 degrees beyond the rate of twist angle. FIG. 9 has a boat tail 38 with depressions 34 that also help the projectile 2 perform better during terminal ballistics because the boat tail 38 with depressions 34 keeps the projectile 2 flying straight after it enters the soft tissue of an animal.

Figure 3A:
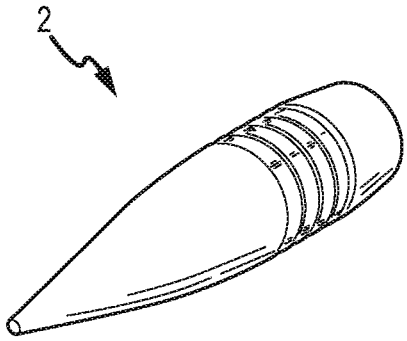
FIGS. 3A-F show a projectile according to a third embodiment of the invention.
Figure 3B:
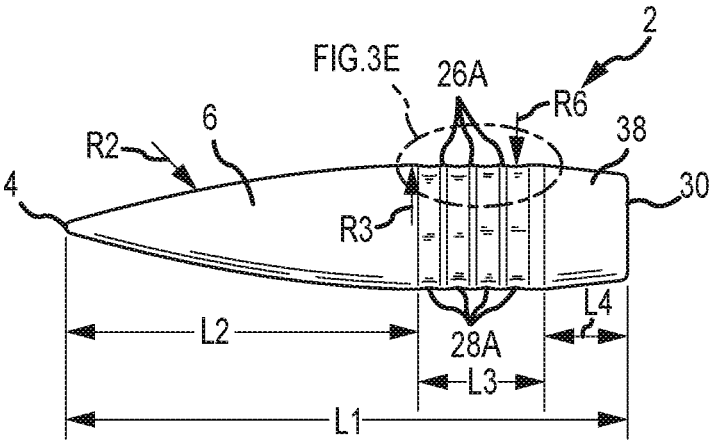
Figure 3C:
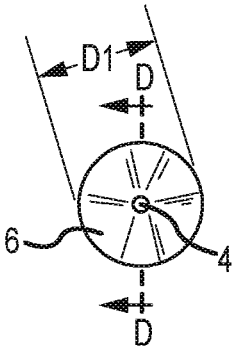
Figure 3D:
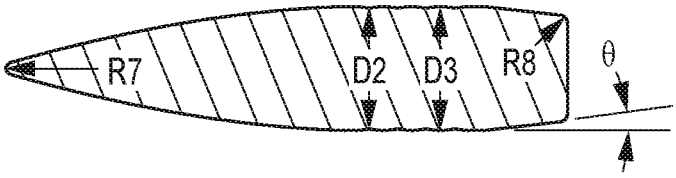
Figure 3E:
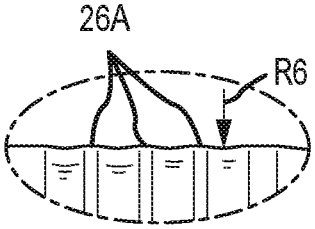
Figure 3F:
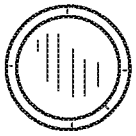

FIGS. 3A-F show a projectile 2 according to a third embodiment of the invention. FIG. 3A is a perspective view of the projectile 2. FIG. 3B is a side elevation view of the projectile 2. FIG. 3C is a top plan view of the projectile 2. FIG. 3D is a cross section of the projectile 2 taken along cut D-D in FIG. 3C. FIG. 3E is an enlarged view of a portion of the projectile 2 shown in FIG. 3B. FIG. 3F is a bottom plan view of the projectile 2. Note that FIGS. 3A-3D and 3F are to scale.

The projectile 2 comprises a tip 4 on one end opposite a base 30 on the other end. The projectile 2 comprises a nose portion 6 proximate the tip 4 on one end and interconnected to a cylindrical portion 20 on the other end. The cylindrical portion 20 is interconnected to a boat tail 38 on the end opposite the nose. The boat tail 38 terminates in the base 30 with a radius of curvature R8 between the boat tail 38 and the base 30. In alternate embodiments, the driving bands 26A vary in number, comprising one driving band 26A, a plurality of driving bands 26A, two driving bands 26A, three driving bands 26A, and four or more driving bands 26A.

The cylindrical portion 20 can comprise multiple angled relief bands 28A and angled driving bands 26A. The driving bands 26A alternate with the relief bands 28A. The angles between the driving bands 26A and relief cuts 28A (relative to the horizontal) are between about 7 degrees and about 10 degrees. In one embodiment, angles between the driving bands 26A and relief cuts 28A (relative to the horizontal) are about 7.5 degrees. In another embodiment, angles between the driving bands 26A and relief cuts 28A (relative to the horizontal) are about 8.5 degrees. In one embodiment, the weight of the projectile is about 154 grams.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R7 of the tip 4 is between about 0.030 inches and about 0.005 inches. In a preferred embodiment, the radius of curvature R7 of the tip 4 is between about 0.020 inches and about 0.010 inches. In a more preferred embodiment, the radius of curvature R7 of the tip 4 is about 0.015 inches. In one embodiment, the radius of curvature R8 between the boat tail 38 and the base 30 is between about 0.035 inches and about 0.010 inches. In a preferred embodiment, the radius of curvature R8 between the boat tail 38 and the base 30 is between about 0.025 inches and about 0.015 inches. In a more preferred embodiment, the radius of curvature R8 between the boat tail 38 and the base 30 is about 0.020 inches.

In one embodiment, the length L1 of the projectile 2 is between about 1.25 inches and about 1.75 inches. In a preferred embodiment, the length L1 of the projectile 2 is between about 1.4 inches and about 1.5 inches. In a more preferred embodiment, the length L1 of the projectile 2 is about 1.435 inches. In one embodiment, the length L2 of the nose portion 6 is between about 0.50 inches and about 1.10 inches. In a preferred embodiment, the length L2 of the nose portion 6 is between about 0.75 inches and about 1.00 inch. In a more preferred embodiment, the length L2 of the nose portion 6 is about 0.8633 inches. In one embodiment, the length L3 of the cylindrical portion 20 is between about 0.25 inches and about 0.50 inches. In a preferred embodiment, the length L3 of the cylindrical portion 20 is between about 0.30 inches and about 0.40 inches. In a more preferred embodiment, the length L3 of the cylindrical portion 20 is about 0.322 inches. In one embodiment, the length L4 of the boat tail 38 is between about 0.10 inches and about 0.35 inches. In a preferred embodiment, the length L4 of the boat tail 38 is between about 0.15 inches and about 0.25 inches. In a more preferred embodiment, the length L4 of the boat tail 38 is about 0.215 inches. The diameter D1 of the projectile 2 (also called the caliber) varies according to the various embodiments. In one embodiment, the diameter D1 of the projectile 2 is between about 0.220 inches and about 0.450 inches. In a preferred embodiment, the diameter D1 of the projectile 2 is between about 0.290 inches and about 0.350 inches. In the embodiment shown, the diameter D1 of the projectile 2 is about 0.308 inches. In one embodiment, the diameter D2 of the angled relief cut 28A is between about 0.20 inches and about 0.40 inches. In a preferred embodiment, the diameter D2 of the angled relief cut 28A is between about 0.25 inches and about 0.31 inches. In the embodiment shown, the diameter D2 of the angled relief cut 28A is about 0.298 inches. In one embodiment, the diameter D3 of the angled driving band 26A is between about 0.25 inches and about 0.32 inches. In a preferred embodiment, the diameter D3 of the angled driving band 26A is between about 0.30 inches and about 0.31 inches. In the embodiment shown, the diameter D3 of the angled driving band 26A is about 0.307 inches. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7 degrees.

In alternate embodiments, the projectile 2 can have nose depressions and/or tail depressions. This projectile 2 is different from the prior art because it can pierce armor and fly for an extended range. This projectile 2 is also capable of flying supersonic. The projectile 2 is extremely accurate even at long distances.

Figure 4A:
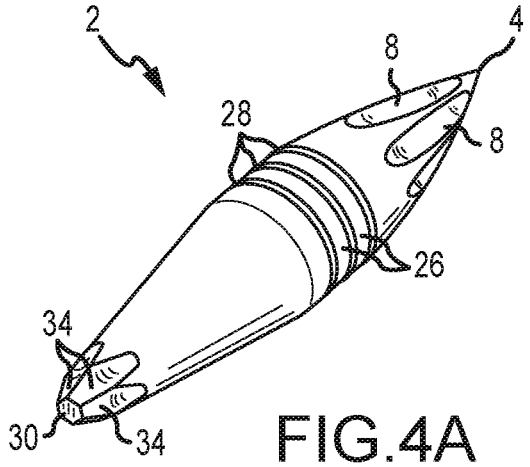
FIGS. 4A-C show a projectile according to a fourth embodiment of the invention.
Figure 4B:
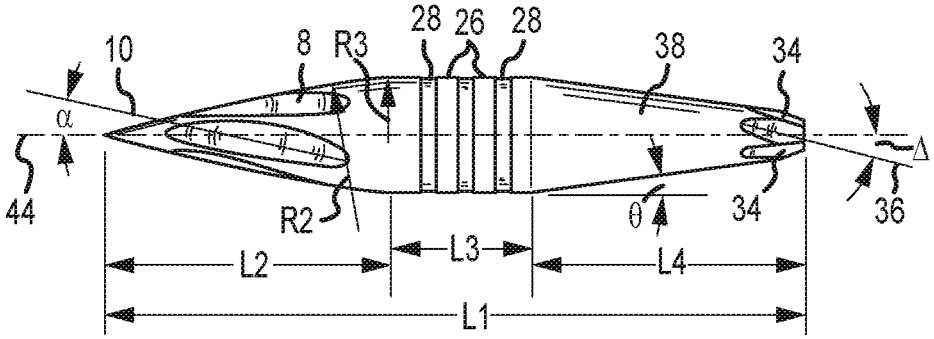
Figure 4C:
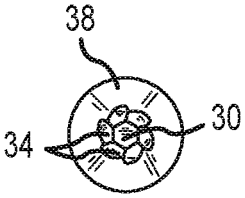

FIGS. 4A-C show a projectile according to a fourth embodiment of the invention. FIG. 4A is a bottom perspective view of the projectile 2. FIG. 4B is a side elevation view of the projectile 2. FIG. 4C is a bottom plan view of the projectile 2. Note that FIGS. 4A-C are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8. The remaining portions 22 are the uncut portions having the projectile's original ogive. The nose depressions 8 run from the tip 4 to a portion of the projectile 2 proximate the central portion 20. The nose depressions 8 have a curved shape meaning that the trough or bottom of the nose depression 8 is curved and has a radius of curvature R4. The boat tail 34 includes tail depressions 34 and tail remaining portions between the tail depressions 34. The remaining portions are the uncut portions. The tail depressions 34 run from the base 30 to a portion of the boat tail 38. The tail depressions 34 have a curved shape meaning that the trough or bottom of the tail depression 34 is curved and has a radius of curvature. In one embodiment, the nose depressions 8 are cut using a 3/16 inch to a 3/8 inch ball end mill and the tail depressions 34 are cut using a 1/8 inch ball end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The longitudinal axis 44 of the projectile 2 is shown in FIG. 4B. Accordingly, the angle α of the nose depressions 8 can be measured relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. Accordingly, the angle Δ of the tail depressions 34 can be measured by measuring the angle of the tail depression centerline 36 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles Δ. In the embodiment shown, the tail depressions 34 are right-hand tail depressions 34 because the angle Δ is positioned to the right of the longitudinal axis 44. Further, when looking at the projectile 2 from a bottom plan view (FIG. 4C), the tail depressions 34 appear to turn in a counterclockwise direction. In one embodiment, the projectile 2 has at least 6 tail depressions 34. However, the projectile 2 can have more or fewer tail depressions 34.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R4 of the nose depressions 8 is between about 0.05 inches and about 0.15 inches. In a preferred embodiment, the radius of curvature R4 of the nose depressions 8 is between about 0.75 inches and about 0.1 inches. In a more preferred embodiment, the radius of curvature R4 of the nose depressions 8 is about 0.09375 inches. In one embodiment, the radius of curvature of the tail depression 34 is between about 0.040 inches and about 0.080 inches. In a preferred embodiment, the radius of curvature of the tail depression 34 is between about 0.030 inches and about 0.050 inches. In a more preferred embodiment, the radius of curvature of the tail depression 34 is about 0.0625 inches. In one embodiment, the length L1 of the projectile 2 is between about 1.50 inches and about 2.75 inches. In a preferred embodiment, the length L1 of the projectile 2 is between about 2.0 inches and about 2.3 inches. In a more preferred embodiment, the length L1 of the projectile 2 is about 2.150 inches. In one embodiment, the length L2 of the nose portion 6 is between about 0.600 inches and about 1.00 inch. In a preferred embodiment, the length L2 of the nose portion 6 is between about 0.700 inches and about 0.900 inches. In a more preferred embodiment, the length L2 of the nose portion 6 is about 0.800 inches. In one embodiment, the length L3 of the cylindrical portion 20 is between about 0.20 inches and about 0.60 inches. In a preferred embodiment, the length L3 of the cylindrical portion 20 is between about 0.30 inches and about 0.50 inches. In a more preferred embodiment, the length L3 of the cylindrical portion 20 is about 0.400 inches. In one embodiment, the length L4 of the boat tail 38 is between about 0.50 inches and about 1.50 inches. In a preferred embodiment, the length L4 of the boat tail 38 is between about 0.75 inches and about 1.25 inches. In a more preferred embodiment, the length L4 of the boat tail 38 is about 0.950 inches. The diameter D1 of the projectile 2 (also called the caliber) varies according the various embodiments. In one embodiment, the diameter D1 of the projectile 2 is between about 0.220 inches and about 0.45 inches. In a preferred embodiment, the diameter D1 of the projectile 2 is between about 0.29 inches and about 0.32 inches. In the embodiment shown, the diameter D1 of the projectile 2 is about 0.308 inches. In one embodiment, the angle α of the nose depressions 8 is between about 2 degrees and about 10 degrees. In a preferred embodiment, the angle α of the nose depressions 8 is between about 4 degrees and about 7 degrees. In a more preferred embodiment, the angle α of the nose depressions 8 is about 5.5 degrees. In one embodiment, the angle Δ of the boat tail 38 is between about 5 degrees and about 10 degrees. In a preferred embodiment, the angle Δ of the boat tail 38 is between about 6 degrees and about 9 degrees. In a more preferred embodiment the angle Δ of the boat tail 38 is about 7.5 degrees.

This projectile 2 is different from the prior art because it can pierce armor and stop in soft tissue. The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 5A:
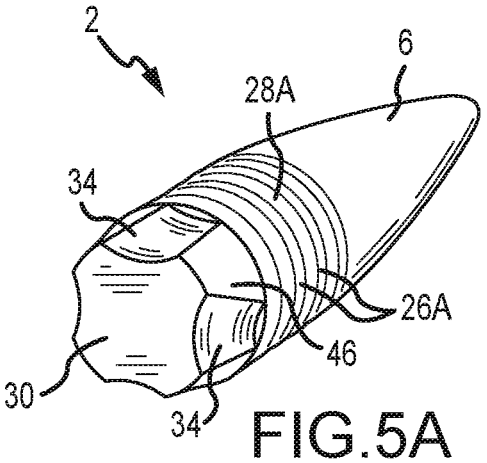
FIGS. 5A-C show a projectile according to a fifth embodiment of the invention.
Figure 5B:
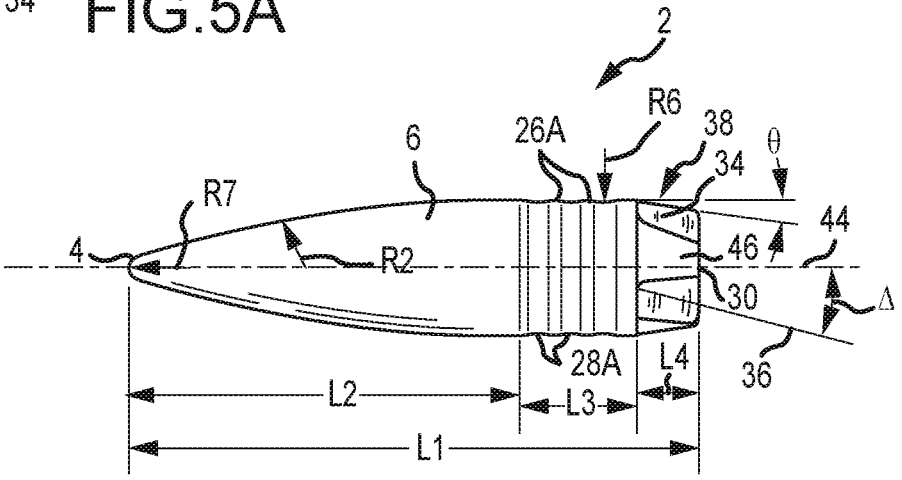
Figure 5C:
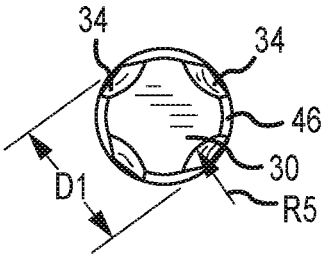

FIGS. 5A-C show a projectile according to a fifth embodiment of the invention. FIG. 5A is a bottom perspective view of the projectile 2. FIG. 5B is a side elevation view of the projectile 2. FIG. 5C is a bottom plan view of the projectile 2. Note that FIGS. 5A-C are to scale.

The projectile 2 comprises a tip 4 on one end opposite a base 30 on the other end. The projectile 2 comprises a nose portion 6, a cylindrical portion 20, and a boat tail 38. The boat tail 38 includes tail depressions 34 and tail remaining portions 46 between the tail depressions 34. The remaining portions 46 are the uncut portions. The tail depressions 34 run from the base 30 to a portion of the boat tail 38. The tail depressions 34 have a curved shape meaning that the trough or bottom of the tail depression 34 is curved and has a radius of curvature R5. In one embodiment, the tail depressions 34 are cut using a ⅜ inch flat end mill. The cylindrical portion 20 of the projectile can also comprise angled driving bands 26A and angled relief cuts 28A. Some embodiments have one or more angled driving bands 26A and angled relief cuts 28A. The widths of the angled driving bands 26A and angled relief cuts 28A can vary or they can all be the same. The angled driving bands 26A alternate with the angled relief cuts 28A. The angles between the driving bands 26A and relief cuts 28A (relative to the horizontal) are between about 7 degrees and about 10 degrees. In one embodiment, angles between the driving bands 26A and relief cuts 28A (relative to the horizontal) are about 7.5 degrees. In another embodiment, the angles between the driving bands 26A and relief cuts 28A (relative to the horizontal) are about 8.5 degrees.

The angle Δ of the centerline 36 of the tail depressions 34 can be measured relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles Δ. In the embodiment shown, the tail depressions 34 are right-hand tail depressions 34 because the angle Δ is positioned to the right of the longitudinal axis 44. Further, when looking at the projectile from a bottom plan view (FIG. 5C), the tail depressions 34 appear to turn in a counter-clockwise direction. In one embodiment, the projectile 2 has at least six tail depressions 34. In the embodiment shown, the projectile 2 has four tail depressions 34. However, the projectile 2 can have more or fewer tail depressions 34.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R7 of the tip 4 is between about 0.030 inches and about 0.005 inches. In a preferred embodiment, the radius of curvature R7 of the tip 4 is between about 0.020 inches and about 0.010 inches. In a more preferred embodiment, the radius of curvature R7 of the tip 4 is about 0.015 inches.

In one embodiment, the length L1 of the projectile 2 is between about 1.0 inch and about 1.6 inches. In a preferred embodiment, the length L1 of the projectile 2 is between about 1.15 inches and about 1.45 inches. In a more preferred embodiment, the length L1 of the projectile 2 is about 1.30 inches. In one embodiment, the length L2 of the nose portion 6 is between about 0.75 inches and about 1.25 inches. In a preferred embodiment, the length L2 of the nose portion 6 is between about 0.80 inches and about 1.0 inch. In a more preferred embodiment, the length L2 of the nose portion 6 is about 0.900 inches. In one embodiment, the length L3 of the cylindrical portion 20 is between about 0.10 inches and about 0.40 inches. In a preferred embodiment, the length L3 of the cylindrical portion 20 is between about 0.20 inches and about 0.30 inches. In a more preferred embodiment, the length L3 of the cylindrical portion 20 is about 0.225 inches. In one embodiment, the length L4 of the boat tail 38 is between about 0.10 inches and about 0.30 inches. In a preferred embodiment, the length L4 of the boat tail 38 is between about 0.15 inches and about 0.20 inches. In a more preferred embodiment, the length L4 of the boat tail 38 is about 0.175 inches. The diameter D1 of the projectile 2 varies according the various embodiments. In one embodiment, the diameter D1 of the projectile 2 is between about 0.20 inches and about 0.40 inches. In a preferred embodiment, the diameter D1 of the projectile 2 is between about 0.25 inches and about 0.35 inches. In the embodiment shown, the diameter D1 of the projectile 2 is about 0.300 inches. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees. In one embodiment, the angle Δ of the tail depressions is between about 5 degrees and about 10 degrees. In a preferred embodiment, the angle Δ of the tail depressions is between about 7.0 degrees and about 8.0 degrees. In a more preferred embodiment the angle Δ of the tail depressions 34 is about 7.8 degrees. In one embodiment, angles between the driving bands 26A and relief cuts 28A (relative to the horizontal) are about 7.5 degrees. In another embodiment, angles between the driving bands 26A and relief cuts 28A (relative to the horizontal) are about 8.5 degrees.

In alternate embodiments, the projectile 2 can have nose depressions and/or tail depressions. This projectile 2 is different from the prior art because it can pierce armor fly an extended range. This projectile is also capable of flying supersonic. It is also extremely accurate even at long distances.

Figure 6A:
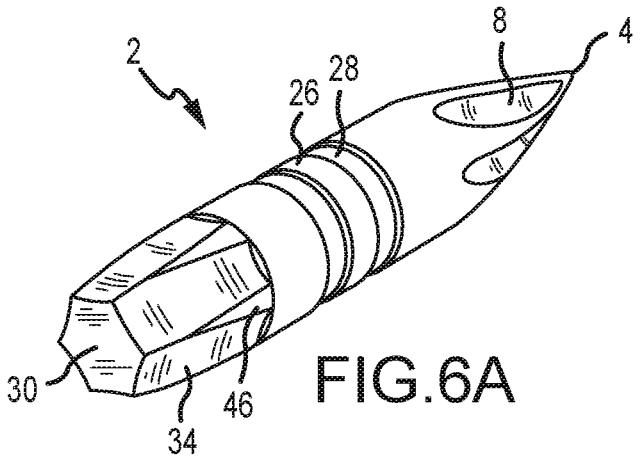
FIGS. 6A-C show a projectile according to a sixth embodiment of the invention.
Figure 6B:
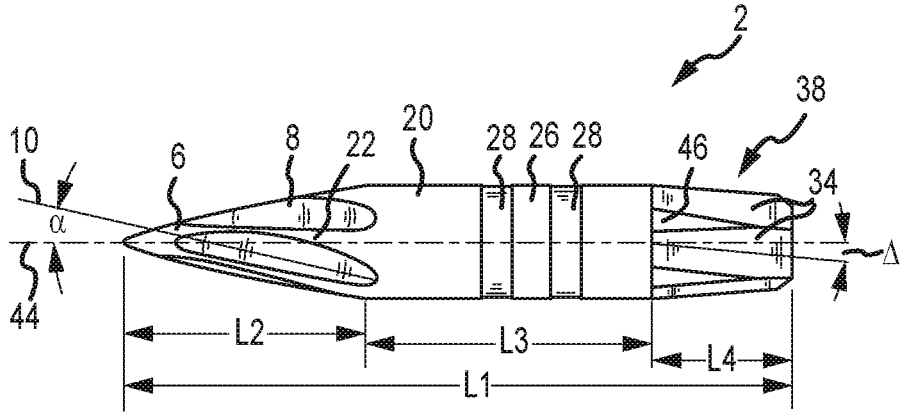
Figure 6C:
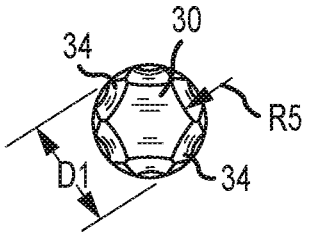

FIGS. 6A-C show a projectile according to a sixth embodiment of the invention. FIG. 6A is a bottom perspective view of the projectile 2. FIG. 6B is a side elevation view of the projectile 2. FIG. 6C is a bottom plan view of the projectile 2. Note that FIGS. 6A-C are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The nose depressions 8 run from the tip 4 to a portion of the projectile proximate the central portion 20. The nose depressions 8 have a curved shape meaning that the trough or bottom of the nose depression 8 is curved and has a radius of curvature. The boat tail 34 includes tail depressions 34 and tail remaining portions 46 between the tail depressions 34, where each tail remaining portion 46 is positioned between two tail depressions 34. The remaining portions 46 are the uncut portions. The tail depressions 34 run from the base 30 to a portion of the boat tail 38 proximate the cylindrical portion 20. The tail depressions 34 have a curved shape meaning that the trough or bottom of the tail depression 34 is curved and has a radius of curvature R5. In one embodiment, the nose depressions 8 are cut using a 3/16 inch to a 3/8 inch ball end mill and the tail depressions 34 are cut using a 3/8 inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same.

The longitudinal axis 44 of the projectile 2 is shown in FIG. 6B. Accordingly, the angle α of the nose depressions 8 can be measured relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. The angle of the tail depressions 34 can also be measured relative to the longitudinal axis 44. In some embodiments, all tail depressions 34 have the same angle. In other embodiments, each tail depression 34 has a different angle. In still other embodiments, some tail depressions 34 have the same angle while other tail depressions 34 have different angles. In the embodiment shown, the tail depressions 34 are right-hand tail depressions 34 because the angle is positioned to the right of the longitudinal axis 44.

Further, when looking at the projectile from a bottom plan view (FIG. 6C), the tail depressions 34 appear to turn in a counterclockwise direction. In one embodiment, the projectile 2 has at least six tail depressions 34. However, the projectile 2 can have more or fewer tail depressions 34.

In one embodiment, the radius of curvature of the nose depression 8 is between about 0.20 inches and about 0.05 inches. In a preferred embodiment, the radius of curvature of the nose depression 8 is between about 0.15 inches and about 0.07 inches. In a more preferred embodiment, the radius of curvature of the nose depression 8 is about 0.09375 inches. In one embodiment, the radius of curvature R5 of the tail depressions 34 is between about 0.10 inches and about 0.30 inches. In a preferred embodiment, the radius of curvature R5 of the tail depressions 34 is between about 0.15 inches and about 0.20 inches. In a more preferred embodiment, the radius of curvature R5 of the tail depressions 34 is about 0.1875 inches. In one embodiment, the length L1 of the projectile 2 is between about 1.0 inch and about 2.5 inches. In a preferred embodiment, the length L1 of the projectile 2 is between about 1.5 inches and about 2.0 inches. In a more preferred embodiment, the length L1 of the projectile 2 is about 1.80 inches. In one embodiment, the length L2 of the nose portion 6 is between about 0.50 inches and about 1.0 inch. In a preferred embodiment, the length L2 of the nose portion 6 is between about 0.70 inches and about 0.80 inches. In a more preferred embodiment, the length L2 of the nose portion 6 is about 0.750 inches. In one embodiment, the length L3 of the cylindrical portion 20 is between about 0.40 inches and about 0.90 inches. In a preferred embodiment, the length L3 of the cylindrical portion 20 is between about 0.55 inches and about 0.75 inches. In a more preferred embodiment, the length L3 of the cylindrical portion 20 is about 0.65 inches. In one embodiment, the length L4 of the boat tail 38 is between about 0.20 inches and about 0.60 inches. In a preferred embodiment, the length L4 of the boat tail 38 is between about 0.30 inches and about 0.50 inches. In a more preferred embodiment, the length L4 of the boat tail 38 is about 0.400 inches. The diameter D1 of the projectile 2 (also called the caliber) varies according the various embodiments. In one embodiment, the diameter D1 of the projectile 2 is between about 0.22 inches and about 0.50 inches. In a preferred embodiment, the diameter D1 of the projectile 2 is between about 0.30 inches and about 0.40 inches. In the embodiment shown, the diameter D1 of the projectile 2 is about 0.338 inches. In one embodiment, the angle α of the nose depressions 8 is between about 5 degrees and about 10 degrees. In a preferred embodiment, the angle α of the nose depressions 8 is between about 6 degrees and about 9 degrees. In a more preferred embodiment, the angle α of the nose depressions 8 is about 7.5 degrees. In one embodiment, the angle θ of the boat tail 38 is between about 5 degrees and about 10 degrees. In a preferred embodiment, the angle of the boat tail 38 is between about 6.5 degrees and about 8.0 degrees. In a more preferred embodiment, the angle of the boat tail 38 is about 7.5 degrees. In one embodiment, the angle Δ of the tail depressions 34 is between about 4.0 degrees and about 10.0 degrees. In a preferred embodiment, the angle Δ of the tail depressions 34 is between about 5.0 degrees and about 7.0 degrees. In a more preferred embodiment the angle Δ of the tail depressions 34 is about 6.0 degrees. The angle Δ of the tail depression 34 is measured from the centerline 36 of the tail depression 34 relative to the longitudinal axis 44.

This projectile 2 is different from the prior art because it can pierce armor and stop in soft tissue. The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 7A:
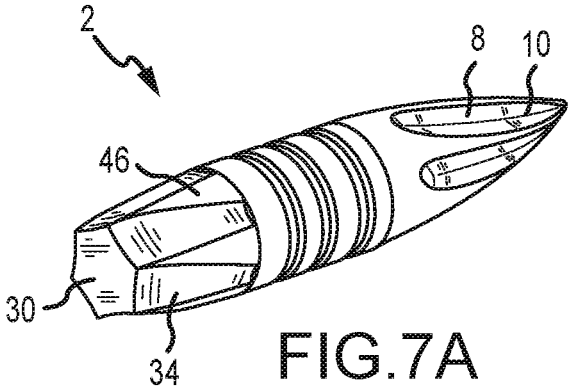
FIGS. 7A-C show a projectile according to a seventh embodiment of the invention.
Figure 7B:
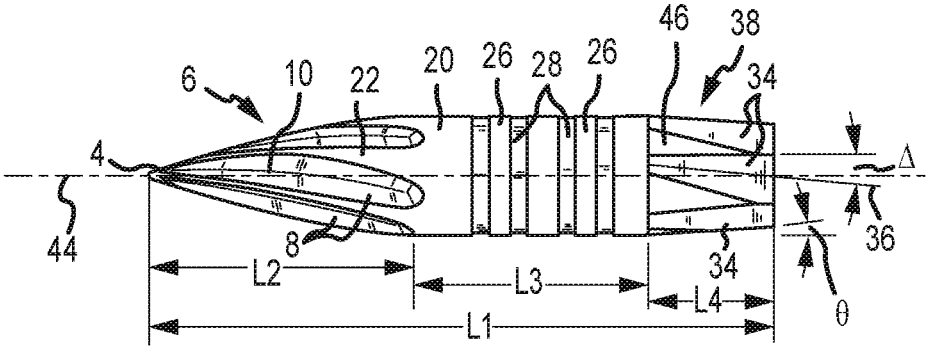
Figure 7C:
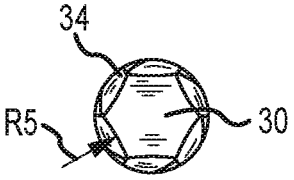

FIGS. 7A-C show a projectile according to a seventh embodiment of the invention. FIG. 7A is a bottom perspective view of the projectile 2. FIG. 7B is a side elevation view of the projectile 2. FIG. 7C is a bottom plan view of the projectile 2. Note that FIGS. 7A-C are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8. The nose remaining portions 22 are the uncut portions having the projectile's original ogive. The nose depressions 8 run from the tip 4 to a portion of the projectile proximate the cylindrical portion 20. The nose depressions 8 have a curved shape meaning that the trough or bottom of the nose depression 8 is curved and has a radius of curvature R4. The boat tail 38 includes tail depressions 34 and tail remaining portions 46 between the tail depressions 34, where each tail remaining portion 46 is positioned between two tail depressions 34. The tail remaining portions 46 are the uncut portions. The tail depressions 34 run from the base 30 to a portion of the boat tail 38 proximate the cylindrical portion 20. The tail depressions 34 can have a curved shape meaning that the trough or bottom of the tail depression 34 is curved and has a radius of curvature R5. In one embodiment, the nose depressions 8 are cut using a 120 degree cutter and the tail depressions 34 are cut using a ⅜ inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same. In additional embodiments, the cylindrical portion 20 has angled driving bands and angled relief cuts like shown in FIGS. 35B and 35E.

The longitudinal axis 44 of the projectile 2 is shown in FIG. 7B. Accordingly, the angle α of the nose depressions 8 can be measured from the centerline 10 of the nose depressions 8 relative to the longitudinal axis 44. In some embodiments, the angle α is measured from the centerline 10 of the nose depressions 8 relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. The angle Δ of the tail depressions 34 can be measured from the centerline 36 of the tail depression 34 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles Δ. In the embodiment shown, the tail depressions 34 are right-hand tail depressions 34 because the angle Δ is positioned to the right of the longitudinal axis 44. Further, when looking at the projectile from a bottom plan view (FIG. 7C), the tail depressions 34 appear to turn in a counterclockwise direction. In one embodiment, the projectile 2 has at least 6 tail depressions 34. However, the projectile 2 can have more or fewer tail depressions 34.

In one embodiment, the radius of curvature R5 of the tail depressions 34 is between about 0.10 inches and about 0.30 inches. In a preferred embodiment, the radius of curvature R5 of the tail depressions 34 is between about 0.15 inches and about 0.20 inches. In a more preferred embodiment, the radius of curvature R5 of the tail depressions 34 is about 0.1875 inches. In one embodiment, the length L1 of the projectile 2 is between about 1.0 inch and about 2.5 inches. In a preferred embodiment, the length L1 of the projectile 2 is between about 1.5 inches and about 2.0 inches. In a more preferred embodiment, the length L1 of the projectile 2 is about 1.80 inches. In one embodiment, the length L2 of the nose portion 6 is between about 0.50 inches and about 1.0 inch. In a preferred embodiment, the length L2 of the nose portion 6 is between about 0.70 inches and about 0.80 inches. In a more preferred embodiment, the length L2 of the nose portion 6 is about 0.750 inches. In one embodiment, the length L3 of the cylindrical portion 20 is between about 0.40 inches and about 0.90 inches. In a preferred embodiment, the length L3 of the cylindrical portion 20 is between about 0.55 inches and about 0.75 inches. In a more preferred embodiment, the length L3 of the cylindrical portion 20 is about 0.65 inches. In one embodiment, the length L4 of the boat tail 38 is between about 0.20 inches and about 0.60 inches. In a preferred embodiment, the length L4 of the boat tail 38 is between about 0.30 inches and about 0.50 inches. In a more preferred embodiment, the length L4 of the boat tail 38 is about 0.400 inches. The diameter of the projectile 2 varies according the various embodiments. In one embodiment, the diameter of the projectile 2 is between about 0.22 inches and about 0.45 inches. In a preferred embodiment, the diameter of the projectile 2 is between about 0.29 inches and about 0.31 inches. In the embodiment shown, the diameter of the projectile 2 is about 0.308 inches. In one embodiment, the angle α of the nose depressions 8 is between about 2 degrees and about 10 degrees. In a preferred embodiment, the angle α of the nose depressions 8 is between about 4 degrees and about 7 degrees. In a more preferred embodiment, the angle α of the nose depressions 8 is about 5.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees. In one embodiment, the angle Δ of the tail depressions 34 is between about 6 degrees and about 9 degrees. In a preferred embodiment, the angle Δ of the tail depressions 34 is between about 7.0 degrees and about 8.5 degrees. In a more preferred embodiment the angle Δ of the tail depressions 34 is about 7.8 degrees.

This projectile 2 is different from the prior art because it can pierce armor and stop in soft tissue. The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 8A:
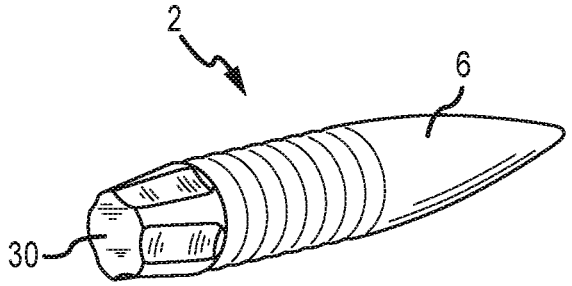
FIGS. 8A-C show a projectile according to an eighth embodiment of the invention.
Figure 8B:
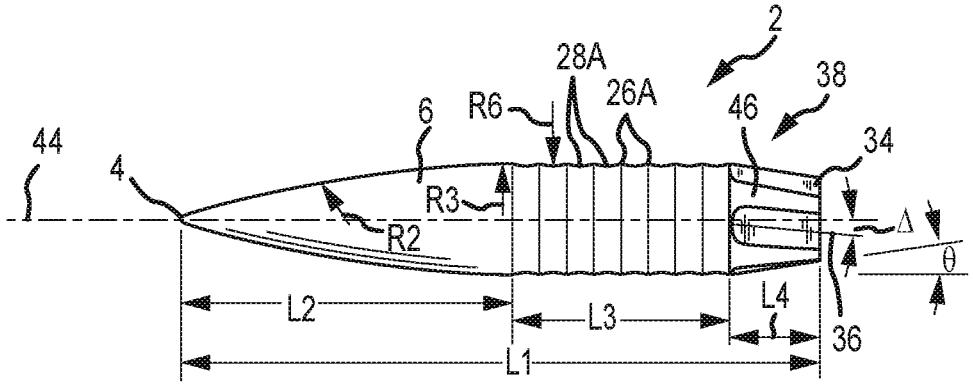
Figure 8C:
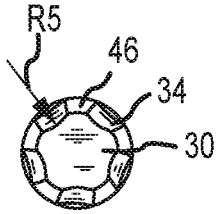

FIGS. 8A-C show a projectile according to an eighth embodiment of the invention. FIG. 8A is a bottom perspective view of the projectile 2. FIG. 8B is a side elevation view of the projectile 2. FIG. 8C is a bottom plan view of the projectile 2. Note that FIGS. 8A-C are to scale.

The projectile 2 comprises a tip 4 on one end opposite a base 30 on the other end. The projectile 2 comprises a nose portion 6, a cylindrical portion 20, and a boat tail 38. The boat tail 34 includes tail depressions 34 and tail remaining portions 46 between the tail depressions 34, where each tail remaining portion 46 is positioned between two tail depressions 34. The remaining portions 46 are the uncut portions. The tail depressions 34 run from the base 30 to a portion of the boat tail 38 proximate the cylindrical portion 20. The tail depressions 34 can have a curved shape, meaning that the trough or bottom of the tail depression 34 is curved and has a radius of curvature R5. In one embodiment, the tail depressions 34 are cut using a ⅜ inch flat end mill. The cylindrical portion 20 of the projectile can also comprise angled driving bands 26A and angled relief cuts 28A. Some embodiments have one or more angled driving bands 26A and angled relief cuts 28A. The widths of the angled driving bands 26A and angled relief cuts 28A can vary or they can all be the same. The driving bands 28A alternate with the relief bands 26A. The angles between the driving bands 26A and angled relief cuts 28A (relative to the horizontal) are between about 7 degrees and about 10 degrees. In one embodiment, angles between the driving bands 26A and, angled relief cuts 28A (relative to the horizontal) are about 7.5 degrees. In another embodiment, angles between the driving bands 26A and relief cuts 28A (relative to the horizontal) are about 8.5 degrees.

The angle Δ of the tail depressions 34 can be measured from the centerline 36 of the tail depression 34 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles Δ. In the embodiment shown, the tail depressions 34 are right-hand tail depressions 34 because the angle Δ is positioned to the right of the longitudinal axis 44. Further, when looking at the projectile 2 from a bottom plan view (FIG. 8C), the tail depressions 34 appear to turn in a counterclockwise direction. In one embodiment, the projectile 2 has at least six tail depressions 34. However, the projectile 2 can have more or fewer tail depressions 34.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch.

In one embodiment, the length L1 of the projectile 2 is between about 1.5 inches and about 2.5 inches. In a preferred embodiment, the length L1 of the projectile 2 is between about 1.75 inches and about 2.25 inches. In a more preferred embodiment, the length L1 of the projectile 2 is about 2.1 inches. In one embodiment, the length L2 of the nose portion 6 is between about 0.50 inches and about 1.10 inches. In a preferred embodiment, the length L2 of the nose portion 6 is between about 0.75 inches and about 1.00 inch. In a more preferred embodiment, the length L2 of the nose portion 6 is about 0.8633 inches. In one embodiment, the length L3 of the cylindrical portion 20 is between about 0.25 inches and about 0.50 inches. In a preferred embodiment, the length L3 of the cylindrical portion 20 is between about 0.30 inches and about 0.40 inches. In a more preferred embodiment, the length L3 of the cylindrical portion 20 is about 0.322 inches. In one embodiment, the length L4 of the boat tail 38 is between about 0.10 inches and about 0.45 inches. In a preferred embodiment, the length L4 of the boat tail 38 is between about 0.15 inches and about 0.30 inches. In a more preferred embodiment, the length L4 of the boat tail 38 is about 0.275 inches. The diameter of the projectile 2 (also called the caliber) varies according the various embodiments. In one embodiment, the diameter of the projectile 2 is between about 0.220 inches and about 0.450 inches. In a preferred embodiment, the diameter of the projectile 2 is between about 0.290 inches and about 0.350 inches. In the embodiment shown, the diameter of the projectile 2 is about 0.3080 inches. In one embodiment, the diameter of the angled relief cut 28A is between about 0.20 inches and about 0.40 inches. In a preferred embodiment, the diameter of the angled relief cut 28A is between about 0.25 inches and about 0.31 inches. In the embodiment shown, the diameter of the angled relief cut 28A is about 0.298 inches. In one embodiment, the diameter of the angled driving band 26A is between about 0.25 inches and about 0.32 inches. In a preferred embodiment, the diameter of the angled driving band 26A is between about 0.30 inches and about 0.31 inches. In the embodiment shown, the diameter of the angled driving band 26A is about 0.307 inches or about 0.308 inches. In one embodiment, the angle θ of the boat tail 38 is between about 5 degrees and about 10 degrees. In a preferred embodiment, the angle θ of the boat tail 38 is between about 7.0 degrees and about 8.0 degrees. In a more preferred embodiment, the angle θ of the boat tail 38 is about 7.5 degrees. In one embodiment, the angle Δ of the tail depressions 34 is between about 5 degrees and about 10 degrees. In a preferred embodiment, the angle Δ of the tail depressions 34 is between about 7.0 degrees and about 8.0 degrees. In a more preferred embodiment the angle Δ of the tail depressions 34 is about 7.8 degrees.

In alternate embodiments, the projectile 2 can have nose depressions and/or tail depressions. This projectile 2 is different from the prior art because it can pierce armor fly an extended range. This projectile is also capable of flying supersonic. It is extremely accurate even at long distances.

Figure 9A:
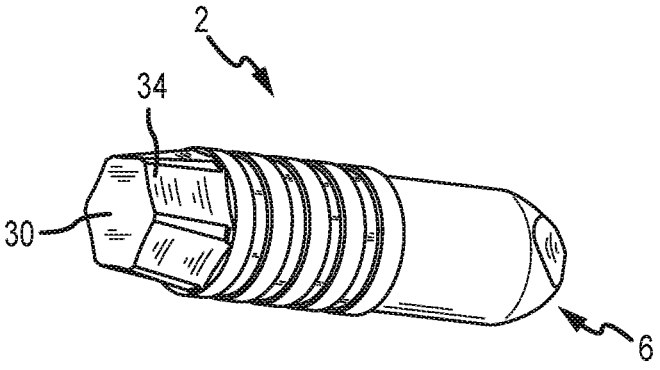
FIGS. 9A-D show a projectile according to a ninth embodiment of the invention.
Figure 9B:
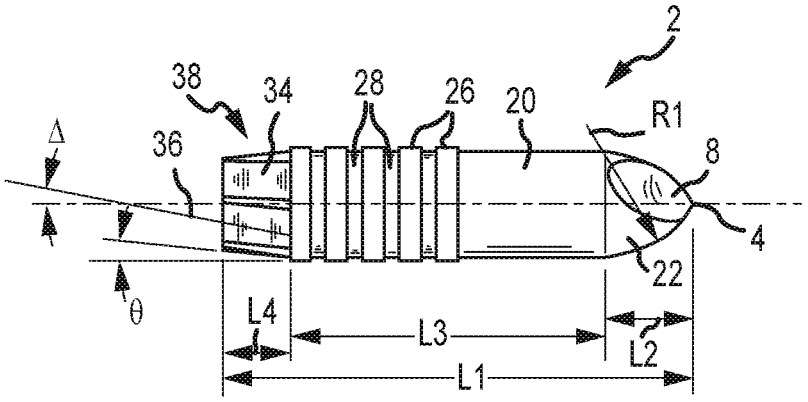
Figure 9C:
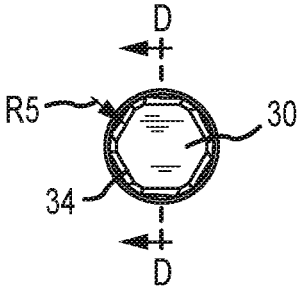
Figure 9D:
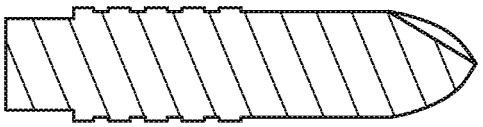

FIGS. 9A-D show a projectile according to a ninth embodiment of the invention. FIG. 9A is a bottom perspective view of the projectile 2. FIG. 9B is a side elevation view of the projectile 2. FIG. 9C is a bottom plan view of the projectile 2. FIG. 9D is a cross sectional view taken at cut D-D of FIG. 9C. Note that FIGS. 9A-D are to scale.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The nose depressions 8 run from the tip 4 to a portion of the projectile proximate the cylindrical portion 20. The nose depressions 8 have a curved shape meaning that the trough or bottom of the nose depression 8 is curved and has a radius of curvature. The boat tail 34 includes tail depressions 34 and tail remaining portions 46 between the tail depressions 34, where each tail remaining portion 46 is positioned between two tail depressions 34. The remaining portions 46 are the uncut portions. The tail depressions 34 run from the base 30 to a portion of the boat tail 38 proximate the cylindrical portion 20. The tail depressions 34 have a curved shape meaning that the trough or bottom of the tail depression 34 is curved and has a radius of curvature R5. In one embodiment, the nose depressions 8 are cut using a 3/16 inch to a 3/8 inch ball end mill and the tail depressions 34 are cut using a 3/8 inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same. In additional embodiments, the cylindrical portion 20 has angled driving bands and angled relief cuts like shown in FIGS. 35B and 35E.

The angle Δ of the tail depressions 34 can be measured from the centerline 36 of the tail depression 34 relative to the longitudinal axis 44. In some embodiments, all tail depressions 34 have the same angle Δ. In other embodiments, each tail depression 34 has a different angle Δ. In still other embodiments, some tail depressions 34 have the same angle Δ while other tail depressions 34 have different angles Δ. In the embodiment shown, the tail depressions 34 are right-hand tail depressions 34 because the angle Δ is positioned to the right of the longitudinal axis 44. Further, when looking at the projectile from a bottom plan view (FIG. 9C), the tail depressions 34 appear to turn in a counterclockwise direction. In one embodiment, the projectile 2 has at least six tail depressions 34. However, the projectile 2 can have more or fewer tail depressions 34.

In one embodiment, the radius of curvature R4 (not shown in FIGS. 9A-9D, but shown in other Figs.) of the nose depressions 8 is between about 0.10 inches and about 0.40 inches. In a preferred embodiment, the radius of curvature of the nose depressions 8 is between about 0.20 inches and about 0.30 inches. In a more preferred embodiment, the radius of curvature of the nose depressions 8 is about 0.25 inches. In one embodiment, the radius of curvature R5 of the tail depressions 34 is between about 0.10 inches and about 0.30 inches. In a preferred embodiment, the radius of curvature R5 of the tail depressions 34 is between about 0.15 inches and about 0.20 inches. In a more preferred embodiment, the radius of curvature R5 of the tail depressions 34 is about 0.1875 inches. In one embodiment, the length L1 of the projectile 2 is between about 1.0 inch and about 2.0 inches. In a preferred embodiment, the length L1 of the projectile 2 is between about 1.25 inches and about 1.75 inches. In a more preferred embodiment, the length L1 of the projectile 2 is about 1.492 inches. In one embodiment, the length L2 of the nose portion 6 is between about 0.10 inches and about 0.40 inches. In a preferred embodiment, the length L2 of the nose portion 6 is between about 0.20 inches and about 0.35 inches. In a more preferred embodiment, the length L2 of the nose portion 6 is about 0.29 inches. In one embodiment, the length L3 of the cylindrical portion 20 is between about 0.75 inches and about 1.25 inches. In a preferred embodiment, the length L3 of the cylindrical portion 20 is between about 0.90 inches and about 1.1 inches. In a more preferred embodiment, the length L3 of the cylindrical portion 20 is about 1.01 inches.

In one embodiment, the length L4 of the boat tail 38 is between about 0.10 inches and about 0.30 inches. In a preferred embodiment, the length L4 of the boat tail 38 is between about 0.15 inches and about 0.25 inches. In a more preferred embodiment, the length L4 of the boat tail 38 is about 0.19 inches. The diameter of the projectile 2 varies according the various embodiments. In one embodiment, the diameter of the projectile 2 is between about 0.20 inches and about 0.50 inches. In a preferred embodiment, the diameter of the projectile 2 is between about 0.30 inches and about 0.45 inches. In the embodiment shown, the diameter of the projectile 2 is about 0.375 inches. In one embodiment, the angle $\alpha$ of the nose depressions 8 is between about 3 degrees and about 8 degrees. In a preferred embodiment, the angle $\alpha$ of the nose depressions 8 is between about 5 degrees and about 6 degrees. In a more preferred embodiment, the angle $\alpha$ of the nose depressions 8 is about 5.6 degrees. In one embodiment, the angle $\theta$ of the boat tail 38 is between about 1 degree and about 5 degrees. In a preferred embodiment, the angle $\theta$ of the boat tail 38 is between about 2.0 degrees and about 4.0 degrees. In a more preferred embodiment, the angle $\theta$ of the of the boat tail 38 is about 3.0 degrees. In one embodiment, the angle $\Delta$ of the tail depressions 34 is between about 4.0 degrees and about 8.0 degrees. In a preferred embodiment, the angle $\Delta$ of the tail depressions 34 is between about 5.0 degrees and about 6.0 degrees. In a more preferred embodiment the angle $\Delta$ of the tail depressions 34 is about 5.6 degrees.

This projectile 2 is designed to shoot into a large animal, e.g., an elephant, and not yaw once it inserts the body. The boat tail 38 of the projectile 2 allows the projectile 2 to perform like this in the soft tissue of an animal. The intended users of the projectile 2 are African big game hunters. The attributes of this projectile 2 are deep straight penetration with transfer of energy. The projectile is comprised of brass, copper, bronze, tungsten-carbide, alloys of these metals, or any material known in the art, including plastics and ceramics. Note that the nose portion 6 of this projectile 2 can be the same or similar to the nose portions shown in FIGS. 21-23.

Figure 10A:
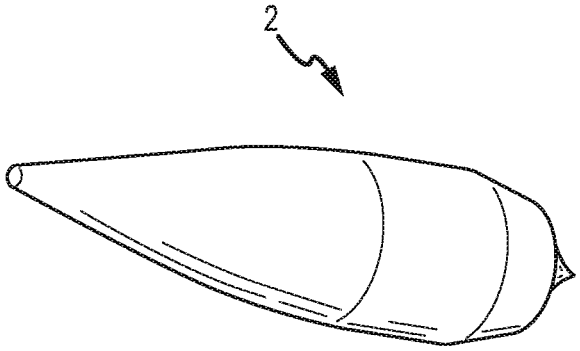
FIGS. 10A-C show a projectile according to a tenth embodiment of the invention.
Figure 10B:
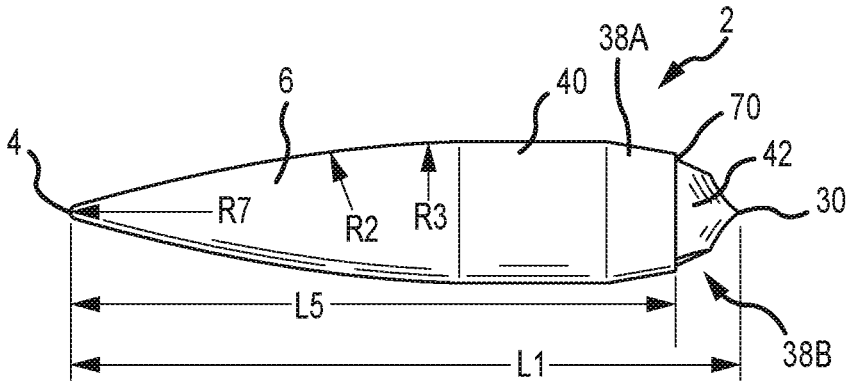
Figure 10C:
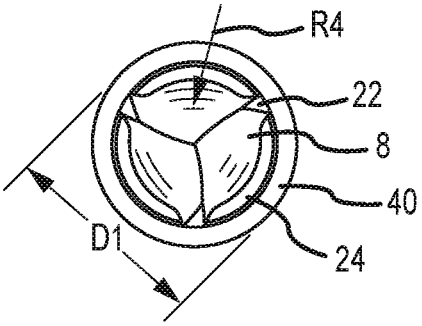

FIGS. 10A-C show a projectile according to a tenth embodiment of the invention. FIG. 10A is a top perspective view of the projectile 2. FIG. 10B is a side elevation view of the projectile 2. FIG. 10C is a bottom plan view of the projectile 2.

The projectile 2 comprises a housing 40 with a tip 4 on one end and rear edge 70 on the opposite end. The projectile 2 also includes an insert 42 with a base 30 opposite the tip 4. The housing 40 comprises a nose portion 6 extending from the tip 4 on to a cylindrical portion 20. The cylindrical portion 20 extends from the nose portion 6 to the boat tail 38A. The housing 40 includes a portion of the boat tail 38A. The insert 42 comprises the rest of the boat tail 38B. In one embodiment, the insert 42 is the same insert shown and described in FIGS. 25 and 27. In additional embodiments, the cylindrical portion 20 can comprise multiple angled relief bands and angled driving bands as shown and described in FIGS. 35A-35E. The driving bands alternate with the relief bands. The angles between the driving bands and relief cuts are between about 7 degrees and about 10 degrees.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the radius of curvature R7 of the tip 4 is between about 0.030 inches and about 0.005 inches. In a preferred embodiment, the radius of curvature R7 of the tip 4 is between about 0.020 inches and about 0.010 inches. In a more preferred embodiment, the radius of curvature R7 of the tip 4 is about 0.015 inches.

In one embodiment, the length L1 of the projectile 2 is between about 1.25 inches and about 2.25 inches. In a preferred embodiment, the length L1 of the projectile 2 is between about 1.4 inches and about 2.0 inches. In a more preferred embodiment, the length L1 of the projectile 2 is about 1.75 inches. In one embodiment, the length L2 of the nose portion 6 is between about 0.50 inches and about 1.10 inches. In a preferred embodiment, the length L2 of the nose portion 6 is between about 0.75 inches and about 1.00 inch. In a more preferred embodiment, the length L2 of the nose portion 6 is about 0.863 inches. The diameter D1 of the projectile 2 (also called the caliber) varies according the various embodiments. In one embodiment, the diameter D1 of the projectile 2 is between about 0.220 inches and about 0.450 inches. In a preferred embodiment, the diameter D1 of the projectile 2 is between about 0.290 inches and about 0.350 inches. In the embodiment shown, the diameter D1 of the projectile 2 is about 0.3080 inches. In one embodiment, the angle $\theta$ of the boat tail 38 is between about 5 degrees and about 10 degrees. In a preferred embodiment, the angle $\theta$ of the boat tail 38 is between about 6.5 degrees and about 8.0 degrees. In a more preferred embodiment, the angle $\theta$ of the boat tail 38 is about 7 degrees. In one embodiment, the length L5 of the housing 40 is between about 1.0 inch and about 2.0 inches. In a preferred embodiment, the length L5 of the housing 40 is between about 1.1 inches and about 1.6 inches. In a more preferred embodiment, the length L5 of the housing 40 is about 1.3 inches.

In this embodiment, the insert 42 acts like a propeller in the gun barrel. Thus, the insert 42 relieves pressure on the gun barrel and increases the speed of the bullet. Relieving pressure reduces the wear on the gun barrel because the projectile is already twisting when it hits the barrel's rifling. Thus, there is not a pressure jump where the rifling begins. Further, the shape of the tail formed by the insert 42 is the ideal shape to interact with the gun powder. The depressions on the tail or insert 42 have a 15 degree twist in one embodiment. The tail shape only enhances performance during internal ballistics because the tail is riding in the slip screen of the projectile during external ballistics.

Figure 11A:
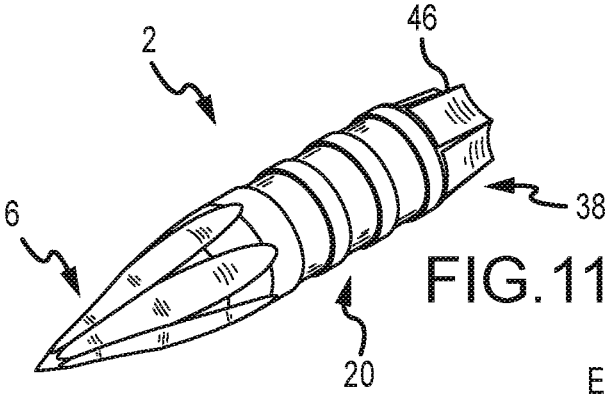
FIGS. 11A-F show a projectile according to an eleventh embodiment of the invention.
Figure 11B:
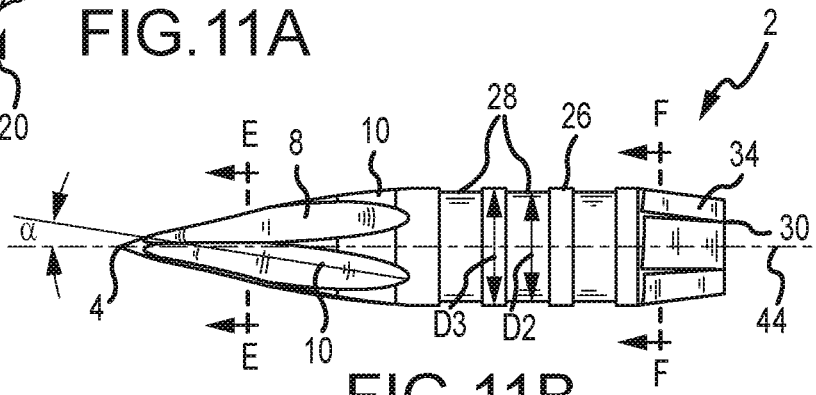
Figure 11C:
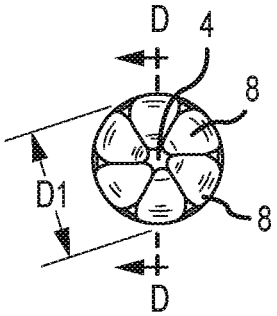
Figure 11D:
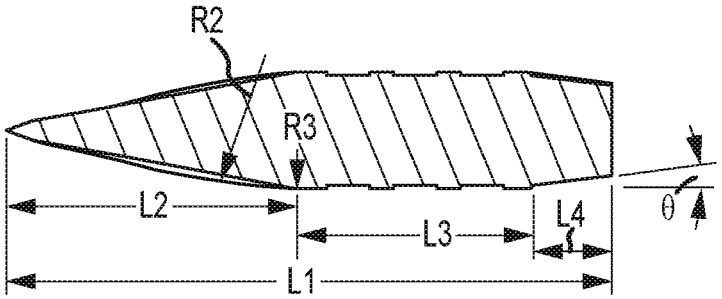
Figure 11E:
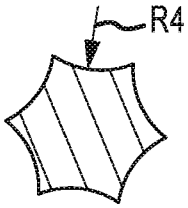
Figure 11F:
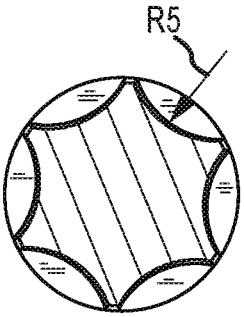

FIGS. 11A-F show a projectile according to an eleventh embodiment of the invention. FIG. 11A is a perspective view of the projectile 2. FIG. 11B is a side elevation view of the projectile 2. FIG. 11C is a top plan view of the projectile 2. FIG. 11D is a cross section taken at cut D-D of FIG. 11C. FIG. 11E is a cross section taken at cut E-E of FIG. 11B. FIG. 11F is a cross section taken at cut F-F of FIG. 11B. Note that FIGS. 11A-D are to scale. FIGS. 11E and 11F are enlarged as compared to FIGS. 11A-D.

The projectile 2 comprises a tip 4 on one end opposite a base 30 on the other end. The projectile 2 comprises a nose portion 6, a cylindrical portion 20, and a boat tail 38. The nose portion 6 includes nose depressions 8 and nose remaining portions 22 between the nose depressions 8, where each nose remaining portion 22 is positioned between two nose depressions 8. The nose remaining portions 22 are the uncut portions having the projectile's original ogive. The nose depressions 8 run from the tip 4 to a portion of the projectile proximate the cylindrical portion 20. The nose depressions 8 have a curved shape meaning that the trough or bottom of the nose depression 8 is curved and has a radius of curvature R4. The boat tail 34 includes tail depressions 34 and tail remaining portions 46 between the tail depressions 34, where each tail remaining portion 46 is positioned between two tail depressions 34. The tail remaining portions 46 are the uncut portions. The tail depressions 34 run from the base 30 to a portion of the boat tail 38 proximate the cylindrical portion 20. The tail depressions 34 have a curved shape meaning that the trough or bottom of the tail depression 34 is curved and has a radius of curvature R5. In one embodiment, the nose depressions 8 are cut using a 0.25 inch ball end mill and the tail depressions 34 are cut using a 0.25 inch flat end mill. The cylindrical portion 20 of the projectile can also comprise driving bands 26 and relief cuts 28. Some embodiments have one or more driving bands 26 and relief cuts 28. The widths of the driving bands 26 and relief cuts 28 can vary or they can all be the same. In additional embodiments, the cylindrical portion 20 has angled driving bands and angled relief cuts like shown in FIGS. 35B and 35E.

The longitudinal axis 44 of the projectile 2 is shown in FIG. 11B. Accordingly, the angle $\alpha$ of the nose depressions 8 can be measured from the centerline 10 of the nose depressions 8 relative to the longitudinal axis 44. In some embodiments, the angle $\alpha$ is measured relative to the original ogive of the projectile nose portion 6. In some embodiments, all nose depressions 8 have the same angle $\alpha$. In other embodiments, each nose depression 8 has a different angle $\alpha$. In still other embodiments, some nose depressions 8 have the same angle $\alpha$ while other nose depressions 8 have different angles $\alpha$. In the embodiment shown, the nose depressions 8 are right-hand nose depressions 8 because the angle $\alpha$ is positioned to the right of the longitudinal axis 44. In one embodiment, the projectile 2 has at least three nose depressions 8. However, the projectile 2 can have more or fewer nose depressions 8. The angle $\Delta$ of the tail depressions 34 can be measured from the centerline 36 of the tail depression 34 relative to the longitudinal axis 44. In some embodiments, all tail depressions 34 have the same angle $\Delta$. In other embodiments, each tail depression 34 has a different angle $\Delta$. In still other embodiments, some tail depressions 34 have the same angle $\Delta$ while other tail depressions 34 have different angles $\Delta$. In one embodiment, the projectile 2 has at least six tail depressions 34. However, the projectile 2 can have more or fewer tail depressions 34.

In one embodiment, the radius of curvature R2 of the tangent ogive is between about 1.0 inch and about 4.0 inches. In a preferred embodiment, the radius of curvature R2 of the tangent ogive is between about 2.0 inches and about 3.5 inches. In a more preferred embodiment, the radius of curvature R2 of the tangent ogive is about 2.71 inches. In one embodiment, the radius of curvature R3 of the secant ogive is between about 0.5 inches and about 2.5 inches. In a preferred embodiment, the radius of curvature R3 of the secant ogive is between about 1.0 inch and about 1.5 inches. In a more preferred embodiment, the radius of curvature R3 of the secant ogive is about 1.35 inches. In one embodiment, the radius of curvature R4 of the nose depressions 8 is between about 0.05 inches and about 0.20 inches. In a preferred embodiment, the radius of curvature R4 of the nose depressions 8 is between about 0.10 inches and about 0.15 inches. In a more preferred embodiment, the radius of curvature R4 of the nose depressions 8 is about 0.125 inches. In one embodiment, the radius of curvature R5 of the tail depressions 34 is between about 0.05 inches and about 0.20 inches. In a preferred embodiment, the radius of curvature R5 of the tail depressions 34 is between about 0.10 inches and about 0.15 inches. In a more preferred embodiment, the radius of curvature R5 of the tail depressions 34 is about 0.125 inches. In one embodiment, the length L1 of the projectile 2 is between about 1.0 inch and about 2.5 inches. In a preferred embodiment, the length L1 of the projectile 2 is between about 1.5 inches and about 2.0 inches. In a more preferred embodiment, the length L1 of the projectile 2 is about 1.75 inches. In one embodiment, the length of the nose portion 6 is between about 0.050 inches and about 1.5 inches. In a preferred embodiment, the length of the nose portion 6 is between about 0.60 inches and about 1.0 inch. In a more preferred embodiment, the length of the nose portion 6 is about 0.80 inches. In one embodiment, the length L3 of the cylindrical portion 20 is between about 0.25 inches and about 1.5 inches. In a preferred embodiment, the length L3 of the cylindrical portion 20 is between about 0.50 inches and about 1.0 inch. In a more preferred embodiment, the length L3 of the cylindrical portion 20 is about 0.70 inches. In one embodiment, the length L4 of the boat tail 38 is between about 0.10 inches and about 0.50 inches. In a preferred embodiment, the length L4 of the boat tail 38 is between about 0.20 inches and about 0.30 inches. In a more preferred embodiment, the length L4 of the boat tail 38 is about 0.25 inches. The diameter D1 of the projectile 2 varies according the various embodiments. In one embodiment, the diameter D1 of the projectile 2 is between about 0.22 inches and about 0.50 inches. In a preferred embodiment, the diameter D1 of the projectile 2 is between about 0.30 inches and about 0.35 inches. In the embodiment shown, the diameter D1 of the projectile 2 is about 0.338 inches. In the embodiment shown, the diameter D2 of the relief cut 28 is about 0.32 inches. In the embodiment shown, the diameter D3 of the driving band is about 0.338 inches. In one embodiment, the angle α of the nose depressions 8 is between about 5 degrees and about 10 degrees. In a preferred embodiment, the angle α of the nose depressions 8 is between about 6 degrees and about 8 degrees. In a more preferred embodiment, the angle α of the nose depressions 8 is about 7.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees. In one embodiment, the angle Δ of the tail depressions 34 is between about 5 degrees and about 10 degrees. In a preferred embodiment, the angle Δ of the tail depressions 34 is between about 7.0 degrees and about 8.0 degrees. In a more preferred embodiment the angle Δ of the tail depressions 34 is about 7.5 degrees.

This projectile 2 is different from the prior art because it can pierce armor and stop in soft tissue. The intended users of the projectile 2 are African big game hunters. The attributes of this projectile 2 are deep straight penetration with transfer of energy. The projectile 2 is comprised of brass, copper, bronze, tungsten-carbide, alloys of these metals, or any material known in the art, including plastics and ceramics.

Referring to FIGS. 12-16 and 18, these projectiles comprise a housing and an insert. Upon impact, the housing will peel back toward the base of the projectile and away from the tip of the projectile when it hits soft tissue. The housing expands rapidly to peel backward. The front of the housing may fragment while peeling backward. The projectile will remain in its original shape when the projectile hits hard tissue. The tip or point keeps the projectile moving in the correct direction after the projectile initially hits soft tissue and the housing peels back toward the base. However, the insert may separate from the housing in soft tissue and the two pieces may go in separate directions. The cavities of these projectiles fill with material when the projectile hits soft tissue. However, material does not go into cavities when the projectile hits hard material. These projectiles are designed mostly for civilian use.

Figure 12A:
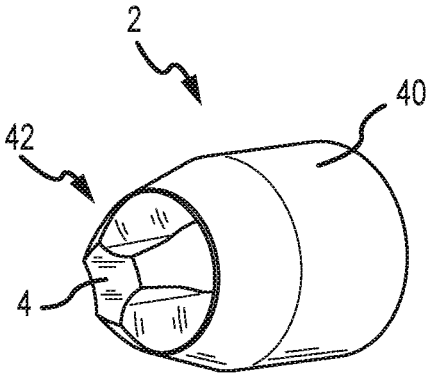
FIGS. 12A-E show a projectile according to a twelfth embodiment of the invention.
Figure 12B:
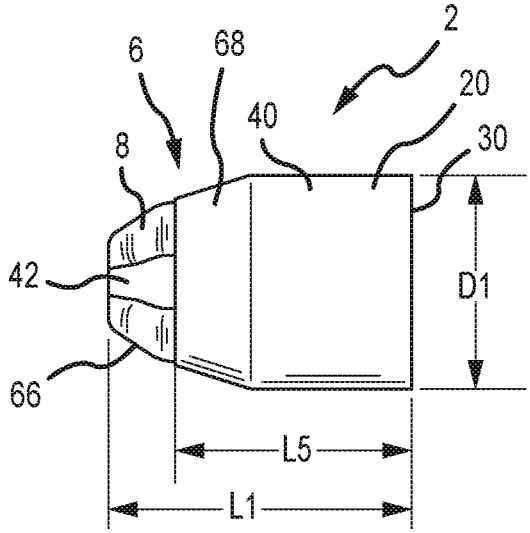
Figure 12C:
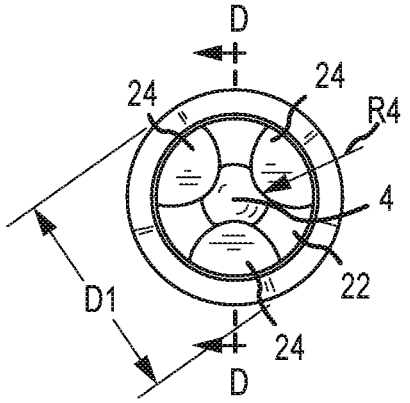
Figure 12D:
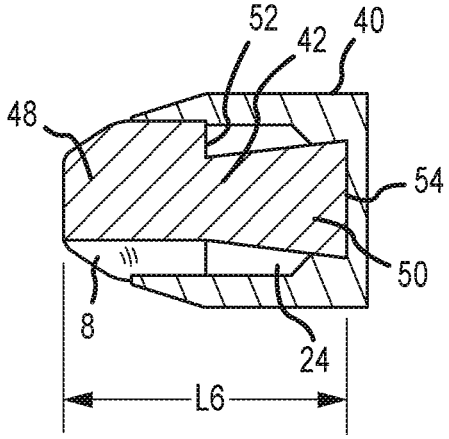
Figure 12E:
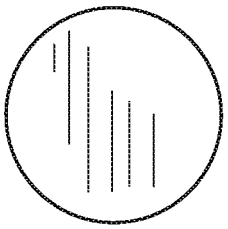

FIGS. 12A-E show a projectile according to a twelfth embodiment of the invention. FIG. 12A is a perspective view of the projectile 2. FIG. 12B is a side elevation view of the projectile 2. FIG. 12C is a top plan view of the projectile 2. FIG. 12D is a cross section taken at cut D-D of FIG. 12C. FIG. 12E is a bottom plan view of the projectile 2. Note that FIGS. 12A-E are to scale.

The projectile 2 comprises a tip 4 on one end opposite a base 30 on the other end. The projectile 2 comprises a nose portion 6 and a cylindrical portion 20. The projectile 2 is two-pieces and includes a housing 40 and an insert 42. The tip 4 is substantially flat and is a part of the insert 42. The insert 42 has an arrowhead portion 48 that is wider than its stem 50, which extends from the lower portion 52 of the arrowhead 48 to the underside 54 of the stem 50. The base 30 of the projectile is substantially flat and is part of the housing 40.

The housing has a cavity 24 extending down from the opening of the housing 40. The lower surface of the cavity 24 is substantially flat and has side portions that extend into the center of the cavity 24 to receive the lower portion or underside 54 of the stem 50 of the insert 42. In some embodiments, the stem 50 has a constant diameter. In other embodiments, the stem 50 gets wider near the bottom 54 of the stem 50.

The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the insert such that they extend into the cavity 24 of the housing 40 creating cavities 24 for tissue and other material to collect when the projectile hits its target. In one embodiment, the nose depressions are cut using a ⅜-inch ball end mill.

In one embodiment, the projectile 2 has at least three nose depressions 8. However, the projectile 2 can have more or fewer nose depressions 8. In one embodiment, the radius of curvature R4 of the nose depressions 8 is between about 0.10 inches and about 0.30 inches. In a preferred embodiment, the radius of curvature R4 of the nose depressions 8 is between about 0.15 inches and about 0.25 inches. In a more preferred embodiment, the radius of curvature R4 of the nose depressions 8 is about 3/16 inches. In one embodiment, the length L1 of the projectile 2 is between about 0.50 inches and about 1.0 inch. In a preferred embodiment, the length L1 of the projectile 2 is between about 0.55 inches and about 0.75 inches. In a more preferred embodiment, the length L1 of the projectile 2 is about 0.625 inches. In one embodiment, the length L5 of the housing 40 is between about 0.30 inches and about 0.70 inches. In a preferred embodiment, the length L5 of the housing is between about 0.45 inches and about 0.50 inches. In a more preferred embodiment, the length L5 of the housing 40 is about 0.485 inches. The diameter D1 of the projectile 2 (also called the caliber) varies according the various embodiments. In one embodiment, the diameter D1 of the projectile 2 is between about 0.25 inches and about 0.60 inches. In a preferred embodiment, the diameter D1 of the projectile 2 is between about 0.35 inches and about 0.55 inches. In the embodiment shown, the diameter D1 of the projectile 2 is about 0.45 inches. In one embodiment, the angle α of the nose depression 8 is about 0 degrees. The width of the opening of the housing 40 is about 0.330 inches.

Figure 13A:
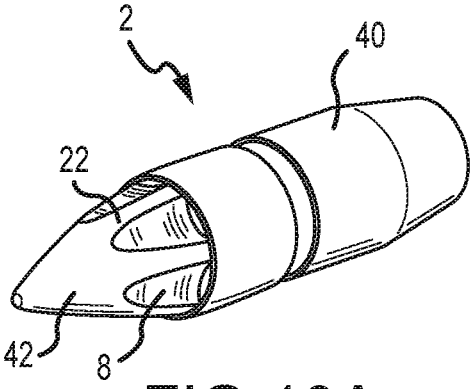
FIGS. 13A-D show a projectile according to a thirteenth embodiment of the invention.
Figure 13B:
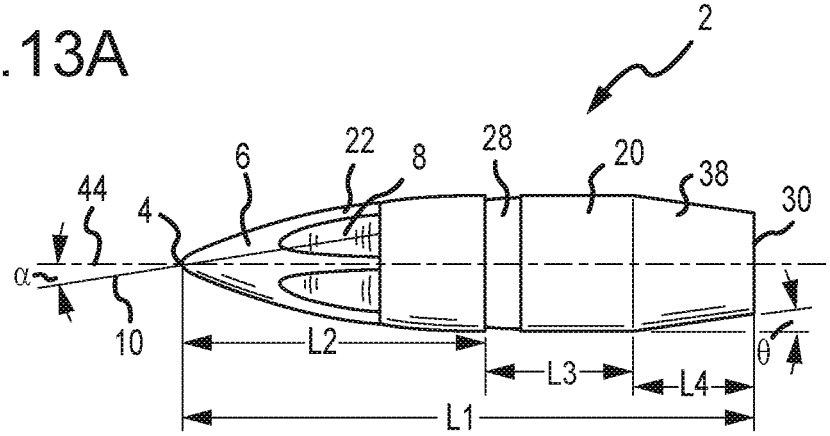
Figure 13C:
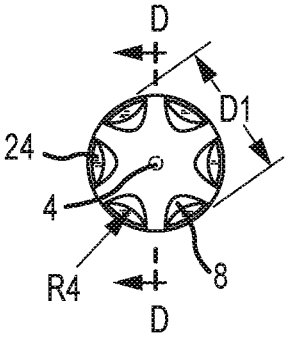
Figure 13D:
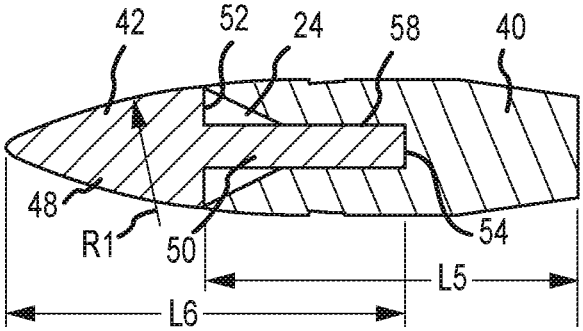

FIGS. 13A-D show a projectile according to a thirteenth embodiment of the invention. FIG. 13A is a perspective view of the projectile 2. FIG. 13B is a side elevation view of the projectile 2. FIG. 13C is a top plan view of the projectile 2. FIG. 13D is a cross section taken at cut D-D of FIG. 13C. Note that FIGS. 13A-D are to scale.

The projectile 2 comprises a tip 4 on one end opposite a base 30 on the other end. The projectile 2 comprises a nose portion, a cylindrical portion 20, and a boat tail 38. The cylindrical portion 20 can comprise one or more relief cuts 28. The cylindrical portion 20 may also comprise at least one driving band. The projectile 2 is two-pieces and includes a housing 40 and an insert 42. The tip 4 is a part of the insert 42. The insert 42 has an arrowhead portion 48 that is wider than its stem 50, which extends from the lower portion 52 of the arrowhead 48 to the underside 54 of the stem 50. The base 30 of the projectile is substantially flat and is part of the housing 40. The housing has a cavity 24 extending down from the opening of the housing 40 in a conical shape that transitions into a cylindrical shape. The lower surface of the cavity 24 is substantially flat and the sides of the cavity 24 form a receiving portion 58 to receive the stem 50 of the insert 42. In some embodiments, the stem 50 has a constant diameter. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the arrowhead 48 of the insert 42 such that they extend into the cavity 24 of the housing 40 creating cavities 24 for tissue and other material to collect when the projectile 2 hits its target. Additional cavities 24 are created by the conical shape of the housing cavity 24 and the flat underside 52 of the arrowhead 48. In one embodiment, the nose depressions are cut using a ⅛ inch ball end mill.

The longitudinal axis 44 of the projectile 2 is shown in FIG. 13B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are left-hand nose depressions 8 because the angle α is positioned to the left of the longitudinal axis 44. In one embodiment, the projectile 2 has at least three nose depressions 8. In another embodiment, the nose portion 6 has six nose depressions 8. However, the projectile 2 can have more or fewer nose depressions 8.

In one embodiment, the radius of curvature R4 of the nose depressions 8 is between about 0.040 inches and about 0.090 inches. In a preferred embodiment, the radius of curvature R4 of the nose depressions 8 is between about 0.050 inches and about 0.070 inches. In a more preferred embodiment, the radius of curvature R4 of the nose depressions 8 is about 0.0625 inches. In one embodiment, the length L1 of the projectile 2 is between about 0.40 inches and about 2.0 inches. In a preferred embodiment, the length L1 of the projectile 2 is between about 0.60 inches and about 1.20 inches. In a more preferred embodiment, the length L1 of the projectile 2 is about 0.912 inches. In one embodiment, the length L2 of the nose portion 6 is between about 0.30 inches and about 0.60 inches. In a preferred embodiment, the length L2 of the nose portion 6 is between about 0.40 inches and about 0.55 inches. In a more preferred embodiment, the length L2 of the nose portion 6 is about 0.485 inches. In one embodiment, the length L3 of the cylindrical portion 20 is between about 0.10 inches and about 0.30 inches. In a preferred embodiment, the length L3 of the cylindrical portion 20 is between about 0.15 inches and about 0.25 inches. In a more preferred embodiment, the length L3 of the cylindrical portion 20 is about 0.20 inches. In one embodiment, the length L4 of the boat tail 38 is between about 0.10 inches and about 0.50 inches. In a preferred embodiment, the length L4 of the boat tail 38 is between about 0.20 inches and about 0.30 inches. In a more preferred embodiment, the length L3 of the cylindrical portion 20 is about 0.225 inches. The diameter D1 of the projectile 2 varies according the various embodiments. In one embodiment, the diameter D1 of the projectile 2 is between about 0.10 inches and about 0.40 inches. In a preferred embodiment, the diameter D1 of the projectile 2 is between about 0.20 inches and about 0.25 inches. In the embodiment shown, the diameter D1 of the projectile 2 is about 0.224 inches. In the embodiment shown, the width of the housing opening is about 0.200 inches. In one embodiment, the angle α of the nose depressions 8 is between about 3.0 degrees and about 8.0 degrees. In a preferred embodiment, the angle α of the nose depressions 8 is between about 4.5 degrees and about 6.5 degrees. In a more preferred embodiment, the angle α of the nose depressions 8 is about 5.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7 degrees.

Figure 14A:
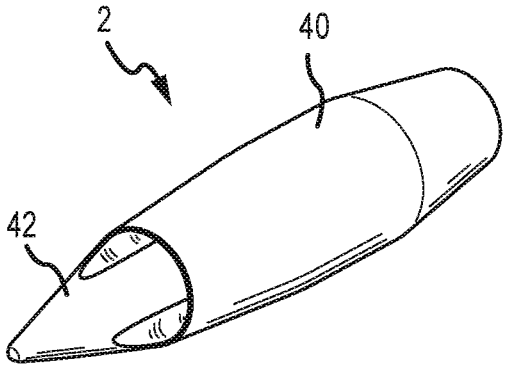
FIGS. 14A-C show a projectile according to a fourteenth embodiment of the invention.
Figure 14B:
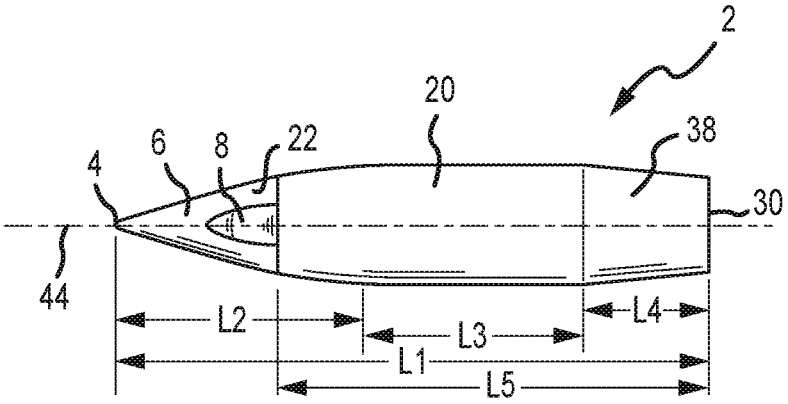
Figure 14C:
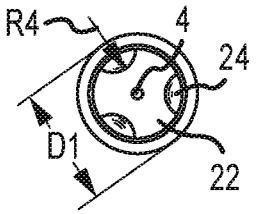

FIGS. 14A-C show a projectile according to a fourteenth embodiment of the invention. FIG. 14A is a perspective view of the projectile 2. FIG. 14B is a side elevation view of the projectile 2. FIG. 14C is a top plan view of the projectile 2. Note that FIGS. 14A-C are to scale.

The projectile 2 comprises a tip 4 on one end opposite a base 30 on the other end. The projectile 2 comprises a nose portion 6, a cylindrical portion 20, and a boat tail 38. The cylindrical portion 20 can comprise at least one relief cut 28. The cylindrical portion may comprise one or more driving bands and relief cuts. The projectile 2 is two-pieces and includes a housing 40 and an insert 42. The tip 4 is a part of the insert 42. The insert 42 is linear. In some embodiments, the cylindrical portion of the insert 42 has a constant diameter. The base 30 of the projectile is substantially flat and is part of the housing 40. The housing 40 has a cavity extending down from the opening of the housing 40. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the insert 42 such that they extend into the cavity of the housing 40 creating cavities 24 for tissue and other material to collect when the projectile 2 hits its target. In one embodiment, the nose depressions 8 are cut using a 3/16 inch flat end mill.

The longitudinal axis 44 of the projectile 2 is shown in FIG. 13B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. In another embodiment, the nose portion has six nose depressions. However, the projectile 2 can have more or fewer nose depressions 8.

In one embodiment, the radius of curvature R4 of the nose depressions 8 is between about 0.040 inches and about 0.080 inches. In a preferred embodiment, the radius of curvature R4 of the nose depressions 8 is between about 0.050 inches and about 0.070 inches. In a more preferred embodiment, the radius of curvature R4 of the nose depressions 8 is about 0.0625 inches. In one embodiment, the length L1 of the projectile 2 is between about 1.0 inch and about 2.5 inches. In a preferred embodiment, the length L1 of the projectile 2 is between about 1.25 inches and about 1.5 inches. In a more preferred embodiment, the length L1 of the projectile 2 is about 1.387 inches. In one embodiment, the length L2 of the nose portion 6 is between about 0.40 inches and about 0.80 inches. In a preferred embodiment, the length L2 of the nose portion 6 is between about 0.60 inches and about 0.70 inches. In a more preferred embodiment, the length L2 of the nose portion 6 is about 0.674 inches. In one embodiment, the length L3 of the cylindrical portion 20 is between about 0.30 inches and about 0.70 inches. In a preferred embodiment, the length L3 of the cylindrical portion 20 is between about 0.40 inches and about 0.45 inches. In a more preferred embodiment, the length L3 of the cylindrical portion 20 is about 0.413 inches. In one embodiment, the length L4 of the boat tail 38 is between about 0.2 inches and about 0.40 inches. In a preferred embodiment, the length L4 of the boat tail 38 is between about 0.25 inches and about 0.35 inches. In a more preferred embodiment, the length L4 of the boat tail 38 is about 0.30 inches. In one embodiment, the length L5 of the projectile 2 is between about 0.8 inches and about 1.4 inches. In a preferred embodiment, the length L5 of the projectile 2 is between about 1.0 inch and about 1.2 inches. In a more preferred embodiment, the length L5 of the projectile 2 is about 1.1 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the angle α of the nose depression 8 is about 0 degrees.

Figure 15A:
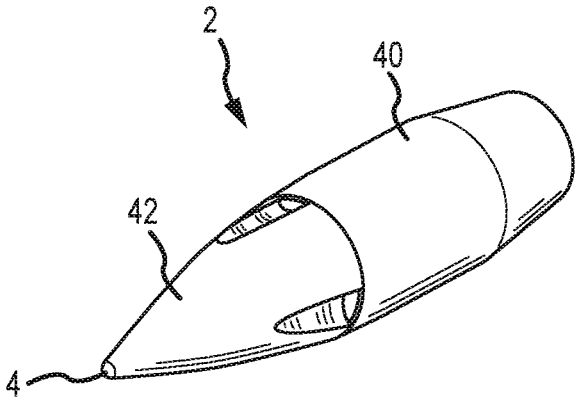
FIGS. 15A-E show a projectile according to a fifteenth embodiment of the invention.
Figure 15B:
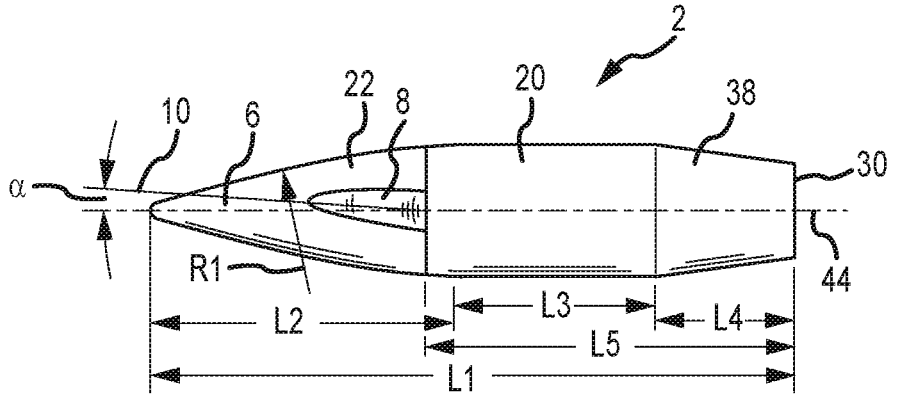
Figure 15C:
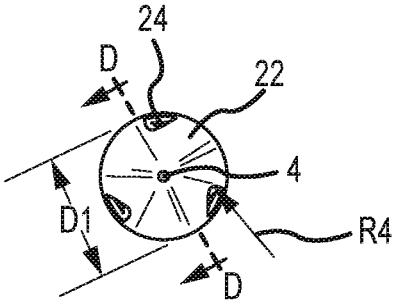
Figure 15D:
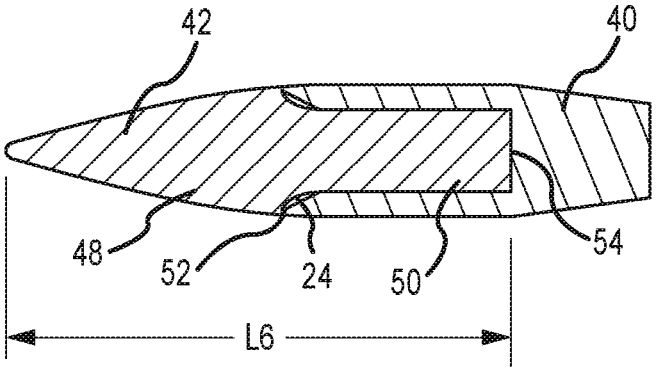
Figure 15E:
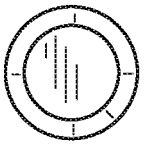

FIGS. 15A-E show a projectile according to a fifteenth embodiment of the invention. FIG. 15A is a perspective view of the projectile 2. FIG. 15B is a side elevation view of the projectile 2. FIG. 15C is a top plan view of the projectile 2. FIG. 15D is a cross sectional view taken along line D-D of FIG. 15C. FIG. 15E is a bottom plan view of the projectile 2. Note that FIGS. 15A-E are to scale.

The projectile 2 comprises a tip 4 on one end opposite a base 30 on the other end. The projectile 2 comprises a nose portion 6, a cylindrical portion 20, and a boat tail 38. The cylindrical portion 20 can comprise one or more relief cuts and one or more driving bands (not shown). The projectile 2 is two-pieces and includes a housing 40 and an insert 42. The tip 4 is a part of the insert 42. The insert 42 has an arrowhead portion 48 that is wider than its stem 50, which extends from the lower portion 52 of the arrowhead 48 to the underside 54 of the stem 50. The base 30 of the projectile is substantially flat and is part of the housing 40. The housing has a cavity 24 extending down from the opening of the housing 40 in a conical shape that transitions into a cylindrical shape. The lower surface of the cavity 24 is substantially flat and the sides of the cavity 24 form a receiving portion to receive the stem 50 of the insert 42. In some embodiments, the stem 50 has a constant diameter that terminates in a substantially flat lower portion 54. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the arrowhead 48 of the insert 42 such that they extend into the cavity 24 of the housing 40 creating cavities 24 for tissue and other material to collect when the projectile 2 hits its target. Additional cavities 24 are created by the conical shape of the housing cavity 24 and the flat underside 52 of the arrowhead 48. The nose depressions 8 have a curved shape meaning that the trough or bottom of the nose depression 8 is curved and has a radius of curvature R4. In one embodiment, the nose depressions are cut using a ⅛ inch ball end mill.

The longitudinal axis 44 of the projectile 2 is shown in FIG. 15B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. However, the projectile 2 can have more or fewer nose depressions 8.

In one embodiment, the radius of curvature R4 of the nose depressions 8 is between about 0.03 inches and about 0.25 inches. In a preferred embodiment, the radius of curvature R4 of the nose depressions 8 is between about 0.05 inches and about 0.15 inches. In a more preferred embodiment, the radius of curvature R4 of the nose depressions 8 is about 0.0625 inches. In one embodiment, the length L1 of the projectile 2 is between about 1.206 inches and about 1.606 inches. In a preferred embodiment, the length L1 of the projectile 2 is between about 1.306 inches and about 1.506 inches. In a more preferred embodiment, the length L1 of the projectile 2 is about 1.406 inches. In one embodiment, the length L2 of the nose portion 6 is between about 0.497 inches and about 0.897 inches. In a preferred embodiment, the length L2 of the nose portion 6 is between about 0.597 inches and about 0.797 inches. In a more preferred embodiment, the length L2 of the nose portion 6 is about 0.697 inches. In one embodiment, the length L3 of the cylindrical portion 20 is between about 0.209 inches and about 0.609 inches. In a preferred embodiment, the length L3 of the cylindrical portion 20 is between about 0.309 inches and about 0.509 inches. In a more preferred embodiment, the length L3 of the cylindrical portion 20 is about 0.409 inches. In one embodiment, the length L4 of the boat tail 38 is between about 0.10 inches and about 0.50 inches. In a preferred embodiment, the length L4 of the boat tail 38 is between about 0.20 inches and about 0.40 inches. In a more preferred embodiment, the length L4 of the boat tail 38 is about 0.30 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches. In one embodiment, the angle α of the nose depressions 8 is between about 5 degrees and about 13 degrees. In a preferred embodiment, the angle α of the nose depressions 8 is between about 7 degrees and about 11 degrees. In a more preferred embodiment, the angle α of the nose depressions 8 is about 9.0 degrees.

Figure 16A:
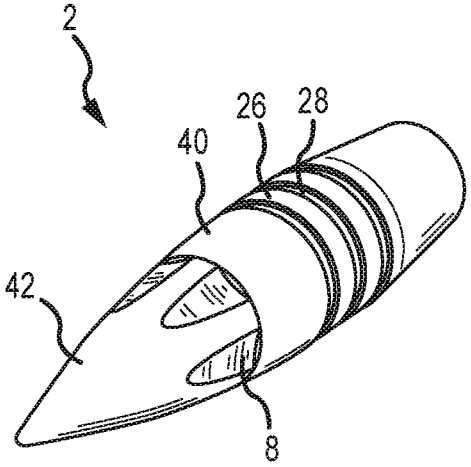
FIGS. 16A-D show a projectile according to a sixteenth embodiment of the invention.
Figure 16B:
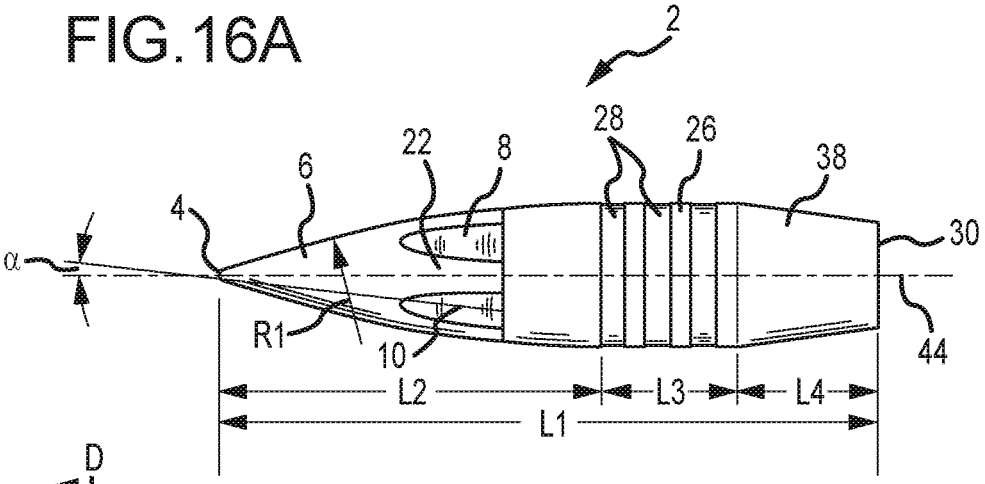
Figure 16C:
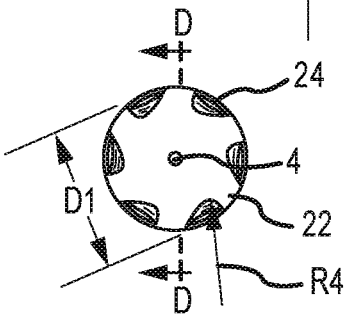
Figure 16D:
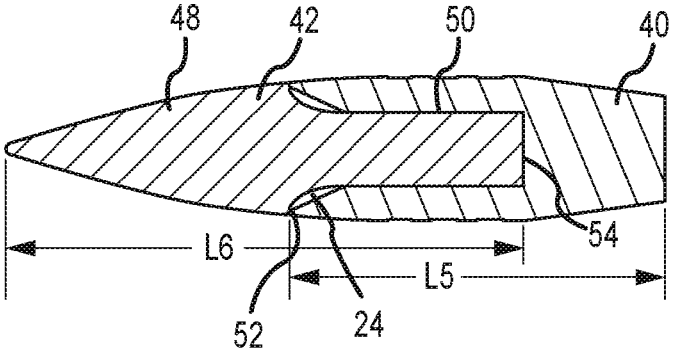

FIGS. 16A-D show a projectile according to a sixteenth embodiment of the invention. FIG. 16A is a perspective view of the projectile 2. FIG. 16B is a side elevation view of the projectile 2. FIG. 16C is a top plan view of the projectile 2. FIG. 16D is a cross section. Note that FIGS. 16A-D are to scale.

The projectile 2 comprises a tip 4 on one end opposite a base 30 on the other end. The projectile 2 comprises a nose portion 6, a cylindrical portion 20, and a boat tail 38. The cylindrical portion 20 can comprise one or more relief cuts 28 and one or more driving bands 26. In additional embodiments, the cylindrical portion 20 has angled driving bands and angled relief cuts like shown in FIGS. 35B and 35E. The projectile 2 is two-pieces and includes a housing 40 and an insert 42. The tip 4 is a part of the insert 42. The insert 42 has an arrowhead portion 48 that is wider than its stem 50, which extends from the lower portion 52 of the arrowhead 48 to the underside 54 of the stem 50. The base 30 of the projectile is substantially flat and is part of the housing 40. The housing has a cavity 24 extending down from the opening of the housing 40 in a conical shape that transitions into a cylindrical shape. The lower surface of the cavity 24 is substantially flat and the sides of the cavity 24 form a receiving portion to receive the stem 50 of the insert 42. In some embodiments, the stem 50 has a constant diameter that terminates in a substantially flat lower portion 54. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. The nose depressions 8 extend along the arrowhead 48 of the insert 42 such that they extend into the cavity 24 of the housing 40 creating cavities 24 for tissue and other material to collect when the projectile 2 hits its target. Additional cavities 24 are created by the conical shape of the housing cavity 24 and the flat underside 52 of the arrowhead 48. The nose depressions 8 have a curved shape meaning that the trough or bottom of the nose depression 8 is curved and has a radius of curvature R4. In one embodiment, the nose depressions are cut using a 3/16 inch flat end mill.

The longitudinal axis 44 of the projectile 2 is shown in FIG. 16B. Accordingly, the angle α of the nose depressions 8 can be measured relative to the longitudinal axis 44. In some embodiments, the angle α is measured from the centerline 10 of the nose depressions 8 relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8.

In one embodiment, the radius of curvature R4 of the nose depressions 8 is between about 0.06 inches and about 0.20 inches. In a preferred embodiment, the radius of curvature R4 of the nose depressions 8 is between about 0.08 inches and about 0.15 inches. In a more preferred embodiment, the radius of curvature R4 of the nose depressions 8 is about 0.09375 inches. In one embodiment, the length L1 of the projectile 2 is between about 1.206 inches and about 1.606 inches. In a preferred embodiment, the length L1 of the projectile 2 is between about 1.306 inches and about 1.506 inches. In a more preferred embodiment, the length L1 of the projectile 2 is about 1.406 inches. In one embodiment, the length L2 of the nose portion 6 is between about 0.627 inches and about 1.027 inches. In a preferred embodiment, the length L2 of the nose portion 6 is between about 0.727 inches and about 0.927 inches. In a more preferred embodiment, the length L2 of the nose portion 6 is about 0.827 inches. In one embodiment, the length L3 of the cylindrical portion 20 is between about 0.149 inches and about 0.549 inches. In a preferred embodiment, the length L3 of the cylindrical portion 20 is between about 0.249 inches and about 0.449 inches. In a more preferred embodiment, the length L3 of the cylindrical portion 20 is about 0.349 inches. In one embodiment, the length L4 of the boat tail 38 is between about 0.08 inches and about 0.38 inches. In a preferred embodiment, the length L4 of the boat tail 38 is between about 0.18 inches and about 0.28 inches. In a more preferred embodiment, the length L4 of the boat tail 38 is about 0.23 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches. In one embodiment, the angle α of the nose depressions 8 is between about 3.5 degrees and about 7.5 degrees. In a preferred embodiment, the angle α of the nose depressions 8 is between about 4.5 degrees and about 6.5 degrees. In a more preferred embodiment, the angle α of the nose depressions 8 is about 5.5 degrees. In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees.

Figure 17A:
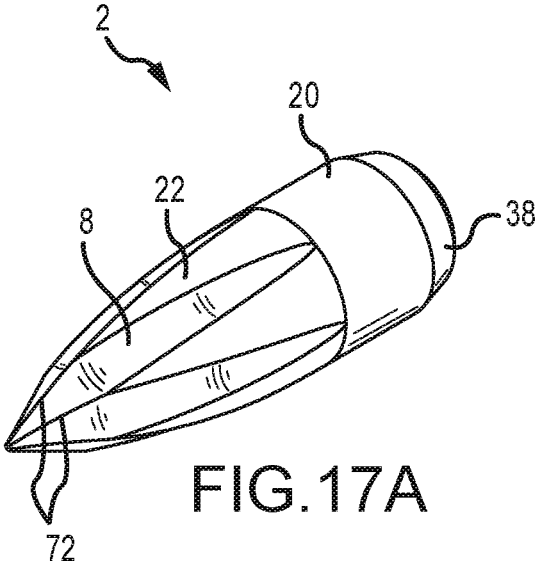
FIGS. 17A-C show a projectile according to a seventeenth embodiment of the invention.
Figure 17B:
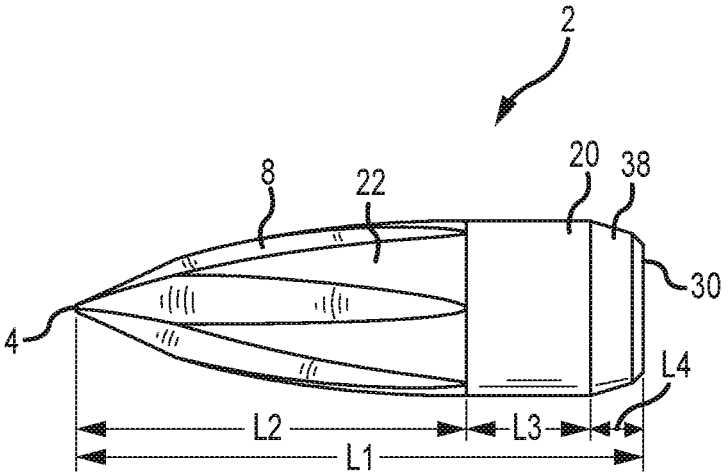
Figure 17C:
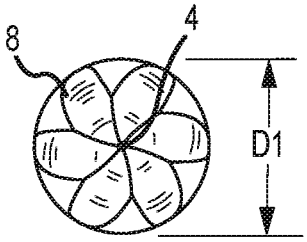

FIGS. 17A-C show a projectile according to a seventeenth embodiment of the invention. FIG. 17A is a perspective view of the projectile 2. FIG. 17B is a side elevation view of the projectile 2. FIG. 17C is a top plan view of the projectile 2. Note that FIGS. 17A-C are to scale.

The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and a nose remaining portion 22 between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the nose depressions are cut using a 1/8 inch ball end mill.

The angle of the nose depressions 8 can be measured relative to the longitudinal axis 44. In some embodiments, the angle is measured from the centerline 10 of the nose depressions 8 relative to the original ogive of the projectile nose portion 6. In some embodiments, all nose depressions 8 have the same angle. In other embodiments, each nose depression 8 has a different angle. In still other embodiments, some nose depressions 8 have the same angle while other nose depressions 8 have different angles. In one embodiment, the projectile 2 has at least three nose depressions 8. However, the projectile 2 can have more or fewer nose depressions 8.

In one embodiment, the length L1 of the projectile 2 is between about 1.20 inches and about 1.60 inches. In a preferred embodiment, the length L1 of the projectile 2 is between about 1.30 inches and about 1.50 inches. In a more preferred embodiment, the length L1 of the projectile 2 is about 1.40 inches. In one embodiment, the length L2 of the nose portion 6 is between about 1 inch and about 1.4 inches. In one embodiment, the length L3 of the cylindrical portion 20 is between about 0.5 inches and about 0.8 inches. In one embodiment, the length L4 of the boat tail 38 is between about 0.2 inches and about 0.5 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches.

This projectile is armor-piercing. The large, long cuts or depressions in the nose ensure the projectile can penetrate and go through metal and other tough or hard material. This projectile is for military and civilian use. Other intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 18A:
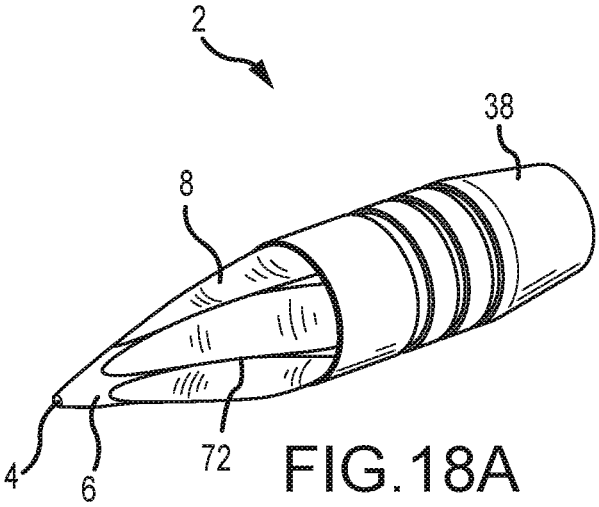
FIGS. 18A-D show a projectile according to an eighteenth embodiment of the invention.
Figure 18B:
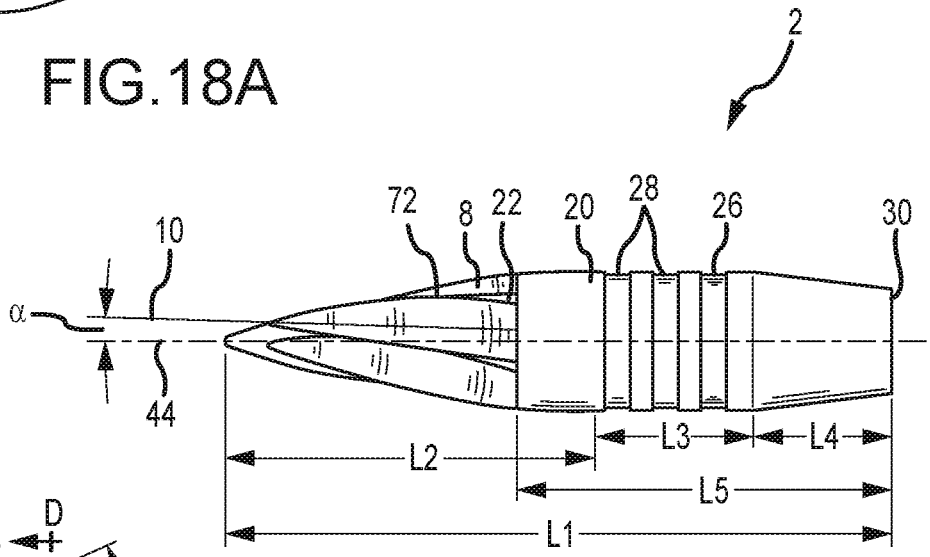
Figure 18C:
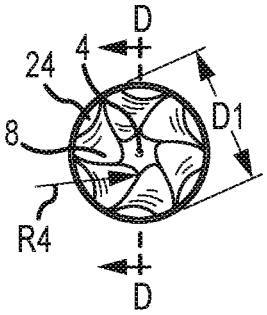
Figure 18D:
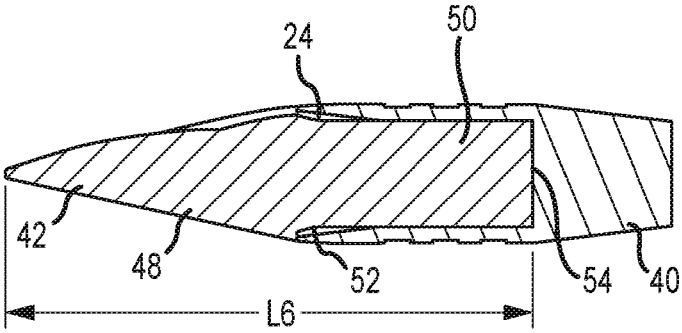

FIGS. 18A-D show a projectile according to an eighteenth embodiment of the invention. FIG. 18A is a perspective view of the projectile 2. FIG. 18B is a side elevation view of the projectile 2. FIG. 18C is a top plan view of the projectile 2. FIG. 18D is a cross section taken along cut D-D of FIG. 18C. Note that FIGS. 18A-D are to scale. This projectile is two pieces and includes a housing 40 and an insert 42.

The projectile 2 comprises a tip 4 on one end opposite a base 30 on the other end. The projectile 2 comprises a nose portion 6 and a cylindrical portion 20. The nose portion 6 includes nose depressions 8 and a nose remaining portion 22 between the nose depressions 8, where each nose remaining portion 22 is positioned between two nose depressions 8. The remaining portions 22 are the uncut portions having the projectile's original ogive. In some embodiments, the nose depressions 8 terminate in a substantially flat shoulder 18 (not shown). The nose depressions 8 have a curved shape meaning that the trough or bottom of the nose depression 8 is curved and has a radius of curvature R4. In one embodiment, the nose depressions are cut using a 3/16 inch flat end mill.

The longitudinal axis 44 of the projectile 2 is shown in FIG. 18B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. However, the projectile 2 can have more or fewer nose depressions 8.

In one embodiment, the radius of curvature R4 of the nose depressions 8 is between about 0.010 inches and about 0.300 inches. In a preferred embodiment, the radius of curvature R4 of the nose depressions 8 is between about 0.050 inches and about 0.150 inches. In a more preferred embodiment, the radius of curvature R4 of the nose depressions 8 is about 0.09375 inches. In one embodiment, the length L1 of the projectile 2 is between about 1.206 inches and about 1.606 inches. In a preferred embodiment, the length L1 of the projectile 2 is between about 1.306 inches and about 1.506 inches. In a more preferred embodiment, the length L1 of the projectile 2 is about 1.406 inches. In one embodiment, the length L2 of the nose portion 6 is between about 0.627 inches and about 1.027 inches. In a preferred embodiment, the length L2 of the nose portion 6 is between about 0.727 inches and about 0.927 inches. In a more preferred embodiment, the length L2 of the nose portion 6 is about 0.827 inches. In one embodiment, the length L3 of the cylindrical portion 20 is between about 0.149 inches and about 0.459 inches. In a preferred embodiment, the length L3 of the cylindrical portion 20 is between about 0.249 inches and about 0.449 inches. In a more preferred embodiment, the length L3 of the cylindrical portion 20 is about 0.349 inches. In one embodiment, the length L4 of the boat tail 38 is between about 0.08 inches and about 0.38 inches. In a preferred embodiment, the length L4 of the boat tail 38 is between about 0.18 inches and about 0.28 inches. In a more preferred embodiment, the length L4 of the boat tail 38 is about 0.23 inches. In one embodiment, the length L5 of the housing 40 is between about 0.627 inches and about 1.027 inches. In a preferred embodiment, the length L5 of the housing 40 is between about 0.727 inches and about 0.927 inches. In a more preferred embodiment, the length L5 of the housing 40 is about 0.827 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches. In one embodiment, the angle α of the nose depressions 8 is between about 3.5 degrees and about 7.5 degrees. In a preferred embodiment, the angle α of the nose depressions 8 is between about 4.5 degrees and about 6.5 degrees. In a more preferred embodiment, the angle α of the nose depressions 8 is about 5.5 degrees.

Figure 19A:
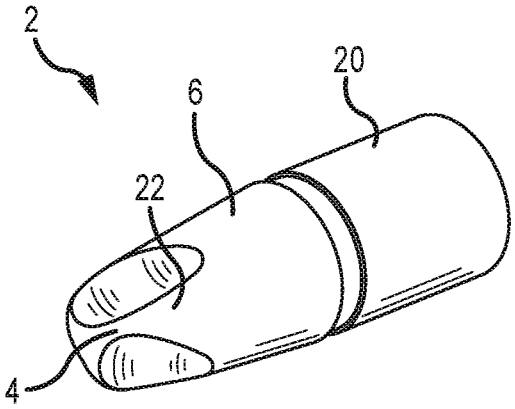
FIGS. 19A-C show a projectile according to a nineteenth embodiment of the invention.
Figure 19B:
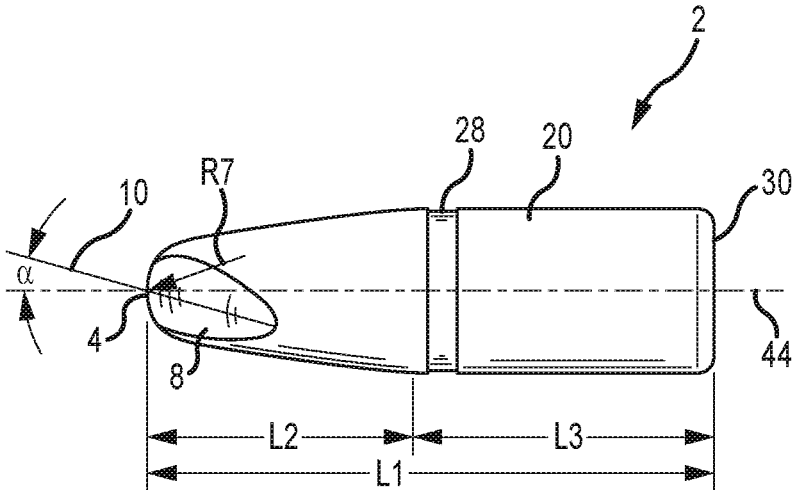
Figure 19C:
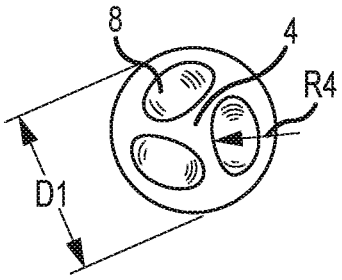

FIGS. 19A-C show a projectile according to a nineteenth embodiment of the invention. FIG. 19A is a perspective view of the projectile 2. FIG. 19B is a side elevation view of the projectile 2. FIG. 19C is a top plan view of the projectile 2. Note that FIGS. 19A-C are to scale.

The projectile 2 comprises a tip 4 on one end opposite a base 30 on the other end. The rounded tip 4 acts like pointed tip due to its aerodynamic properties. The projectile 2 comprises a nose portion 6 and a cylindrical portion 20. The nose portion 6 includes nose depressions 8 and nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the nose depressions are cut using a 3/8 inch ball end mill. In the embodiment of FIGS. 19A-C, the projectile 2 has one relief cut 28. In some embodiments, the projectile 2 includes a plurality of relief cuts 28.

The longitudinal axis 44 of the projectile 2 is shown in FIG. 19B. The angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. As shown in FIGS. 19A and 19C, the nose depressions 8 do not extend all the way to the tip 4 and the nose depressions 8 do not intersect one another. Thus, the remaining portions 22 extend to the tip 4. Additionally, the nose depressions 8 do not extend all the way to a forward portion of the cylindrical portion 20.

In one embodiment, the radius of curvature R4 of the nose depressions 8 is between about 0.05 inches and about 0.30 inches. In a preferred embodiment, the radius of curvature R4 of the nose depressions 8 is between about 0.10 inches and about 0.25 inches. In a more preferred embodiment, the radius of curvature R4 of the nose depressions 8 is about 0.1875 inches. In one embodiment, the length L1 of the projectile 2 is between about 0.5 inches and about 1.5 inches. In a preferred embodiment, the length L1 of the projectile 2 is between about 0.75 inches and about 1.25 inches. In a more preferred embodiment, the length L1 of the projectile 2 is about 1.0 inch. In one embodiment, the length L2 of the nose portion 6 is between about 0.25 inches and about 0.75 inches. In a preferred embodiment, the length L2 of the nose portion 6 is between about 0.4 inches and about 0.6 inches. In a more preferred embodiment, the length L2 of the nose portion 6 is about 0.500 inches. In one embodiment, the length L3 of the cylindrical portion 20 is between about 0.30 inches and about 0.70 inches. In a preferred embodiment, the length L3 of the cylindrical portion 20 is between about 0.40 inches and about 0.60 inches. In a more preferred embodiment, the length L3 of the cylindrical portion 20 is about 0.500 inches. The diameter D1 of the projectile 2 (also called the caliber) varies according the various embodiments. In one embodiment, the diameter D1 of the projectile 2 is between about 0.20 inches and about 0.50 inches. In a preferred embodiment, the diameter D1 of the projectile 2 is between about 0.30 inches and about 0.40 inches. In the embodiment shown, the diameter D1 of the projectile 2 is about 0.3075 inches. In one embodiment, the angle α of the nose depressions 8 is between about 3.0 degrees and about 10.0 degrees. In a preferred embodiment, the angle α of the nose depressions 8 is between about 4.5 degrees and about 6.5 degrees. In a more preferred embodiment, the angle α of the nose depressions 8 is about 5.5 degrees.

Figure 20A:
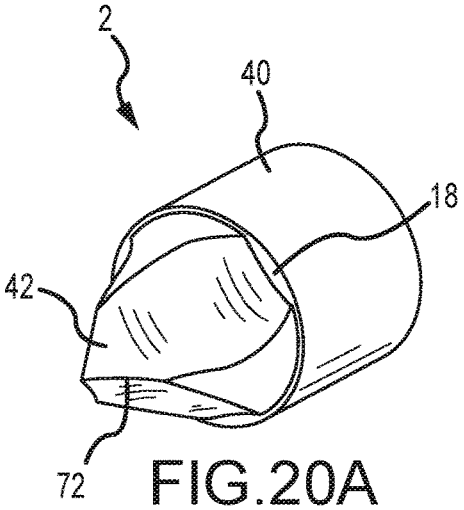
FIGS. 20A-E show a projectile according to a twentieth embodiment of the invention.
Figure 20B:
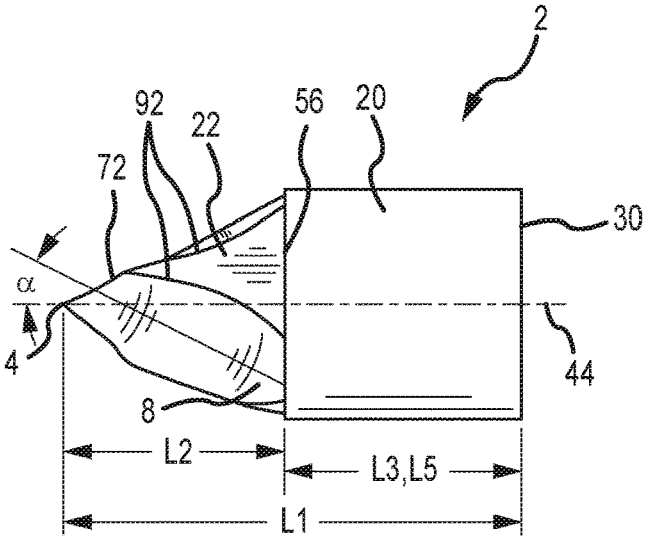
Figure 20C:
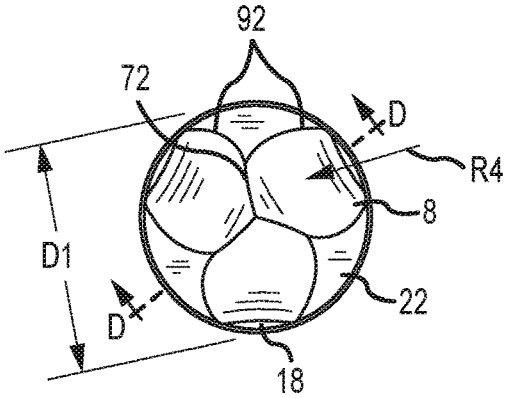
Figure 20D:
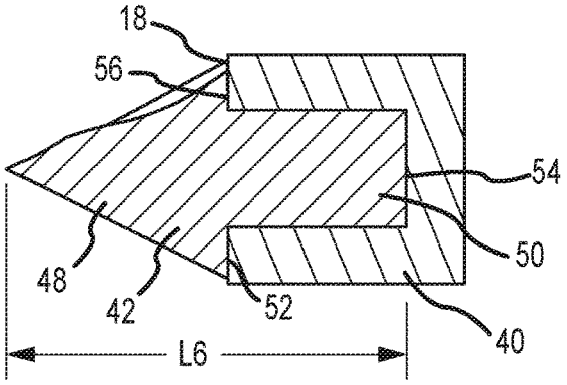
Figure 20E:
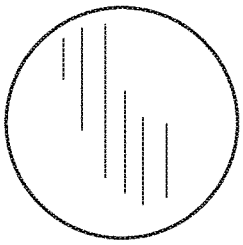

FIGS. 20A-E show a projectile according to a twentieth embodiment of the invention. FIG. 20A is a perspective view of the projectile 2. FIG. 20B is a side elevation view of the projectile 2. FIG. 20C is a top plan view of the projectile 2. FIG. 20D is a cross section taken at cut D-D of FIG. 20C. FIG. 20E is a bottom plan view of the projectile 2.

The projectile 2 comprises a tip 4 on one end opposite a base 30 on the other end. The projectile 2 comprises a nose portion 6 and a cylindrical portion 20. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The remaining portions 22 have a generally triangular shape with the tip of the triangle positioned proximate to the tip 4 of the projectile and the base of the triangle positioned proximate to the rear of the nose 6 and the forward portion of the cylindrical portion 20. A first edge 92 is formed between a nose depression 8 and a remaining portion 22 and a second edge 72 proximate the tip 4 is formed between two nose depressions 8. The first edge 92 and/or the second edge 72 may be referred to as a cutter edge in some embodiments. The nose depressions 8 can terminate in a substantially flat shoulder 18 in some embodiments. In other embodiments, a shoulder is not present between the nose depressions 8 and the front 56 of the housing 40. The nose depressions 8 have a curved shape meaning that the trough or bottom of the nose depression 8 is curved and has a radius of curvature R4. In one embodiment, the nose depressions are cut using a ⅜ inch ball end mill.

The longitudinal axis 44 of the projectile 2 is shown in FIG. 20B. The angle α of the nose depressions 8 can be measured from the centerline 10 of the nose depressions 8 relative to the longitudinal axis 44. In some embodiments, the angle α is measured relative to the original ogive of the projectile nose portion 6 or the remaining portion 22. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8.

In one embodiment, the radius of curvature R4 of the nose depressions 8 is between about 1/32 inches and about 0.50 inches. In a preferred embodiment, the radius of curvature R4 of the nose depressions 8 is between about 3/32 inches and about ⅜ inches. In a more preferred embodiment, the radius of curvature R4 of the nose depressions 8 is about 0.1875 inches. In one embodiment, the length L1 of the projectile 2 is between about 0.400 inches and about 1.00 inch. In a preferred embodiment, the length L1 of the projectile 2 is between about 0.550 inches and about 0.850 inches. In a more preferred embodiment, the length L1 of the projectile 2 is about 0.710 inches. In one embodiment, the length L2 of the nose portion 6 is between about 0.150 inches and about 0.500 inches. In a preferred embodiment, the length L2 of the nose portion 6 is between about 0.350 inches and about 0.450 inches. In a more preferred embodiment, the length L2 of the nose portion 6 is about 0.400 inches. In one embodiment, the length L3 of the cylindrical portion 20 is between about 0.100 inches and about 0.500 inches. In a preferred embodiment, the length L3 of the cylindrical portion 20 is between about 0.200 inches and about 0.400 inches. In a more preferred embodiment, the length L3 of the cylindrical portion 20 is about 0.310 inches. The diameter D1 of the projectile 2 (also called the caliber) varies according the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 15 degrees. In a preferred embodiment, the angle α of the nose depressions 8 is between about 6 degrees and about 9 degrees. In a more preferred embodiment, the angle α of the nose depressions 8 is about 7.5 degrees.

The advantage of this projectile is that it can shoot through armor. This projectile 2 is different from the prior art because it can pierce armor and stop in soft tissue. The sharp tip 4 and sharp cutter edges 72 allow this projectile 2 to cut through armor, including Kevlar. Additionally, the shoulders 18 of the projectile enable the projectile 2 to stop in soft tissue because the shoulders 18 slow the projectile down once it hits soft tissue. This projectile 2 is likely for military use only.

The construction of this projectile 2 may be accomplished using a press or mill and lathe. One unique and innovative feature is the shape of the front of the projectile 2, which has a slight radius coming off the bearing surface 20 (the cylindrical portion or the shaft) but is largely formed by angled or slightly twisting depressions 8 pointed to the front. The depressions 8 form troughs and ridges 22 (or remaining portions between the depressions 8) that possess an angle or a slight radius off the centerline 44 (longitudinal axis) of the projectile. In some embodiments, the twist angle α of the depressions 8 corresponds to (i.e., is equal to) or is greater than the barrel twist rate (i.e., the twist rate of the rifling in the barrel) and turns in the same direction as the barrel's rifling. In other embodiments, the twist angle α of the depressions 8 is equal to or greater than the barrel twist rate and turns in the opposite direction as the barrel's rifling. These depressions 8 do not affect the projectile during internal ballistics but they greatly enhance the performance during external and/or terminal ballistics. In some embodiments, at the center of the tip 4 or a portion of the nose 6 proximate the tip 4, the ridges 92 meet to form a cutting surface or cutting edge 72. These edges 72 initiate a cut in the target, greatly reducing resistance through media such as sheet metal, fabrics, and soft armor. The twisting troughs 8 move media away from the projectile 2 further reducing resistance and they promote and maintain the spin to ensure the projectile 2 penetrates deep and straight. The troughs 8 may rapidly move liquids and soft tissue away from the path of the projectile 2 and therefore increase the wound channel.

Referring to FIGS. 21A-23E, which are pistol projectile embodiments that, among other things, provide deep straight penetration. These pistol projectiles 2 are homogenous in nature and intended for deep, straight penetration. In one embodiment, the pistol projectile 2 is comprised of brass. These projectiles 2 are different from the prior art because they can pierce armor and stop in soft tissue. The sharp tip 4 and sharp cutter edges 72 allow these projectiles 2 to cut through armor, including Kevlar. Further, these projectiles 2 create a lot of cavitation in soft tissue, thus making a wound larger than it would be with a projectile of the prior art. Intended users of these projectiles 2 comprise military and law enforcement. Additionally, the base 30 of these projectiles is shown substantially flat and perpendicular to the longitudinal axis 44 of the projectile. In alternative embodiments, the base could have a domed shape that curves inward toward the cylindrical portion to allow more gun powder to be loaded into the final bullet. However, the projectile with the dome-shaped base does not continue to fly straight after about 600 yards and the projectile does not have enough density to fly through transonic speeds.

The construction of these projectiles 2 may be accomplished using a press or mill and lathe. One unique and innovative feature is the shape of the front of the projectile 2, which has a slight radius coming off the bearing surface 20 (the cylindrical portion or the shaft) but is largely formed by angled or slightly twisting depressions 8 pointed to the front. The depressions 8 form troughs and ridges 22 (or remaining portions between the depressions) that possess an angle or a slight radius off the centerline 44 (longitudinal axis) of the projectile 2. In some embodiments, the twist angle α of the depressions 8 corresponds to (i.e., is equal to) or is greater than the barrel twist rate (i.e., the twist rate of the rifling in the barrel) and turns in the same direction as the barrel's rifling. In other embodiments, the twist angle α of the depressions 8 is equal to or greater than the barrel twist rate and turns in the opposite direction as the barrel's rifling. These depressions 8 do not affect the projectile 2 during internal ballistics but they greatly enhance the performance during external and/or terminal ballistics. In some embodiments, at the center of the tip 4 or a portion of the nose 6 proximate the tip 4, the ridges 92 meet to form a cutting surface or cutting edge 72. These edges 72 initiate a cut in the target, greatly reducing resistance through media such as sheet metal, fabrics, and soft armor. The twisting troughs 8 move media away from the projectile 2 further reducing resistance and promote and maintain the spin to ensure the projectile 2 penetrates deep and straight. The troughs 8 may rapidly move liquids and soft tissue away from the path of the projectile 2 and therefore increase the wound channel.

In one embodiment, the pistol projectile 2 is manufactured via a Swiss Turn machine or the combination of a lathe and mill. Alternatively, the pistol projectile 2 is manufactured via a powdered or gilding metal that is then pressed into a die at high pressure. Due to the direct interface with the barrel, a softer metal may be used. The sharp edges 72 in the front create the ability to penetrate armor (hard and soft) and metal. Testing has revealed that the 78 grain 9 mm projectile moving at 1550 fps will penetrate the following materials: 16 sheets of 22-gauge steel and Level IIIA soft Kevlar. This same projectile fired from a 380 moving 830 fps will penetrate Level IIIA soft armor. If the twist (angle α from centerline 44) of the trough 8 is in the same direction of the rifling, it will increase the penetration in tissue. The angle α is to be equal to or greater than the angle of the rifling.

The angle of the rifling is subject to change by barrel twist rate and caliber. For example, a 9 mm (0.355") with a 1 in 10" rate of twist will have a different alpha (α) angle than the same rate of twist in a 45 ACP (0.451"). Different barrels will have different rates of twist and can differ in the direction of the twist. In FIGS. 21-23, all the alpha angles are set to 15 degrees or 25 degrees. When this projectile 2 is fired from a barrel that twists in the opposing direction of the alpha angle, the penetration lessens but the tissue damage increases. A lower alpha angle or thicker/fatter front to the projectile 2 will have greater tissue damage and a lesser ability to penetrate armor. A higher alpha angle or sharper projectile will penetrate better but do less tissue damage.

In one embodiment of the pistol projectile, terminal ballistics traits are emphasized. The tip 4 of the projectile 2 is formed such that the trough 8 is at an angle α relative to the longitudinal axis 44 of the projectile 2. Due to magazine and chamber constraints, projectiles have a maximum length. The density of the material will determine this alpha angle because a steeper alpha angle cuts better, but has a lower weight.

In some embodiments, the twist rate a of the ridges 92 can equal to or exceeds, by up to double, the twist rate of the barrel. In one embodiment, the projectile 2 would increase the rate of twist once it struck the terminal media. In one embodiment, a projectile 2 with a counter twist to (i.e., in the opposite direction of) the rifling is provided, therefore limiting penetration once it cuts through the outer layer of its target. Twist rates in most handguns, run from 4-7 degrees, but could be between 2-10 degrees.

In general, the non-congruent twist penetrates less into the target and larger end mill cuts penetrate less into the target.

These projectiles 2 create cavitation and slow down in soft tissue. The advantages generally include the ease of manufacturing and the non-expanding bullet (i.e., no housing and cavities). Further, the projectile 2 does not deflect in auto glass, it shoots through sheet metal and body armor using its cutting edges 72, and it creates a cavitation in tissue to help the projectile 2 slow down in the soft tissue. A congruent twist will increase the depth of the projectile's penetration in soft media. The shorter the distance the projectile travels in the target, the more energy is released in a shorter distance. Thus, a wider tissue area is affected in order to absorb the energy.

This projectile 2 is different from the prior art because it can pierce armor and stop in soft tissue. The sharp tip 4 and sharp cutter edges 72 allow this projectile 2 to cut through armor, including Kevlar. Additionally, the nose depressions 8 positioned at an angle α greater than about 10 degrees create cavitation to collect the target medium such that the projectile 2 stops in soft tissue. This projectile is likely for military and civilian use. The density of the projectiles may be about 7 g/cm$^3$.

Figure 21A:
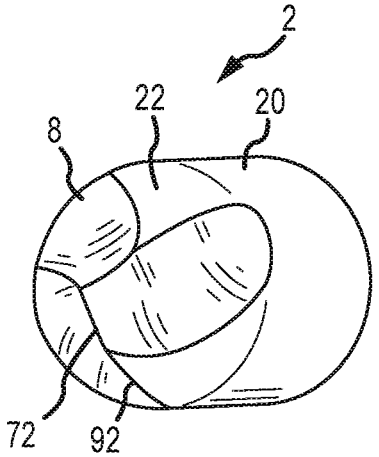
FIGS. 21A-D show a projectile according to a twenty-first embodiment of the invention.
Figure 21B:
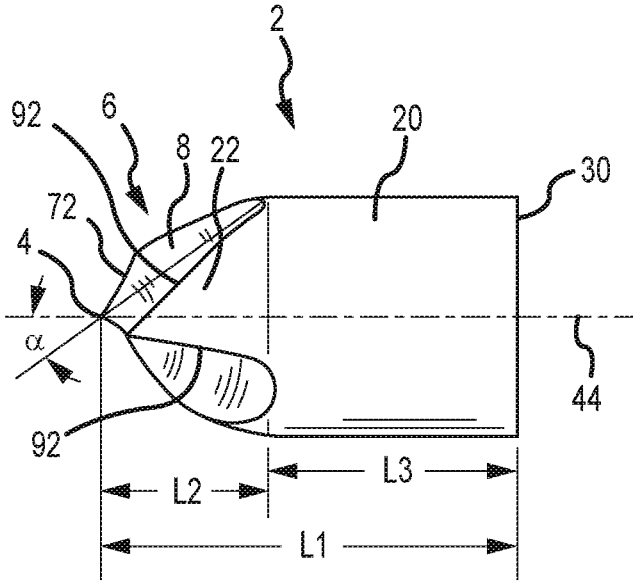
Figure 21C:
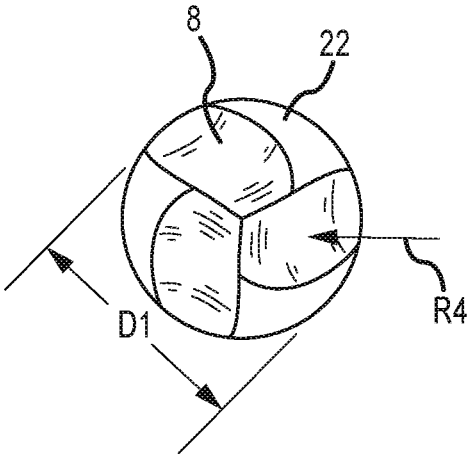
Figure 21D:
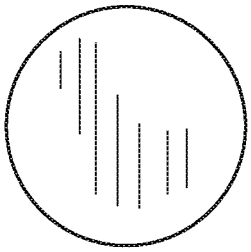

FIGS. 21A-D show a projectile according to a twenty-first embodiment of the invention. FIG. 21A is a perspective view of the projectile 2. FIG. 21B is a side elevation view of the projectile 2. FIG. 21C is a top plan view of the projectile 2. FIG. 21D is a bottom plan view of the projectile 2. Note that FIGS. 21A-D are to scale.

The projectile 2 comprises a tip 4 on one end opposite a base 30 on the other end. The projectile 2 comprises a nose portion 6 and a cylindrical portion 20. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4. In one embodiment, the nose depressions are cut using a 3/16 inch ball end mill. The nose depressions 8 extend from a front portion of the cylindrical portion 20 to the tip 4 of the projectile.

The longitudinal axis 44 of the projectile 2 is shown in FIG. 21B. The angle α of the nose depressions 8 can be measured from the centerline 10 of the nose depressions 8 relative to the longitudinal axis 44. As with all embodiments described herein, the nose depressions 8 can be right or left-hand depressions 8. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are left-hand nose depressions 8 because the angle α is positioned to the left of the longitudinal axis 44. In one embodiment, the projectile 2 has at least three nose depressions 8. However, the projectile 2 can have more or fewer nose depressions 8.

In one embodiment, the radius of curvature R4 of the nose depressions 8 is between about 0.05 inches and about 0.25 inches. In a preferred embodiment, the radius of curvature R4 of the nose depressions 8 is between about 0.075 inches and about 0.15 inches. In a more preferred embodiment, the radius of curvature R4 of the nose depressions 8 is about 0.09375 inches. In one embodiment, the length L1 of the projectile 2 is between about 0.40 inches and about 0.80 inches. In a preferred embodiment, the length L1 of the projectile 2 is between about 0.50 inches and about 0.60 inches. In a more preferred embodiment, the length L1 of the projectile 2 is about 0.600 inches. In one embodiment, the length L2 of the nose portion 6 is between about 0.20 inches and about 0.40 inches. In a preferred embodiment, the length L2 of the nose portion 6 is between about 0.25 inches and about 0.35 inches. In a more preferred embodiment, the length L2 of the nose portion 6 is about 0.315 inches. In one embodiment, the length L3 of the cylindrical portion 20 is between about 0.20 inches and about 0.50 inches. In a preferred embodiment, the length L3 of the cylindrical portion 20 is between about 0.25 inches and about 0.35 inches. In a more preferred embodiment, the length L3 of the cylindrical portion 20 is about 0.285 inches. The diameter D1 of the projectile 2 varies according the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. In yet another preferred embodiment, the diameter D1 of the projectile 2 is about 0.450 inches. In one embodiment, the angle α of the nose depressions 8 is between about 5 degrees and about 45 degrees. In a preferred embodiment, the angle α of the nose depressions 8 is between about 20 degrees and about 30 degrees. In a more preferred embodiment, the angle α of the nose depressions 8 is about 25 degrees.

Figure 22A:
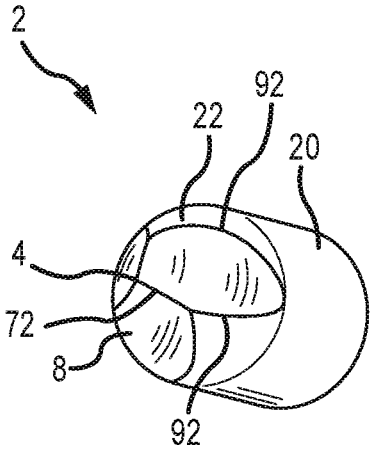
FIGS. 22A-D show a projectile according to a twenty-second embodiment of the invention.
Figure 22B:
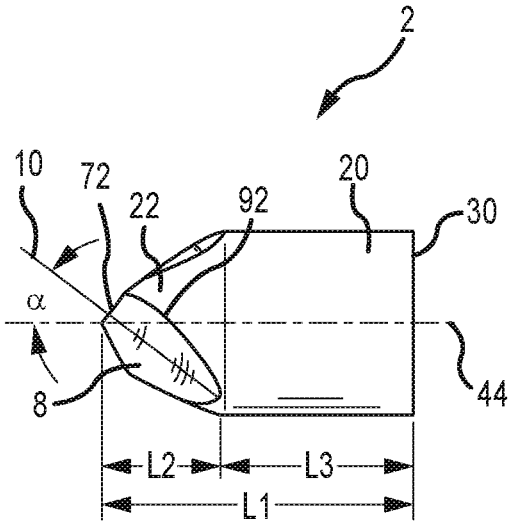
Figure 22C:
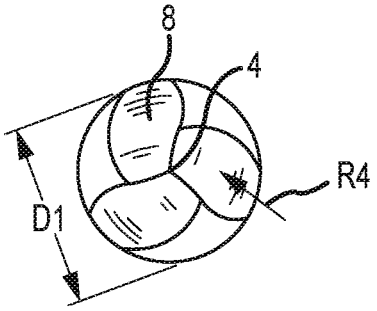
Figure 22D:
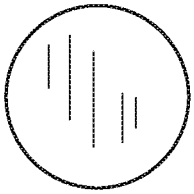

FIGS. 22A-D show a projectile according to a twenty-second embodiment of the invention. FIG. 22A is a perspective view of the projectile 2. FIG. 22B is a side elevation view of the projectile 2. FIG. 22C is a top plan view of the projectile 2. FIG. 22D is a bottom plan view of the projectile 2. Note that FIGS. 22A-D are to scale.

FIGS. 22A-D are the same as FIGS. 21A-D except that the nose depressions 8 are right-hand nose depressions 8 because the angle α is positioned to the right of the longitudinal axis 44. Further, the nose depressions 8 are cut using a 3/8 inch ball end mill. The nose depressions 8 in FIG. 22A-D may be shorter and deeper than the nose depression 8 of FIGS. 21A-D. In one embodiment, the radius of curvature R4 of the nose depressions 8 is between about 0.05 inches and about 0.30 inches. In a preferred embodiment, the radius of curvature R4 of the nose depressions 8 is between about 0.15 inches and about 0.25 inches. In a more preferred embodiment, the radius of curvature R4 of the nose depressions 8 is about 0.1875 inches.

Figure 23A:
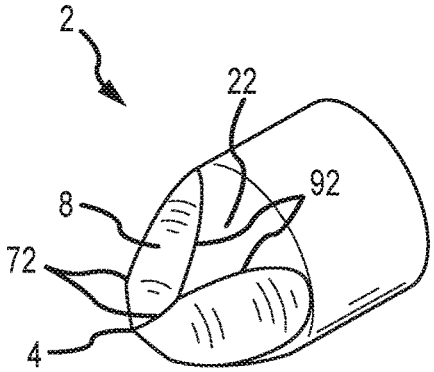
FIGS. 23A-F show a projectile according to a twenty-third embodiment of the invention.
Figure 23B:
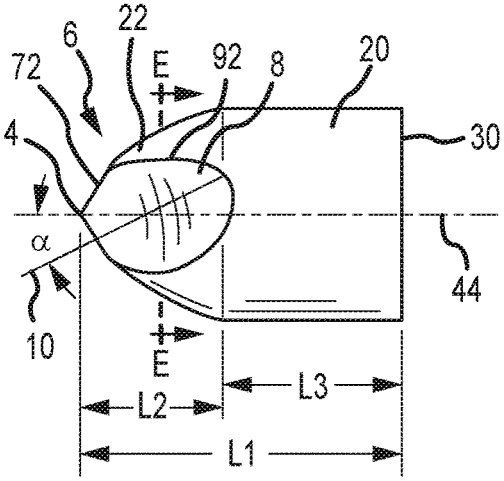
Figure 23C:
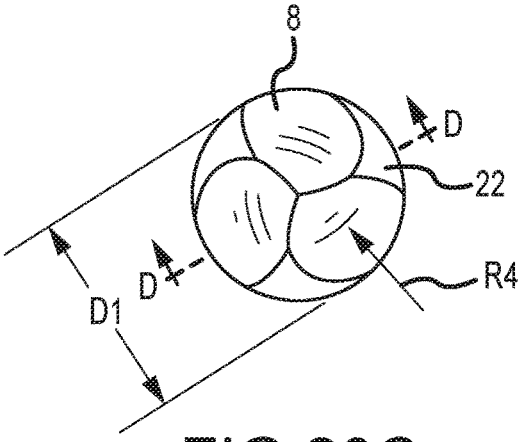
Figure 23E:
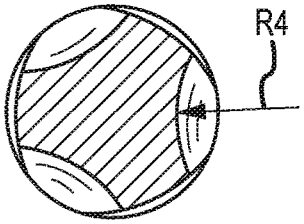
Figure 23D:
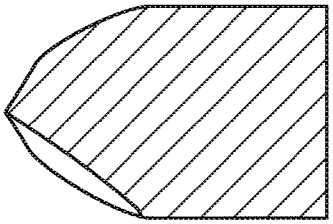
Figure 23F:
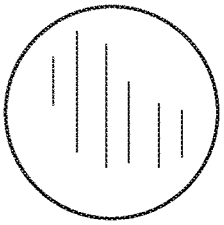

FIGS. 23A-F show a projectile according to a twenty-third embodiment of the invention. FIG. 23A is a perspective view of the projectile 2. FIG. 23B is a side elevation view of the projectile 2. FIG. 23C is a top plan view of the projectile 2. FIG. 23D is a cross section taken at cut D-D. FIG. 23E is a cross section taken at cut E-E. FIG. 23F is a bottom plan view of the projectile 2. Note that FIGS. 23A-F are to scale.

FIGS. 23A-F are the same as FIGS. 21A-D except that the nose depressions 8 are cut using a 0.50 inch ball end mill. Each nose depression 8 has a radius of curvature R4 because it has a curved or rounded bottom. The radius of curvature R4 of the depression 8 is shown in FIGS. 23C and 23E. In one embodiment, the radius of curvature R4 of the nose depressions 8 is between about 0.10 inches and about 0.50 inches. In a preferred embodiment, the radius of curvature R4 of the nose depressions 8 is between about 0.20 inches and about 0.30 inches. In a more preferred embodiment, the radius of curvature R4 of the nose depressions 8 is about 0.25 inches. Further, the diameter D1 of the projectile 2 varies according the various embodiments. In one embodiment, the diameter D1 of the projectile 2 is between about 0.200 inches and about 0.600 inches. In a preferred embodiment, the diameter D1 of the projectile 2 is between about 0.300 inches and about 0.50 inches. In the embodiment shown, the diameter D1 of the projectile 2 is about 0.400 inches. In another preferred embodiment, the diameter D1 of the projectile 2 is about 0.450 inches.

Figure 24A:
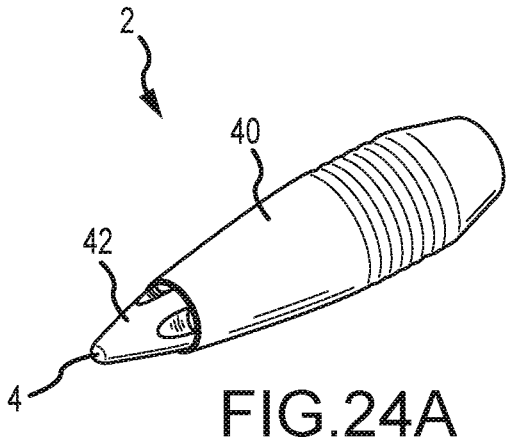
FIGS. 24A-E show a projectile according to a twenty-fourth embodiment of the invention.
Figure 24B:
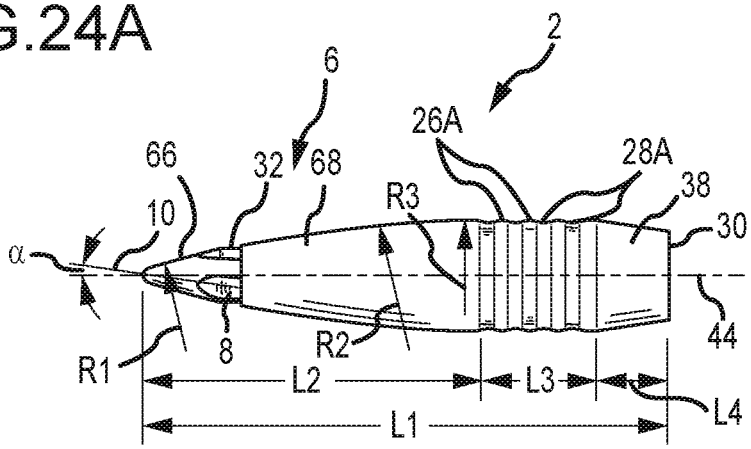
Figure 24C:
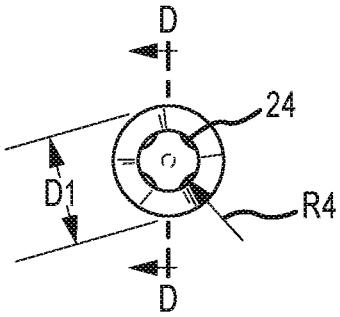
Figure 24D:
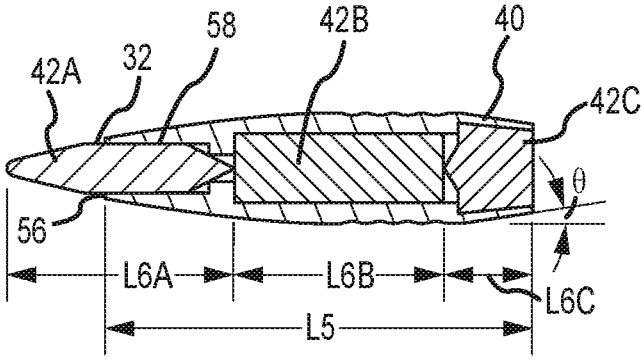
Figure 24E:
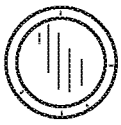

FIGS. 24A-E show a projectile according to a twenty-fourth embodiment of the invention. FIG. 24A is a perspective view of the projectile 2. FIG. 24B is a side elevation view of the projectile 2. FIG. 24C is a top plan view of the projectile 2. FIG. 24D shows a cross section of the projectile 2 taken along cut D-D of FIG. 24B. FIG. 24E is a bottom plan view of the projectile 2. Note that FIGS. 24A-E are to scale. FIG. 24 is the same as FIG. 35 except that the projectile of FIG. 24 has three inserts, 42A, 42B, 42C. Further, the first insert 42A is metal, for example, steel, Inconel, or another hard metal. The second insert 42B is aluminum or other soft metal. The third insert 42C is tungsten or another hard metal. Cavities 24 are positioned between the inserts 42A, 42B, 42C and the housing 40.

The longitudinal axis 44 of the projectile 2 is shown in FIG. 24B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. The depressions 8 create cavities 24 between the inserts 42A, 42B, 42C, and the housing 40 such that when the projectile 2 hits a soft medium target, the cavities 24 fill with the soft medium and the projectile slows down. The steeper (i.e., greater) alpha angle will also transfer media at a greater rate into the housing for a faster opening and expansion of the housing 40 upon impact with the terminal media.

The length L1 of the projectile 2 varies according to various embodiments and varies with caliber (diameter D1). In one embodiment, the length L1 of the projectile 2 is between about 1.0 inch and about 2.0 inches. In a preferred embodiment, the length L1 of the projectile 2 is between about 1.3 inches and about 1.6 inches. In a more preferred embodiment, the length L1 of the projectile 2 is about 1.405 inches. The diameter D1 of the projectile 2 varies according to the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the length of the first nose portion 66 extending from the tip 4 to the linear portion 32 is between about 0.10 inches and about 0.30 inches. In a preferred embodiment, the length of the first nose portion 66 is between about 0.14 inches and about 0.20 inches. In a more preferred embodiment, the length of the first nose portion 66 is about 0.17 inches. In one embodiment, the length L5 of the housing 40 is between about 1.0 inch and about 1.3 inches. In a preferred embodiment, the length L5 of the housing 40 is about 1.145 inches. In one embodiment, the length of the second nose portion 68 extending from the front 56 of the housing 40 to the cylindrical portion 20 is between about 0.55 and about 0.70 inches. In a preferred embodiment, the length of the second nose portion 68 is about 0.62 inches.

In one embodiment, the length L6A of the first insert 42A is between about 0.3 inches and about 0.9 inches. In a preferred embodiment, the length L6A of the first insert 42A is between about 0.45 inches and about 0.75 inches. In a more preferred embodiment, the length L6A of the first insert 42A is about 0.6 inches. In one embodiment, the length of the linear portion 32 outside of the housing 40 is between about 0.01 and 0.15 inches. In a preferred embodiment, the length of the linear portion 32 outside of the housing 40 is between about 0.05 and 0.10 inches. In one embodiment, the length L6B of the second insert 42B is between about 0.25 inches and about 1.0 inch. In a preferred embodiment, the length L6B of the second insert 42B is between about 0.4 inches and about 0.7 inches. In a more preferred embodiment, the length L6B of the second insert 42B is about 0.555 inches. In one embodiment, the length L6C of the third insert 42C is between about 0.1 inches and about 0.5 inches. In a preferred embodiment, the length L6C of the third insert 42C is between about 0.15 inches and about 0.35 inches. In a more preferred embodiment, the length L6C of the third insert 42C is about 0.25 inches. However, these lengths can vary with different embodiments. Specifically, embodiments of smaller or larger calibers will have shorter or longer lengths respectively.

In one embodiment, the length L4 of the boat tail 38 is between about 0.10 inches and about 0.40 inches. In a preferred embodiment, the length L4 of the boat tail 38 is between about 0.15 inches and about 0.35 inches. In a more preferred embodiment, the length L4 of the boat tail 38 is about 0.23 inches. In another more preferred embodiment, the length L4 of the boat tail 38 is about 0.30 inches.

In one embodiment, the angle θ of the boat tail 38 is between about 5 degrees and about 10 degrees. In a preferred embodiment, the angle θ of the boat tail 38 is between about 6.5 degrees and about 8.0 degrees. In a more preferred embodiment, the angle θ of the boat tail 38 is about 7.5 degrees.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch.

The cylindrical portion 20 comprises angled driving bands 26A and angled relief cuts 28A. In one embodiment, the angled driving bands 26A and angled relief cuts 28A are positioned at an angle σ relative to the longitudinal axis 44 between about 5 degrees and about 10 degrees. In a preferred embodiment, the angled driving bands 26A and angled relief cuts 28A are positioned at an angle σ relative to the longitudinal axis 44 between about 6 degrees and about 9 degrees. In a more preferred embodiment, the angled driving bands 26A and angled relief cuts 28A are positioned at an angle σ relative to the longitudinal axis 44 about 7.5 degrees. In another preferred embodiment, the angled driving bands 26A and angled relief cuts 28A are positioned at an angle σ relative to a horizontal line or the longitudinal axis 44 about 8.5 degrees. In alternate embodiments, the driving bands 26A vary in number, comprising one driving band 26A, a plurality of driving bands 26A, two driving bands 26A, three driving bands 26A, or four or more driving bands 26A. The angled driving bands 26A and angled relief cuts 28A create air disturbances that stabilize the projectile 2 in flight allowing the projectile 2 to fly straighter and be less affected by cross winds than projectiles of the prior art.

Figure 25A:
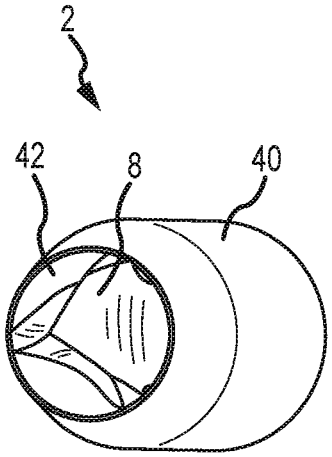
FIGS. 25A-D show a projectile according to a twenty-fifth embodiment of the invention.
Figure 25B:
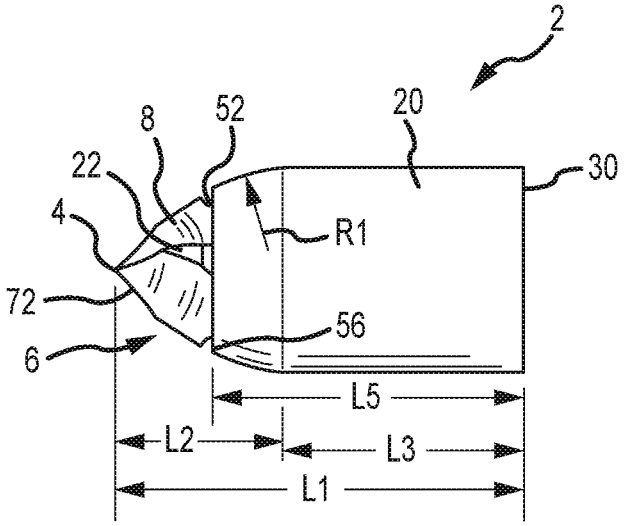
Figure 25C:
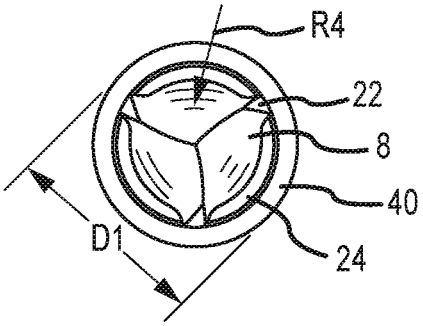
Figure 25D:
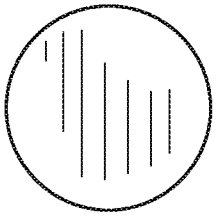
Figure 30A:
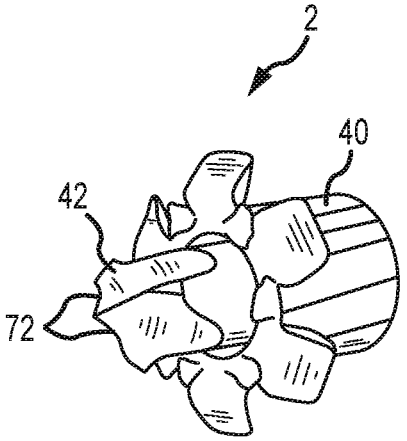
FIGS. 30A-C show the projectile of FIGS. 25A-C after being fired.

FIGS. 25A-D show a projectile 2 according to a twenty-fifth embodiment of the invention. This projectile 2 creates large cavitations and giant wounds. When the projectile 2 hits soft tissue, the housing 40 flowers and peels backward as shown in FIG. 30. This projectile 2 can also be accurately shot through glass because it maintains its original flight path. The projectile 2 keeps its shape through hard material (e.g., glass or steel) and it keeps its trajectory: tip forward flight. It can also penetrate body armor and stop in soft tissue because when it hits soft tissue it opens up (see FIGS. 30A-31C). FIG. 25A is a perspective view of the projectile 2. FIG. 25B is a side elevation view of the projectile 2. FIG. 25C is a top plan view of the projectile 2. FIG. 25D is a bottom plan view of the projectile 2. Note that FIGS. 25A-D are to scale.

Figure 26A:
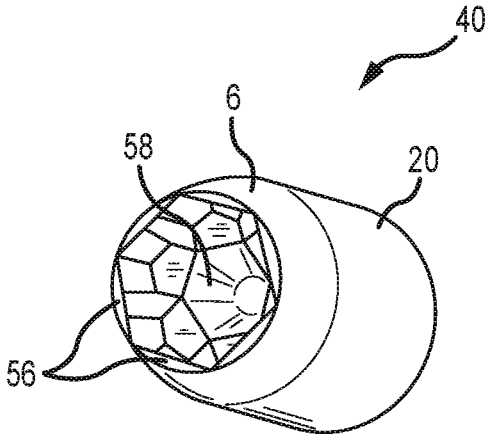
FIGS. 26A-B show the projectile housing of FIGS. 25A-C.
Figure 26B:
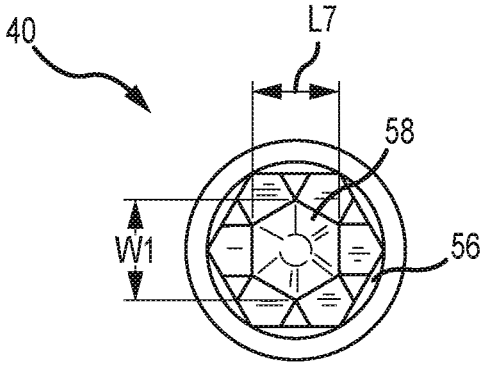
Figure 27A:
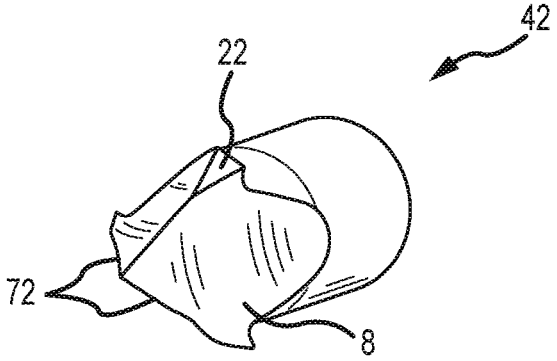
FIGS. 27A-C show the projectile insert of FIGS. 25A-C.
Figure 27B:
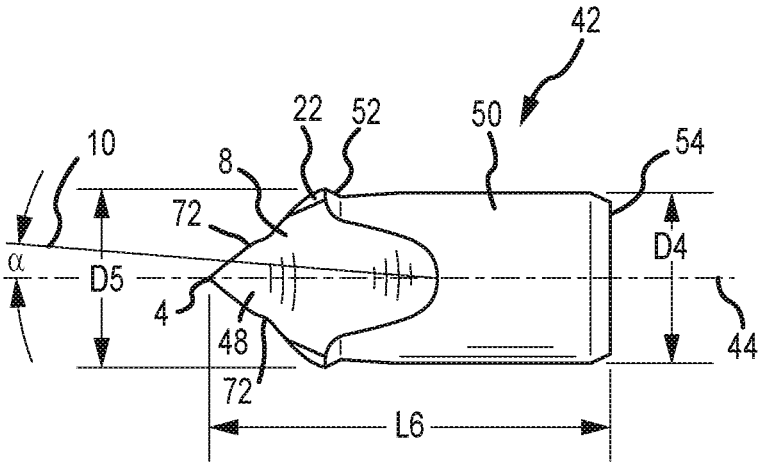
Figure 27C:
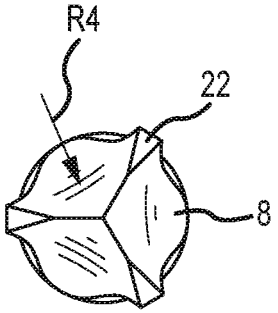

FIGS. 27A-C show the insert 42 used in the projectile 2 of FIGS. 25A-D. FIGS. 26A-B show the housing 40 used in the projectile 2 of FIG. 25A-C. FIGS. 25A-D depict a two-piece bullet embodiment. Intended users comprise military, law enforcement, and private citizens. Among other things, these embodiments provide deep straight penetration in, for example, sheet metal, clothing, soft armor, and fabrics, but may provide limited penetration in tissue. These embodiments may be manufactured of materials comprising brass, copper, aluminum, tungsten-carbide, or alloys to form the insert 42 and copper or brass, for example, to form the housing 40.

The construction of these projectiles 2 may be accomplished using a press or mill and lathe. One feature is the shape of the insert 42 of the projectile 2, largely formed by slightly twisting depressions 8 pointed to the front of the insert 42. The depressions 8 form troughs and ridges that form the point 4 of the insert 42. The tip 4 of the insert is positioned forward of the housing 40 and the terminal ends of the troughs 8 and ridges 22 extend into the housing 40. Proximate the tip 4, the depressions 8 intersect forming cutting edges 72. The cutting edges 72 initiate a cut in the target to promote the penetration through the outer layer and because a portion of the troughs 8 are inside the housing 40 results in rapid and violent expansion of the housing 40 upon impact with the projectile's target. The twist of the depressions 8 corresponds to or is greater than the twist rate of the rifling in the barrel and the depressions 8 turn in the same direction or the opposite direction of the barrel. The projectile can also have a cut perpendicular to the radius line which would generate a zero twist degree. At the center of the tip 4, the ridges 72 join together to form a cutting surface. These edges 72 initiate a cut, greatly reducing resistance through media such as sheet metal, fabrics, and soft armor. The twisting troughs 8 move media away from the projectile 2 and rapidly open the housing 40 to create greater frontal surface area of the projectile 2 during terminal ballistics. These projectiles 2 are designed so as to not over penetrate in soft tissue and to produce a rapid transfer of energy, and may react similarly to full metal jackets ("FMJs") when penetrating sheet metal, glass, soft armor, and fabrics.

In one embodiment, a cap is pressed into place that covers the insert and is held by the housing, which provides a first media to initiate the opening of the housing during the first stages of terminal ballistics.

One advantage of the housing is the ability to make the insert 42 out of almost any material (e.g., brass, aluminum, steel, polymers, etc.). The insert 42 does not interface with the barrel so the use of hard materials or even steel is also feasible. Both steel and aluminum in both similar and opposed twist directions have been tested and are further embodiments. When the twist rate is opposed to the rifling, in particular with the aluminum insert, the tissue destruction is immense. All testing has shown that all these designs will penetrate in similar fashion on both hard and soft armor. The steeper (i.e., greater) alpha angle will also transfer media at a greater rate into the housing for a faster opening and expansion of the housing 40 upon impact with the terminal media.

The projectile 2 comprises a tip 4 on one end opposite a base 30 on the other end. The projectile 2 comprises a nose portion 6 and a cylindrical portion 20 (also called a shank). The nose portion 6 includes nose depressions 8 (also called cutouts or troughs) and a nose remaining portion 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4.

The longitudinal axis 44 of the projectile 2 is shown in FIG. 27B. Accordingly, the angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. However, the projectile 2 can have more or fewer nose depressions 8.

In one embodiment, the radius of curvature R4 of the nose depressions 8 is between about 1/16 and about ½ inches. In a preferred embodiment, the radius of curvature R4 of the nose depressions 8 is between about 3/16 inches and ¼ inches. In one embodiment, the length L1 of the projectile 2 is between about 0.5 inches and about 0.8 inches. In a preferred embodiment, the length L1 of the projectile 2 is between about 0.60 inches and about 0.71 inches. In a more preferred embodiment, the length L1 of the projectile 2 is about 0.670 inches. In one embodiment, the length L2 of the nose portion 6 is between about 0.30 inches and about 0.45 inches. In a preferred embodiment, the length L2 of the nose portion 6 is between about 0.36 inches and about 0.38 inches. In a more preferred embodiment, the length L2 of the nose portion 6 is about 0.37 inches. In one embodiment, the length L5 of the housing 40 is between about 0.316 inches and about 0.716 inches. In a preferred embodiment, the length L5 of the housing 40 is between about 0.416 inches and about 0.616 inches. In a more preferred embodiment, the length L5 of the housing 40 is about 0.516 inches. The diameter D1 of the projectile 2 (also called the caliber) varies according the various embodiments. In one embodiment, the diameter D1 of the projectile 2 is between about 11 mm and about 7 mm. In a preferred embodiment, the diameter D1 of the projectile 2 is between about 10 mm and about 8 mm. In the embodiment shown, the diameter D1 of the projectile 2 is about 9 mm.

FIGS. 26A-B show the projectile housing 40 of FIGS. 25A-C. FIG. 26A is a perspective view of the housing 40. FIG. 26B is a top plan view of the housing 40. Note that FIGS. 26A-B are to scale.

In a preferred embodiment, the dimension W1 of the projectile 2 is between about 0.070 inches and about 0.470 inches. In a more preferred embodiment, the dimension W1 of the projectile 2 is about 0.270 inches. In one embodiment, the length L7 is between about 0.145 inches and about 0.345 inches. In a preferred embodiment, the length L7 is about 0.245 inches.

The housings 40 can be formed on a lathe or press and may be made from copper or brass. Any material that will not harm a barrel would be also be acceptable and form alternative embodiments of the housing 40. The addition of the housing 40 lessens the penetration in tissue by creating greater frontal surface area and therefore increases trauma. FIGS. 27A-29C detail the insert 42 mounted inside a housing 40. By varying the alpha and beta angles of the insert 42, one can control the penetration in armor and the destruction in tissue.

The tip 4 of the insert 42 is formed such that the depression or trough 8 is at an angle α relative to the longitudinal axis 44 of the insert 42. The density of the material used and the size of the insert 42 and projectile will determine this alpha angle because a steeper alpha angle cuts better, but has a lower weight. The steeper alpha angle will also transfer media at a greater rate into the housing for a faster opening and expansion upon impact with the terminal media.

In some embodiments, the twist rate of the depressions 8 can equal or exceed, by up to double, the twist rate of the gun barrel. In one embodiment, the projectile would increase the rate of twist once it struck the terminal media. In one embodiment, an insert 42 with a counter twist to (i.e., in the opposite direction of) the rifling is provided, therefore limiting penetration once it cuts through the outer layer of its target. The twist rate of the depressions 8 of the insert 42 may also be reversed (i.e., in the opposite direction to the barrel twist). Twist rates in most handguns run from about 4-7 degrees, but could be between about 2-10 degrees.

FIGS. 27A-C show the projectile insert 42 of FIGS. 25A-C. FIG. 27A is a perspective view of the insert 42. FIG. 27B is a side elevation view of the insert 42. FIG. 27C is a top plan view of the insert 42. Note that FIGS. 27A-C are to scale.

The insert 42 comprises a tip 4 on one end opposite a lower portion 54 on the other end. The insert 42 comprises an arrowhead portion 48 and a stem portion 50. The underside 52 of the arrowhead 48 can be flat, angled, or rounded. The insert 42 includes nose depressions 8 (also called cutouts or troughs) and a nose remaining portion 22 between the nose depressions 8, where each nose remaining portion 22 is positioned between two nose depressions 8. The remaining portions 22 are the uncut portions having the insert's original ogive and radius of curvature R1. The nose depressions 8 have a curved shape meaning that the trough or bottom of the nose depression 8 is curved and has a radius of curvature R4. In one embodiment, the nose depressions are cut using a ⅜ inch flat end mill.

The longitudinal axis 44 of the insert 42 is shown in FIG. 27B. Accordingly, the angle α of the nose depressions 8 can be measured from the centerline 10 of the nose depressions 8 relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the projectile 2 has at least three nose depressions 8. However, the projectile 2 can have more or fewer nose depressions 8. The nose depressions 8 intersect one another to form cutter edges 72 extending to the tip 4 of the insert 42.

In one embodiment, the radius of curvature R4 of the nose depressions 8 is between about 0.05 inches and about 0.75 inches. In a preferred embodiment, the radius of curvature R4 of the nose depressions 8 is between about 0.10 inches and about 0.5 inches. In a more preferred embodiment, the radius of curvature R4 of the nose depressions 8 is about 0.4 inches. In one embodiment, the length L6 of the insert 42 is between about 0.513 inches and about 0.713 inches. In a preferred embodiment, the length L6 of the insert 42 is between about 0.413 inches and about 0.613 inches. In a more preferred embodiment, the length L6 of the insert 422 is about 0.513 inches. However, the length L6 varies with the embodiment and with the caliber of the projectile.

The diameter D4 of the stem 50 of the insert 42 varies according the various embodiments. In one embodiment, the diameter D4 of the projectile 2 is between about 0.1 inches and about 0.4 inches. In a preferred embodiment, the diameter D4 of the stem 50 of the insert 42 is between about 0.2 inches and about 0.28 inches. In the embodiment shown, the diameter D4 of the stem 50 of the insert 42 is about 0.225 inches. In one embodiment, the diameter D5 of the arrowhead 48 of the insert 42 is between about 0.1 inches and about 0.4 inches. In a preferred embodiment, the diameter D5 of the arrowhead 48 is between about 0.2 inches and about 0.3 inches. In the embodiment shown, the diameter D5 of the arrowhead 48 is about 0.25 inches. In one embodiment, the angle α of the nose depressions 8 is between about 5 degrees and about 25 degrees. In a preferred embodiment, the angle α of the nose depressions 8 is between about 8 degrees and about 12 degrees. In a more preferred embodiment, the angle α of the nose depressions 8 is about 10 degrees.

This insert 42 is different from the prior art because it can pierce armor and the projectile stops in soft tissue. The sharp tip 4 and sharp cutter edges 72 allow this insert 42 to cut through armor, including Kevlar.

Figure 28A:
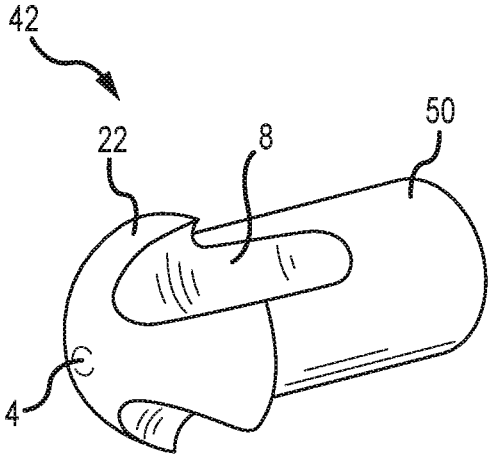
FIGS. 28A-C show a projectile insert according to another embodiment of the invention.
Figure 28B:
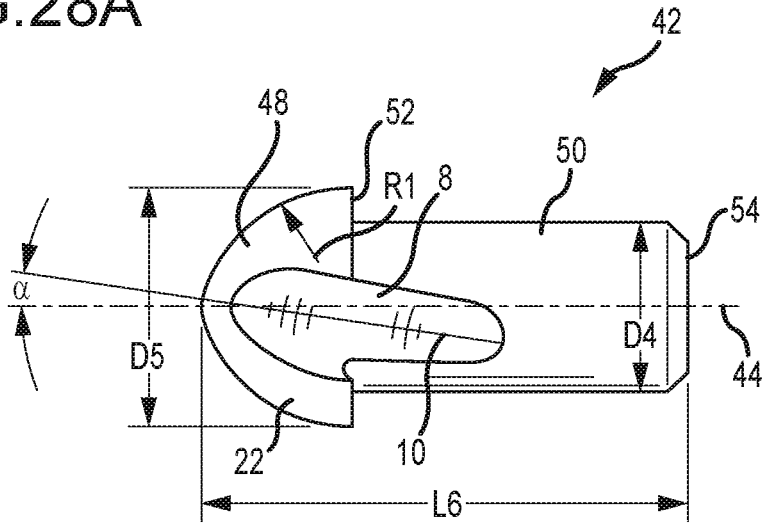
Figure 28C:
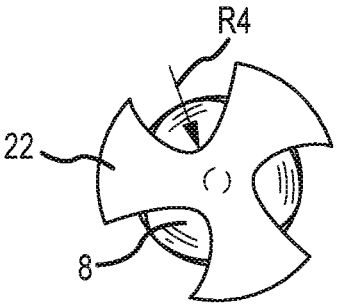

FIGS. 28A-C show a projectile insert 42 according to another embodiment of the invention. This is the civilian insert of FIG. 27. FIG. 28A is a perspective view of the insert 42. FIG. 28B is a side elevation view of the insert 42. FIG. 28C is a top plan view of the insert 42. Note that FIGS. 28A-C are to scale.

The insert 42 comprises a tip 4 on one end opposite a lower portion 54 on the other end. The insert 42 comprises an arrowhead portion 48 and a stem portion 50. The underside 52 of the arrowhead 48 can be angled, flat, or curved. The insert 42 includes nose depressions 8 (also called cutouts or troughs) and nose remaining portions 22 between the nose depressions 8, where each nose remaining portion 22 is positioned between two nose depressions 8. The remaining portions 22 are the uncut portions having the insert's original ogive and radius of curvature R1 The nose depression 8 has a curved shape meaning that the trough or bottom of the nose depression 8 is curved and has a radius of curvature R4. In one embodiment, the nose depressions 8 are cut using a 3⁄32 inch flat end mill.

The longitudinal axis 44 of the insert 42 is shown in FIG. 28B. Accordingly, the angle α of the nose depressions 8 can be measured from the centerline 10 of the nose depressions 8 relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the insert 42 has at least three nose depressions 8. However, the insert 42 can have more or fewer nose depressions 8. In this embodiment, the depressions 8 do not extend all the way to the tip 4 and do not intersect. Rather, the remaining portions 22 extend to the tip 4.

In one embodiment, the radius of curvature R4 of the nose depressions 8 is between about 0.01 and about 0.5 inches. In a preferred embodiment, the radius of curvature R4 of the nose depressions 8 is between about 0.03 inches and about 0.375 inches. In a more preferred embodiment, the radius of curvature R4 of the nose depressions 8 is about 0.25 inches. In another more preferred embodiment, the radius of the curvature R4 of the nose depressions 8 is about 0.047 inches. In one embodiment, the length L6 of the insert 42 is between about 0.426 inches and about 0.826 inches. In a preferred embodiment, the length L6 of the insert 42 is between about 0.526 inches and about 0.726 inches. In a more preferred embodiment, the length L6 of the insert 42 is about 0.626 inches. The diameter D4 of the projectile 2 varies according the various embodiments. In one embodiment, the diameter D4 of the stem 50 is between about 0.1 inches and about 0.4 inches. In a preferred embodiment, the diameter D4 of the stem 50 is between about 0.2 inches and about 0.3 inches. In the embodiment shown, the diameter D4 of the stem 50 is about 0.225 inches. In one embodiment, the diameter D5 of the arrowhead 48 of the insert 42 is between about 0.1 inches and about 0.5 inches. In a preferred embodiment, the diameter D5 of the arrowhead 48 is between about 0.2 inches and about 0.4 inches. In the embodiment shown, the diameter D5 of the arrowhead 48 is about 0.30 inches. In one embodiment, the angle α of the nose depressions 8 is between about 5 degrees and about 25 degrees. In a preferred embodiment, the angle α of the nose depressions 8 is between about 8 degrees and about 12 degrees. In a more preferred embodiment, the angle α of the nose depressions 8 is about 10 degrees.

Figure 29A:
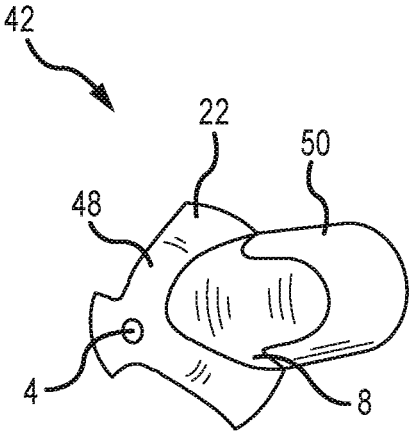
FIGS. 29A-C show a projectile insert according to alternate embodiment of the invention.
Figure 29B:
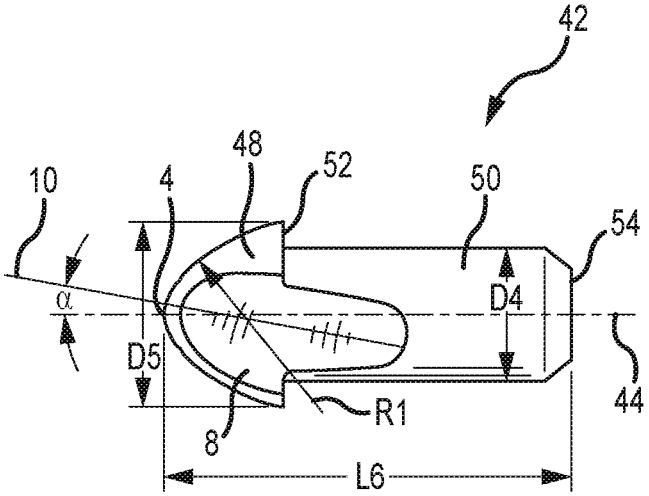
Figure 29C:
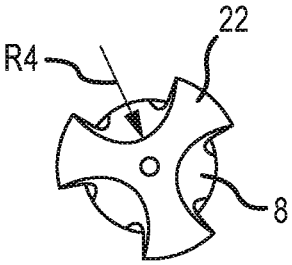

FIGS. 29A-C show a projectile insert 42 according to an alternate embodiment of the invention. The insert 42 can be made of any projectile or bullet material, such as brass or steel. FIG. 29A is a perspective view of the insert 42. FIG. 29B is a side elevation view of the insert 42. FIG. 29C is a top plan view of the insert 42. Note that FIGS. 29A-C are to scale.

The insert 42 comprises a tip 4 on one end opposite a lower portion 54 on the other end. The insert 42 comprises an arrowhead portion 48 and a stem portion 50. The insert 42 includes nose depressions 8 (also called cutouts or troughs) and nose remaining portion 22 between the nose depressions 8, where each nose remaining portion 22 is positioned between two nose depressions 8. The remaining portions 22 are the uncut portions having the insert's original ogive and radius of curvature R1. The nose depressions 8 have a curved shape meaning that the trough or bottom of the nose depression 8 is curved and has a radius of curvature R4. In one embodiment, the nose depressions 8 are cut using a 3/16 inch flat end mill.

The longitudinal axis 44 of the projectile 2 is shown in FIG. 29B. The angle α of the nose depressions 8 can be measured from the centerline 10 of the nose depressions 8 relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In one embodiment, the insert 42 has at least three nose depressions 8. However, the insert 42 can have more or fewer nose depressions 8. The nose depressions 8 can also extend varying lengths along the insert 42. Also, like FIGS. 28A-C, the depressions 8 do not intersect. Rather, the nose remaining portions 22 extend to the tip 4 of the insert 42.

In one embodiment, the radius of curvature R4 of the nose depressions 8 is between about 0.05 inches and about 0.5 inches. In a preferred embodiment, the radius of curvature R4 of the nose depressions 8 is between about 0.08 inches and about 0.375 inches. In a more preferred embodiment, the radius of curvature R4 of the nose depressions 8 is about 0.25 inches. In another more preferred embodiment, the radius of curvature of the depression 8 is about 0.09375 inches. In one embodiment, the length L6 of the insert 42 is between about 0.436 inches and about 0.836 inches. In a preferred embodiment, the length L6 of the insert 42 is between about 0.536 inches and about 0.736 inches. In a more preferred embodiment, the length L6 of the insert 42 is about 0.636 inches. The diameter D4 of the stem 50 of the insert varies according the various embodiments. In one embodiment, the diameter D4 of the stem 50 is between about 0.025 inches and about 0.425 inches. In a preferred embodiment, the diameter D4 of the stem 50 is between about 0.125 inches and about 0.325 inches. In the embodiment shown, the diameter D4 of the stem 50 is about 0.225 inches. In one embodiment, the diameter D5 of the arrowhead 48 of the insert 42 is between about 0.1 inches and about 0.5 inches. In a preferred embodiment, the diameter D5 of the arrowhead 48 is between about 0.2 inches and about 0.4 inches. In the embodiment shown, the diameter D5 of the arrowhead 48 is about 0.3 inches. In one embodiment, the angle α of the nose depressions 8 is between about 5 degrees and about 25 degrees. In a preferred embodiment, the angle α of the nose depressions 8 is between about 8 degrees and about 12 degrees. In a more preferred embodiment, the angle α of the nose depressions 8 is about 10 degrees.

Figure 30B:
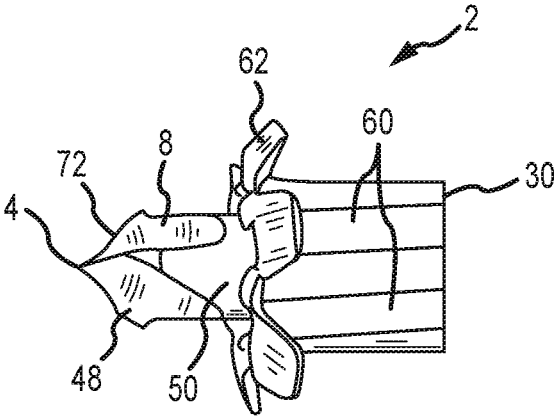
Figure 30C:
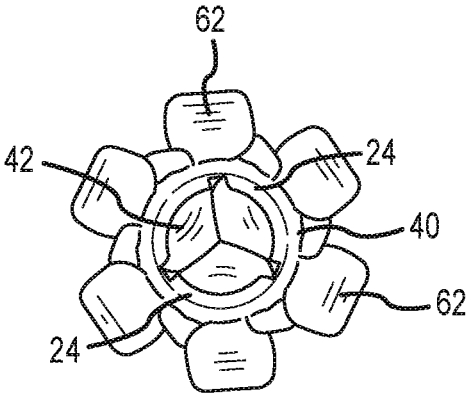

FIGS. 30A-C show the projectile 2 of FIGS. 25A-C after being fired and after hitting the target. FIG. 30A is a perspective view of the projectile 2. FIG. 30B is a side elevation view of the projectile 2. FIG. 30C is a top plan view of the projectile 2. Rifling marks 60 from the gun barrel are shown on the projectile 2.

Figure 31A:
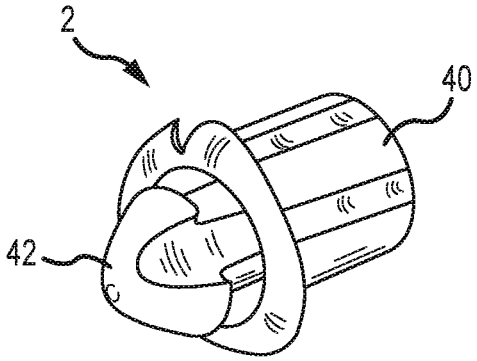
FIGS. 31A-C show a projectile according to a twenty-sixth embodiment of the invention after being fired.
Figure 31B:
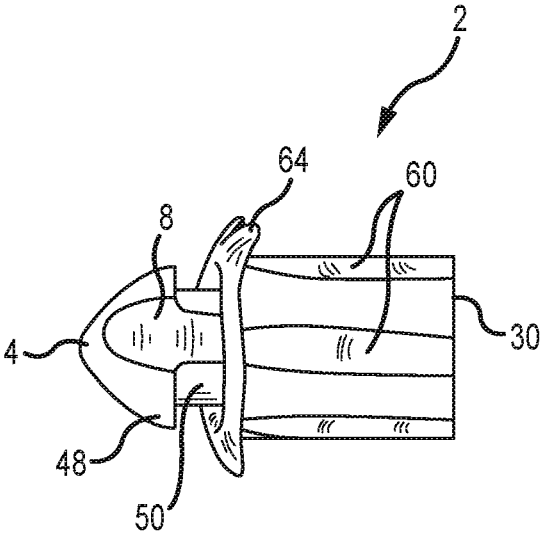
Figure 31C:
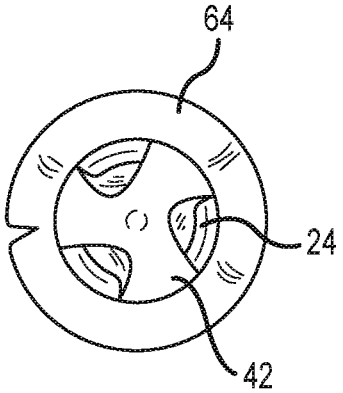

FIGS. 31A-C show a projectile 2 according to a twenty-sixth embodiment of the invention after being fired and after hitting the target. FIG. 31A is a perspective view of the projectile 2. FIG. 31B is a side elevation view of the projectile 2. FIG. 31C is a top plan view of the projectile 2. This insert 42 is the insert shown in FIGS. 28A-C. The projectile 2 of FIGS. 30A-C has perforations on the housing 40 whereas the projectile 2 of FIGS. 31A-C does not have perforations. The perforations cause the housing 40 to flower upon impact as shown in FIG. 30, whereas the housing 40 of FIGS. 31A-C rolls backward in one piece upon impact.

Figure 32A:
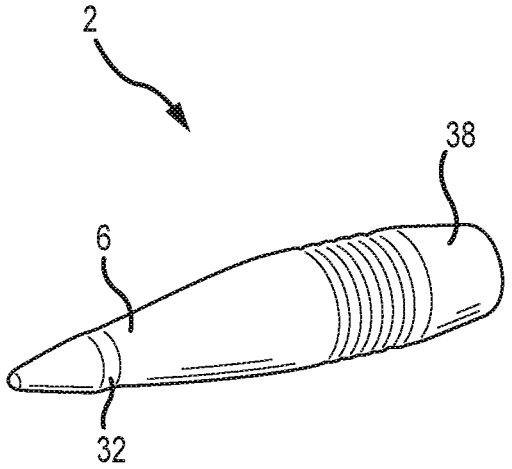
FIGS. 32A-E show a projectile according to a twenty-seventh embodiment of the invention.
Figure 32B:
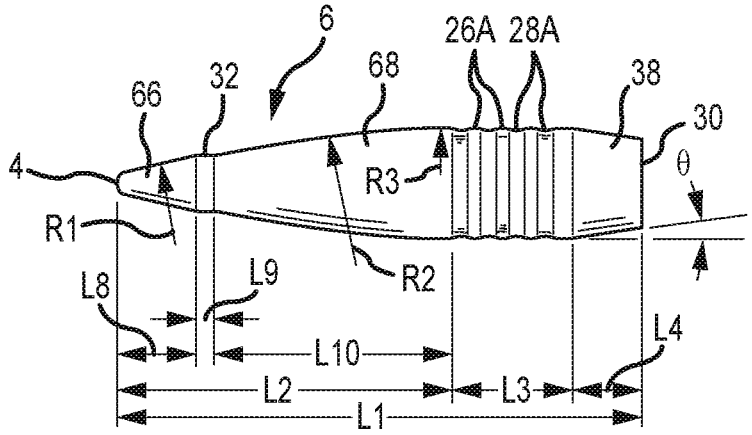
Figure 32C:
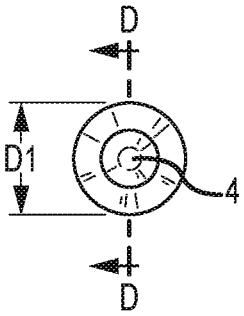
Figure 32D:
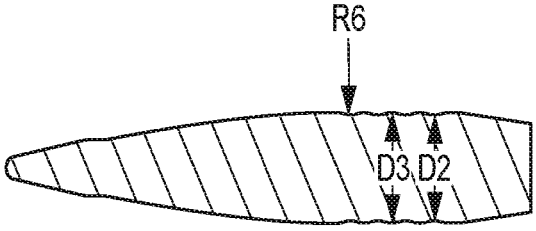
Figure 32E:
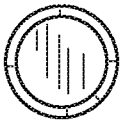

FIGS. 32A-E show a projectile according to a twenty-seventh embodiment of the invention. FIG. 32A is a perspective view of the projectile 2. FIG. 32B is a side elevation view of the projectile 2. FIG. 32C is a top plan view of the projectile 2. FIG. 32D is a cross-sectional view of the projectile 2 taken along cut D-D of FIG. 32C. FIG. 32E is a bottom plan view of the projectile 2. Note that FIGS. 32A-32E are to scale.

The projectile 2 comprises a tip 4 on one end opposite a base 30 on the other end. The projectile 2 comprises a nose portion 6 proximate the tip 4 and a boat tail 38 proximate the base 30 and a cylindrical portion 30 between the nose portion 6 and boat tail 38. The nose portion 6 is comprised of a first nose portion 66, a linear portion 32, and a second nose portion 68. The ogive of the first nose portion 66 has a first radius of curvature R1 and the second nose portion 68 has a second radius of curvature R2. In some embodiments, the second radius of curvature R2 is between about 2.5 inches and about 5.0 inches. In some embodiments, the first nose portion 66 is linear rather than having a radius of curvature R1.

In one embodiment, the length L1 of the projectile 2 is between about 1.125 inches and about 1.725 inches. In a preferred embodiment, the length L1 of the projectile 2 is between about 1.225 inches and about 1.625 inches. In a more preferred embodiment, the length L1 of the projectile 2 is about 1.425 inches. In one embodiment, the length L2 of the nose portion 6 is between about 0.7 inches and about 1.1 inches. In a preferred embodiment, the length L2 of the nose portion 6 is between about 0.8 inches and about 1.0 inch. In a more preferred embodiment, the length L2 of the nose portion 6 is about 0.899 inches. In one embodiment, the length L3 of the cylindrical portion 20 is between about 0.522 inches and about 0.122 inches. In a preferred embodiment, the length L3 of the cylindrical portion 20 is between about 0.422 inches and about 0.222 inches. In a more preferred embodiment, the length L3 of the cylindrical portion 20 is about 0.322 inches. In one embodiment, the length L4 of the boat tail 38 is between about 0.4 inches and about 0.1 inches. In a preferred embodiment, the length L4 of the boat tail 38 is between about 0.3 inches and about 0.15 inches. In a more preferred embodiment, the length L4 of the boat tail 38 is about 0.204 inches. In one embodiment, the length L9 of the linear portion 32 is between about 0.01 inches and 0.10 inches. In a preferred embodiment, the length L9 of the linear portion 32 is between about 0.02 inches and about 0.04 inches. In a more preferred embodiment, the length L9 of the linear portion 32 is about 0.025 inches. In some embodiments, the length L9 corresponds to 1/10 or 1/12 of the caliber of the projectile 2. In one embodiment, the length L8 of the first nose portion 66 is between about 0.1 inches and 0.4 inches. In a preferred embodiment, the length L8 of the first nose portion 66 is between about 0.15 inches and about 0.3 inches. In a more preferred embodiment, the length L8 of the first nose portion 66 is about 0.22 inches. In one embodiment, the length L10 of the second nose portion 68 is between about 0.35 inches and 0.95 inches. In a preferred embodiment, the length L10 of the second nose portion 68 is between about 0.55 inches and about 0.75 inches. In a more preferred embodiment, the length L10 of the second nose portion 68 is about 0.65 inches. In some embodiments, the length L10 of the second nose portion 68 is about three times the length L8 of the first nose portion 66. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches.

The projectile 2 also has a boat tail 38 with an angle θ proximate the base 30. The cylindrical portion 30 has angled driving bands 26A and angled relief cuts 28A. In one embodiment, the diameter D2 of the angled relief cut 28A is between about 0.20 inches and about 0.40 inches. In a preferred embodiment, the diameter D2 of the angled relief cut 28A is between about 0.25 inches and about 0.31 inches. In the embodiment shown, the diameter D2 of the angled relief cut 28A is about 0.298 inches. In one embodiment, the diameter D3 of the angled driving band 26A is between about 0.25 inches and about 0.32 inches. In a preferred embodiment, the diameter D3 of the angled driving band 26A is between about 0.30 inches and about 0.31 inches. In the embodiment shown, the diameter D3 of the angled driving band 26A is about 0.307 inches. Detailed views of the angled driving bands 26A and angled relief cuts 28A are shown in FIG. 35E.

Referring to FIGS. 33-36, these projectiles are "smart bullets" because they penetrate armor and slow down in soft tissue. Like other embodiments with a housing 40 and an insert 42, these projectiles 2 have cavities 24 to receive soft tissue to slow the projectile down in soft tissue. These projectiles 2 have a hardened steel tip insert 42. Further, the different angle of the front or first ogive of the first nose portion 66 from the second ogive of the second nose portion 68 means that a minimal amount of surface area is in contact with the wind, making the projectile's BC higher. Thus, there are two ogive angles: a front or first ogive and rear or second ogive.

Figure 33A:
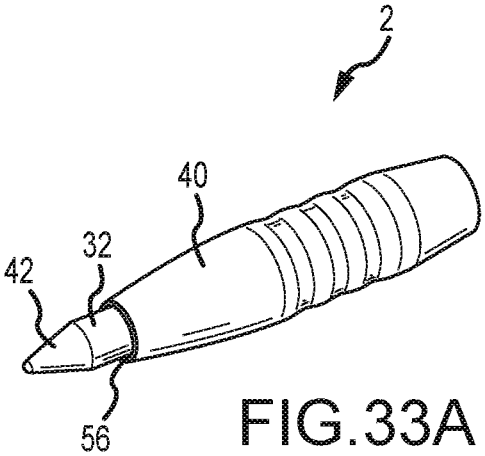
FIGS. 33A-D show a projectile according to a twenty-eighth embodiment of the invention.
Figure 33B:
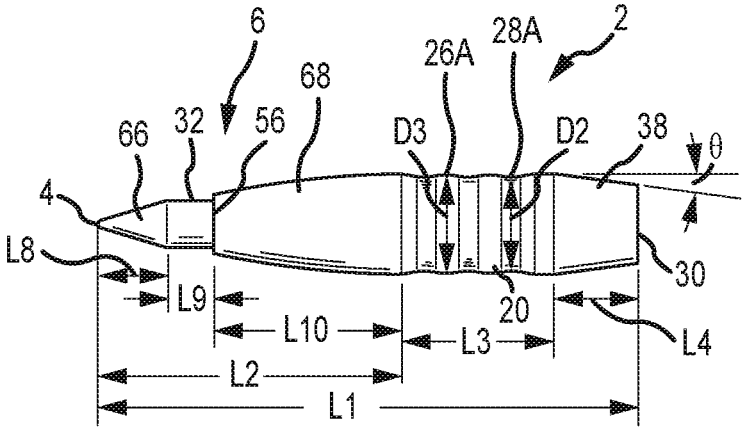
Figure 33C:
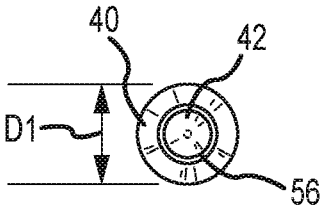
Figure 33D:
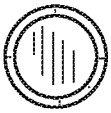
Figure 34A:
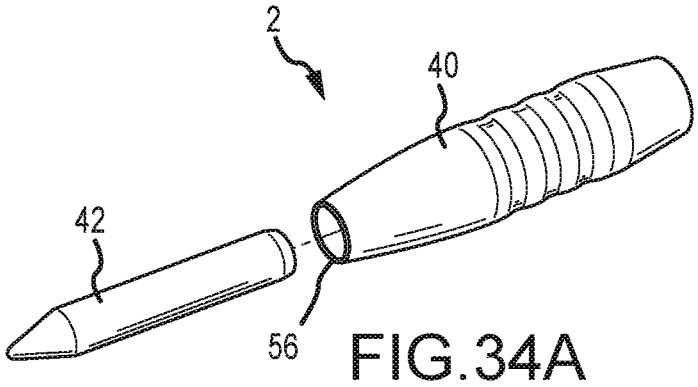
FIGS. 34A-D are exploded views of the projectile housing and insert of FIGS. 33A-C.
Figure 34B:
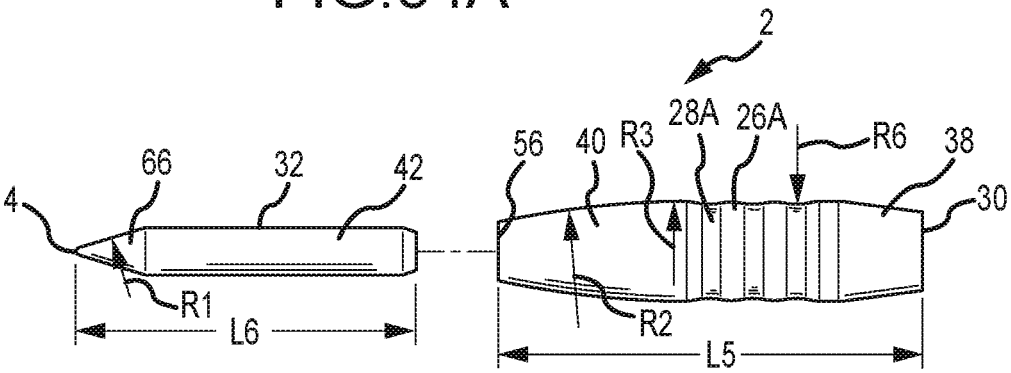
Figure 34C:
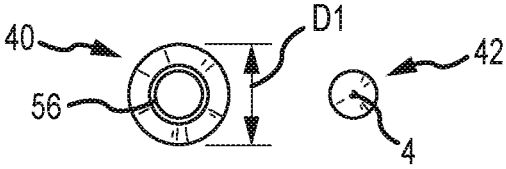
Figure 34D:
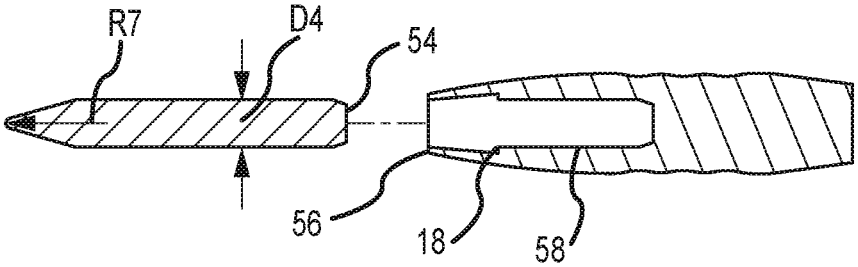

FIGS. 33A-D show a projectile according to a twenty-eighth embodiment of the invention. FIG. 33A is a perspective view of the projectile 2. FIG. 33B is a side elevation view of the projectile 2. FIG. 33C is a top plan view of the projectile 2. FIG. 33D is a bottom plan view of the projectile 2. Note that FIGS. 33A-33D are to scale. FIGS. 34A-D are exploded views of the projectile housing 40 and insert 42 of FIGS. 33A-D. FIG. 34A is a perspective view of the projectile 2. FIG. 34B is a side elevation view of the projectile 2. FIG. 34C is a top plan view of the projectile 2. FIG. 34D is a cross-sectional view. Note that FIGS. 34A-34D are to scale.

The projectile 2 comprises a tip 4 on one end opposite a base 30 on the other end. The projectile includes an insert 42 that fits into a housing 40. The projectile 2 comprises a nose portion 6 and a cylindrical portion 20 (also called a shank). The nose portion 6 includes a first nose portion 66 and a second nose portion 68. A linear portion 32 is positioned between the first nose portion 66 and second nose portion 68. In one embodiment, the projectile 2 has a hardened steel tip 4. The cylindrical portion 20 includes angled driving bands 26A with diameter D3 and angled relief cuts 28A with diameter D2 and radius of curvature R6. See FIG. 35E for detail on the angled driving bands 26A and angled relief cuts 28A. The projectile also has a boat tail 38 at an angle θ.

In one embodiment, the length L1 of the projectile 2 is between about 1.125 inches and about 1.725 inches. In a preferred embodiment, the length L1 of the projectile 2 is between about 1.225 inches and about 1.625 inches. In a more preferred embodiment, the length L1 of the projectile 2 is about 1.425 inches. In one embodiment, the length L2 of the nose portion 6 is between about 0.7 inches and about 1.1 inches. In a preferred embodiment, the length L2 of the nose portion 6 is between about 0.8 inches and about 1.0 inch. In a more preferred embodiment, the length L2 of the nose portion 6 is about 0.899 inches. In one embodiment, the length L3 of the cylindrical portion 20 is between about 0.522 inches and about 0.122 inches. In a preferred embodiment, the length L3 of the cylindrical portion 20 is between about 0.422 inches and about 0.222 inches. In a more preferred embodiment, the length L3 of the cylindrical portion 20 is about 0.322 inches. The diameter D1 of the projectile 2 (also called the caliber) varies according the various embodiments. In one embodiment, the diameter D1 of the projectile 2 is between about 0.108 inches and about 0.508 inches. In a preferred embodiment, the diameter D1 of the projectile 2 is between about 0.208 inches and about 0.408 inches. In the embodiment shown, the diameter D1 of the projectile 2 is about 0.308 inches.

As shown in FIG. 34D, the receiving portion 58 of the housing 40 has a step or shoulder 18. Additionally, the front 56 of the housing 40 is substantially flat and parallel to the base 30.

Figure 35A:
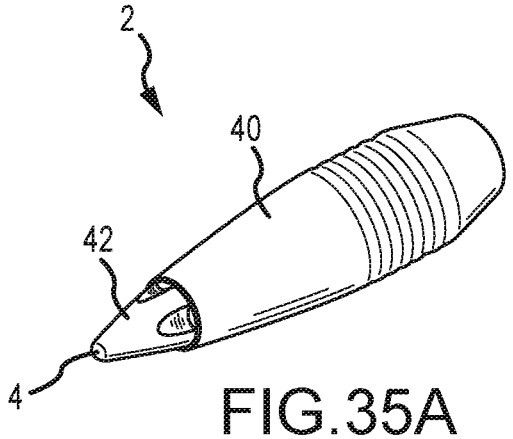
FIGS. 35A-E show a projectile according to a twenty-ninth embodiment of the invention.
Figure 35B:
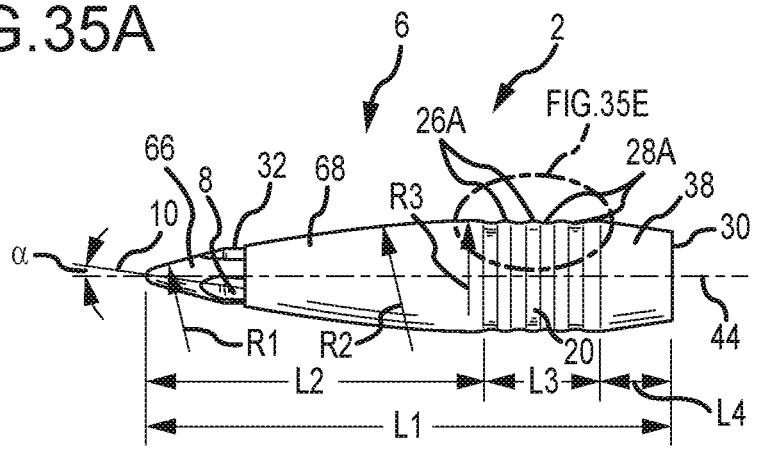
Figure 35C:
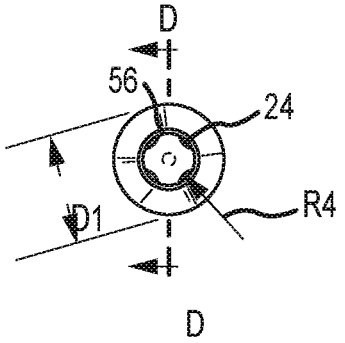
Figure 35D:
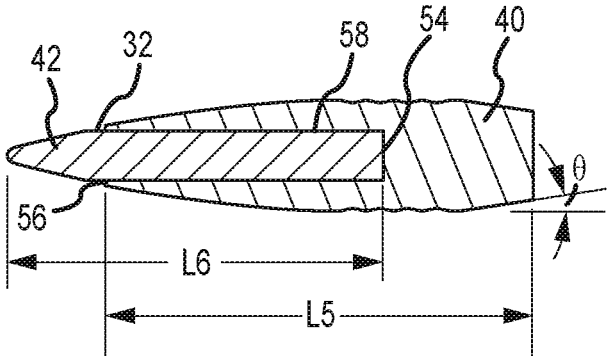
Figure 35E:
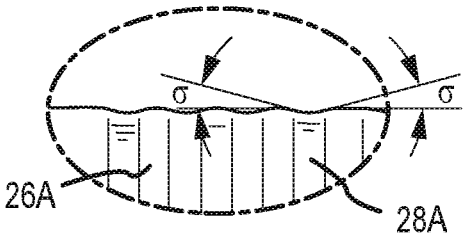

FIGS. 35A-E show a projectile according to a twenty-ninth embodiment of the invention. FIG. 35A is a perspective view of the projectile 2. FIG. 35B is a side elevation view of the projectile 2. FIG. 35C is a top plan view of the projectile 2. FIG. 35D is a cross-sectional view. FIG. 35E is a close-up view. Note that FIGS. 35A-E are to scale. The projectile of FIG. 35 is the same as the projectile of FIG. 24 except that the projectile of FIG. 35 has one insert 42 and the projectile of FIG. 24 has three inserts. This projectile 2 is also similar to the projectile 2 of FIGS. 33A-34D, but the linear portion 32 is shorter in FIGS. 35A-E. Additionally, the projectile 2 of FIGS. 35A-E has depressions 8 on the insert 42. The depressions 8 create a high-pressure area in the depressions 8 to move air around the depression 8 and not into the cavity 24 when traveling through air or in hard media.

The longitudinal axis 44 of the projectile 2 is shown in FIG. 35B. The angle $\alpha$ of the nose depressions 8 can be measured from the centerline 10 of the nose depressions 8 relative to the longitudinal axis 44. In some embodiments, the angle $\alpha$ is measured relative to the original ogive of the projectile nose portion 6. In some embodiments, all nose depressions 8 have the same angle $\alpha$. In other embodiments, each nose depression 8 has a different angle $\alpha$. In still other embodiments, some nose depressions 8 have the same angle $\alpha$ while other nose depressions 8 have different angles $\alpha$. In the embodiment shown, the nose depressions 8 are right-hand nose depressions 8 because the angle $\alpha$ is positioned to the right of the longitudinal axis 44. Further, when looking at the projectile from a top plan view (FIG. 35C), the nose depressions 8 appear to turn in a counter-clockwise direction. In one embodiment, the projectile 2 has at least four nose depressions 8. However, the projectile 2 can have more or fewer nose depressions 8. The depressions 8 create cavities 24 between the insert 42 and the housing 40 such that when the projectile 2 hits a soft medium target, the cavities 24 fill with the soft medium and the projectile 2 slows down. The steeper (i.e., greater) alpha angle will also transfer media at a greater rate into the housing for a faster opening and expansion of the housing 40 upon impact with the terminal media.

The nose portion 6 comprises a first nose portion 66 with a radius of curvature R1 and a second nose portion 66 with a radius of curvature R2. The projectile 2 also has a boat tail 38 with an angle $\theta$.

In one embodiment, the length L1 of the projectile 2 is between about 1.0 inch and about 2.0 inches. In a preferred embodiment, the length L1 of the projectile 2 is between about 1.3 inches and about 1.6 inches. In a more preferred embodiment, the length L1 of the projectile 2 is about 1.405 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the length of the first nose portion 66 extending from the tip 4 to the linear portion 32 is between about 0.10 inches and about 0.30 inches. In a preferred embodiment, the length of the first nose portion 66 extending from the tip 4 to the linear portion 32 is between about 0.14 inches and about 0.20 inches. In a more preferred embodiment, the length of the first nose portion 66 extending from the tip 4 to the linear portion 32 is about 0.17 inches. In one embodiment, the length L5 of the housing 40 is between about 1.0 inch and about 1.3 inches. In a preferred embodiment, the length L5 of the housing 40 is about 1.145 inches. In one embodiment, the length L6 of the insert 42 is between about 1.0 inch and about 1.3 inches. In a preferred embodiment, the length L6 of the insert 42 is about 1.175 inches. In one embodiment, the length of the linear portion 32 is between about 0.10 and 0.15 inches. In one embodiment, the length of the second nose portion 68 extending from the front 56 of the housing 40 to the cylindrical portion 20 is between about 0.55 and about 0.70 inches. In a preferred embodiment, the length of the second nose portion 68 extending from the front 56 of the housing 40 to the cylindrical portion 20 is about 0.62 inches.

In one embodiment, the length L4 of the boat tail 38 is between about 0.10 inches and about 0.40 inches. In a preferred embodiment, the length L4 of the boat tail 38 is between about 0.15 inches and about 0.35 inches. In a more preferred embodiment, the length L4 of the boat tail 38 is about 0.23 inches. In another more preferred embodiment, the length L4 of the boat tail 38 is about 0.30 inches.

In one embodiment, the radius of curvature R2 of the tangent ogive is between about 2.0 inches and about 5.0 inches. In a preferred embodiment, the radius of curvature R2 of the tangent ogive is between about 3.0 inches and about 4.0 inches. In a more preferred embodiment, the radius of curvature R2 of the tangent ogive is about 3.5 inches. In one embodiment, the radius of curvature R3 of the secant ogive is between about 0.5 inches and about 1.5 inches. In a preferred embodiment, the radius of curvature R3 of the secant ogive is between about 0.75 inches and about 1.25 inches. In a more preferred embodiment, the radius of curvature R3 of the secant ogive is about 1.00 inch. In one embodiment, the angle $\theta$ of the boat tail 38 is between about 5 degrees and about 10 degrees. In a preferred embodiment, the angle $\theta$ of the boat tail 38 is between about 6.5 degrees and about 8.0 degrees. In a more preferred embodiment, the angle $\theta$ of the boat tail 38 is about 7.5 degrees.

The cylindrical portion 20 comprises angled driving bands 26A and angled relief cuts 28A. In one embodiment, the angled driving bands 26A and angled relief cuts 28A are positioned at an angle $\sigma$ relative to a horizontal line or the longitudinal axis 44 between about 5 degrees and about 10 degrees. In a preferred embodiment, the angled driving bands 26A and angled relief cuts 28A are positioned at an angle $\sigma$ relative to a horizontal line or the longitudinal axis 44 between about 6 degrees and about 9 degrees. In a more preferred embodiment, the angled driving bands 26A and angled relief cuts 28A are positioned at an angle $\sigma$ relative to a horizontal line or the longitudinal axis 44 about 7.5 degrees. In another preferred embodiment, the angled driving bands 26A and angled relief cuts 28A are positioned at an angle $\sigma$ relative to a horizontal line or the longitudinal axis 44 about 8.5 degrees. In alternate embodiments, the driving bands 26A vary in number, comprising one driving band 26A, a plurality of driving bands 26A, two driving bands 26A, three driving bands 26A, and four or more driving bands 26A. The angled driving bands 26A and angled relief cuts 28A create air disturbances that stabilize the projectile 2 in flight allowing the projectile 2 to fly straighter and be less affected by cross winds than projectiles of the prior art.

Figure 36A:
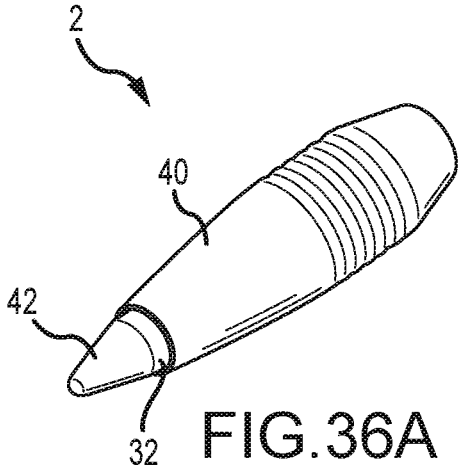
FIGS. 36A-D show a projectile according to a thirtieth embodiment of the invention.
Figure 36B:
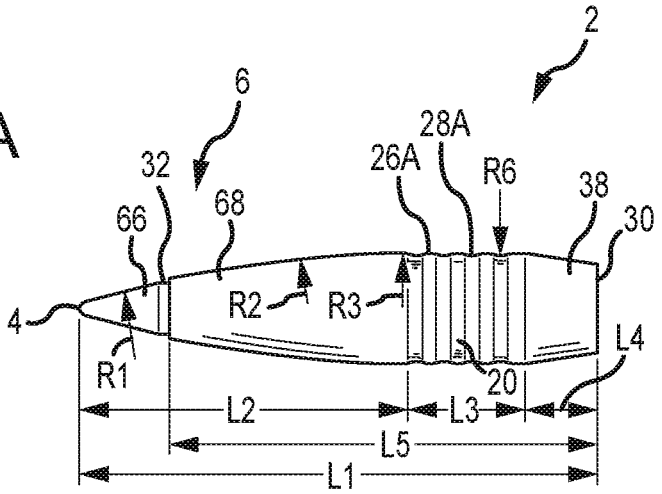
Figure 36C:
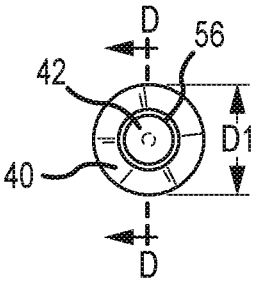
Figure 36D:
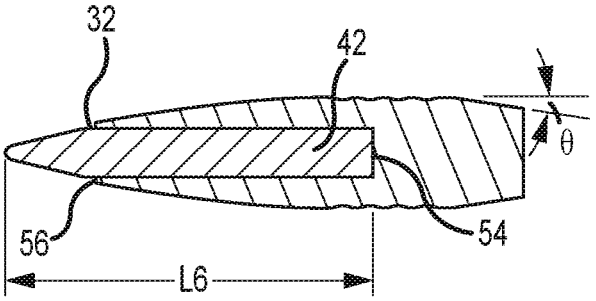

FIGS. 36A-D show a projectile according to a thirtieth embodiment of the invention. FIG. 36A is a perspective view of the projectile 2. FIG. 36B is a side elevation view of the projectile 2. FIG. 36C is a top plan view of the projectile 2. FIG. 36D is a cross-sectional view of the projectile 2. Note that FIGS. 36A-D are to scale.

The projectile 2 comprises a tip 4 on one end opposite a base 30 on the other end. The projectile 2 comprises a nose portion 6 interconnected to a cylindrical portion 20 interconnected to a boat tail 38. The nose portion 6 includes a first nose portion 66, a second nose portion 68, and a linear portion 32 positioned between the first nose portion 66 and the second nose portion 68. The cylindrical portion 20 includes angled driving bands 26A and angled relief cuts 28A. In one embodiment, the length L1 of the projectile 2 is between about 1.0 inch and about 2.0 inches. In a preferred embodiment, the length L1 of the projectile 2 is between about 1.3 inches and about 1.6 inches. In a more preferred embodiment, the length L1 of the projectile 2 is about 1.405 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches. In one embodiment, the length of the first nose portion 66 is between 0.10 inches and about 0.30 inches, or preferably 0.23 inches. In one embodiment, the length of the housing is between about 1.0 inch and about 1.3 inches. In a preferred embodiment, the length of the housing is about 1.145 inches. In one embodiment, the length of the linear portion 32 is between about 0.04 and 0.06 inches. In one embodiment, the length of the second nose portion 68 is between about 0.55 and about 0.70 inches.

The projectiles of FIGS. 37A-38E are designed for high-speed silent flight.

Figure 37A:
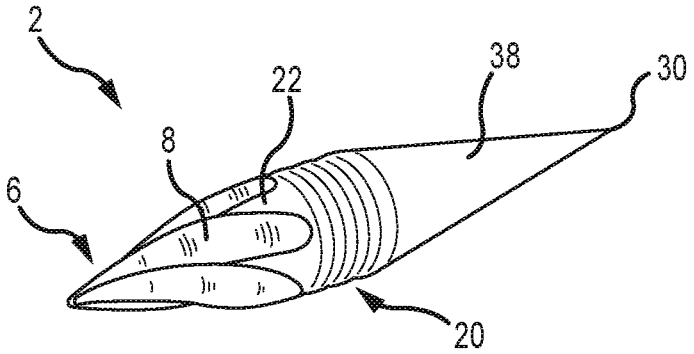
FIGS. 37A-D show a projectile according to a thirty-first embodiment of the invention.
Figure 37B:
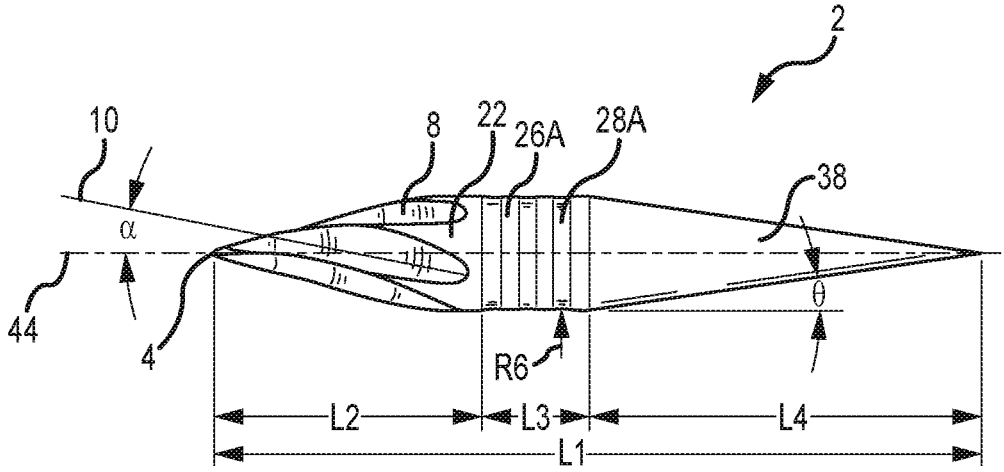
Figure 37C:
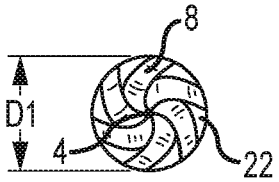
Figure 37D:
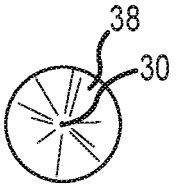

FIGS. 37A-D show a projectile according to a thirty-first embodiment of the invention. FIG. 37A is a perspective view of the projectile 2. FIG. 37B is a side elevation view of the projectile 2. FIG. 37C is a top plan view of the projectile 2. FIG. 37D is a bottom plan view of the projectile 2. Note that FIGS. 37A-D are to scale.

The projectile 2 comprises a tip 4 on one end opposite a base 30 on the other end. The projectile 2 comprises a nose portion 6 interconnected to a cylindrical portion 20 (also called a shank) interconnected to a boat tail 38 with an angle θ. The nose portion 6 includes nose depressions 8 (also called cutouts or troughs) and nose remaining portions 22 between the nose depressions 8, where each nose remaining portion 22 is positioned between two nose depressions 8. The remaining portions 22 are the uncut portions having the projectile's original ogive. The nose depressions 8 have a curved shape meaning that the trough or bottom of the nose depression 8 is curved and has a radius of curvature R4.

The longitudinal axis 44 of the projectile 2 is shown in FIG. 37B. The angle α of the nose depressions 8 can be measured from the centerline 10 of the nose depressions 8 relative to the longitudinal axis 44. In some embodiments, the angle α is measured relative to the original ogive of the projectile nose portion 6. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. Further, when looking at the projectile 2 from a top plan view (FIG. 37C), the nose depressions 8 appear to turn in a counter-clockwise direction. In one embodiment, the projectile 2 has at least six nose depressions 8. However, the projectile 2 can have more or fewer nose depressions 8.

In one embodiment, the length L1 of the projectile 2 is between about 1.0 inch and about 3.0 inches. In a preferred embodiment, the length L1 of the projectile 2 is between about 1.5 inches and about 2.5 inches. In a more preferred embodiment, the length L1 of the projectile 2 is about 1.96 inches. In one embodiment, the length L2 of the nose portion 6 is between about 1.00 inch and about 0.600 inches. In a preferred embodiment, the length L2 of the nose portion 6 is between about 0.900 inches and about 0.700 inches. In a more preferred embodiment, the length L2 of the nose portion 6 is about 0.800 inches. In one embodiment, the length L3 of the cylindrical portion 20 is between about 0.550 inches and about 0.150 inches. In a preferred embodiment, the length L3 of the cylindrical portion 20 is between about 0.450 inches and about 0.250 inches. In a more preferred embodiment, the length L3 of the cylindrical portion 20 is about 0.350 inches. In one embodiment, the length L4 of the boat tail 38 is between about 1.0 inch and about 1.4 inches. In a more preferred embodiment, the length L4 is about 1.2 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches.

Figure 38A:
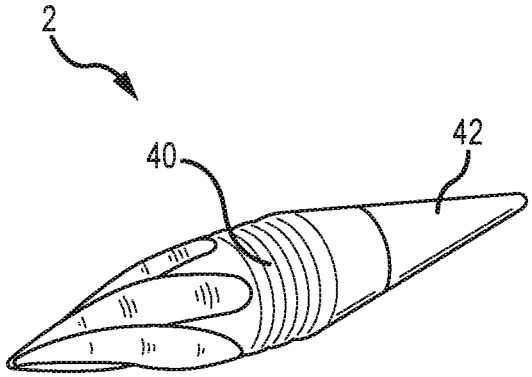
FIGS. 38A-E show a projectile according to a thirty-second embodiment of the invention.
Figure 38B:
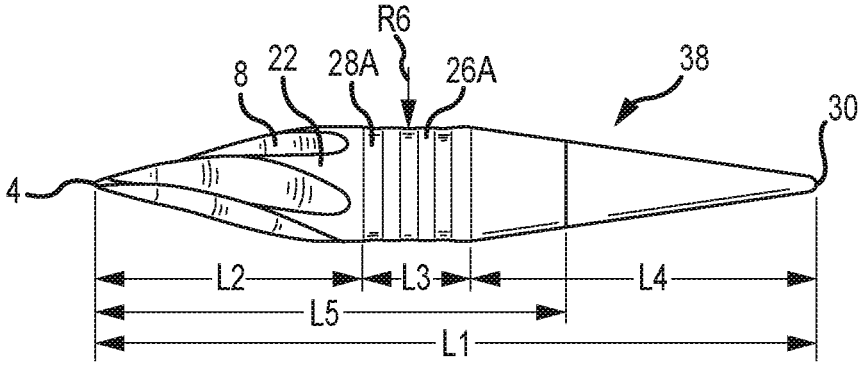
Figure 38C:
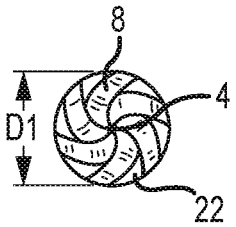
Figure 38D:
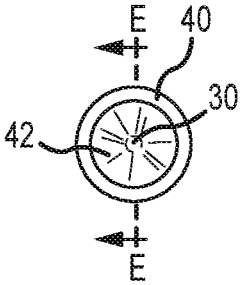
Figure 38E:
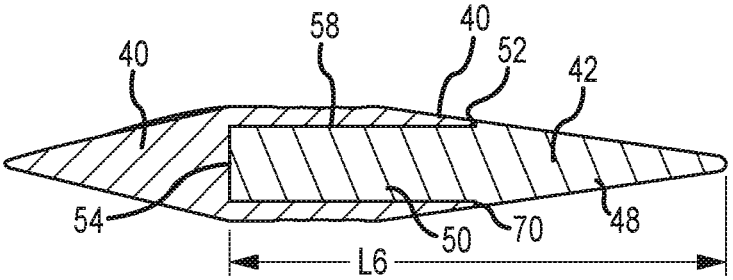

FIGS. 38A-E show a projectile according to a thirty-second embodiment of the invention. FIG. 38A is a perspective view of the projectile 2. FIG. 38B is a side elevation view of the projectile 2. FIG. 38C is a top plan view of the projectile 2. FIG. 38D is a bottom plan view. FIG. 38E is a cross-sectional view. Note that FIGS. 38A-E are to scale. The projectile 2 comprises a housing 40 and an insert 42. The projectile 2 comprises a tip 4 on one end opposite a base 30 on the other end. The projectile 2 comprises a nose portion 6 interconnected to a cylindrical portion 20 interconnected to a boat tail 38. The nose portion 6 includes nose depressions 8 and nose remaining portions 22 between the nose depressions 8, where each nose remaining portion 22 is positioned between two nose depressions 8. The remaining portions 22 are the uncut portions having the projectile's original ogive.

The nose depressions 8 are right-hand depressions 8 because when looking at the projectile from a top plan view (FIG. 38C), the nose depressions 8 appear to turn in a clockwise direction. In one embodiment, the projectile 2 has at least six nose depressions 8. However, the projectile 2 can have more or fewer nose depressions 8.

In one embodiment, the length L1 of the projectile 2 is between about 1.0 inch and about 2.0 inches. In a preferred embodiment, the length L1 of the projectile 2 is between about 1.5 inches and about 2.5 inches. In a more preferred embodiment, the length L1 of the projectile 2 is about 1.88 inches. In one embodiment, the length L5 of the housing is between about 1.0 inch and about 1.4 inches. In a preferred embodiment, the length L5 of the housing 40 is about 1.2 inches. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In the embodiment shown, the diameter D1 of the projectile 2 is about 0.308 inches.

Figure 39A:
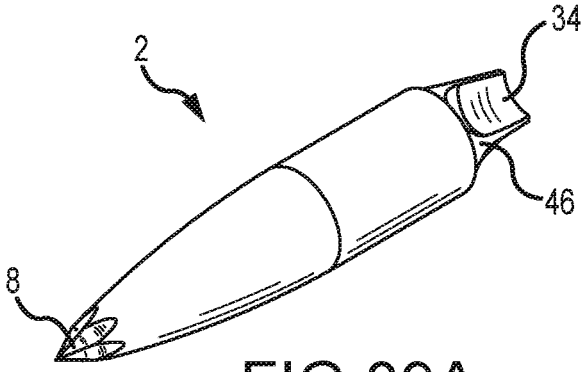
FIGS. 39A-C show a projectile according to a thirty-third embodiment of the invention.
Figure 39B:
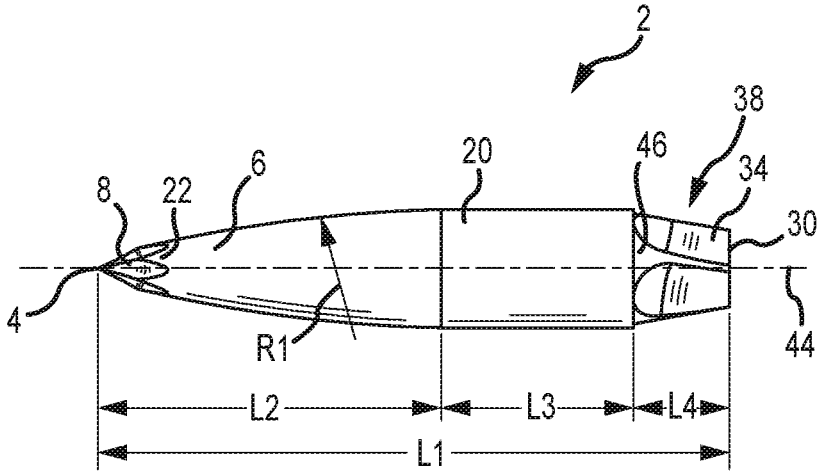
Figure 39C:
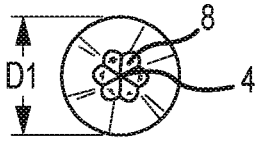

FIGS. 39A-C show a projectile according to a thirty-third embodiment of the invention. FIG. 39A is a perspective view of the projectile 2. FIG. 39B is a side elevation view of the projectile 2. FIG. 39C is a top plan view of the projectile 2. Note that FIGS. 39A-C are to scale.

The projectile 2 comprises a tip 4 on one end opposite a base 30 on the other end. The projectile 2 comprises a nose portion 6 interconnected to a cylindrical portion 20 interconnected to a boat tail 38. The nose portion 6 includes nose depressions 8 (also called cutouts or troughs) and nose remaining portions 22 between the nose depressions 8, where each nose remaining portion 22 is positioned between two nose depressions 8. The remaining portions 22 are the uncut portions having the projectile's original ogive.

The nose depressions 8 have a curved shape meaning that the trough or bottom of the nose depression 8 is curved and has a radius of curvature R4. In one embodiment, the projectile 2 further comprises a tungsten or Inconel insert.

The longitudinal axis 44 of the projectile 2 is shown in FIG. 39B. In one embodiment, the projectile 2 has at least six nose depressions 8. However, the projectile 2 can have more or fewer nose depressions 8.

The diameter D1 of the projectile 2 (also called the caliber) varies according the various embodiments. In one embodiment, the diameter D1 of the projectile 2 is between about 0.508 inches and about 0.108 inches. In a preferred embodiment, the diameter D1 of the projectile 2 is between about 0.408 inches and about 0.208 inches. In the embodiment shown, the diameter D1 of the projectile 2 is about 0.308 inches.

The intended users of the projectile 2 are African big game hunters. The attributes of this projectile 2 are deep straight penetration with transfer of energy. The projectile 2 is comprised of brass, copper, bronze, tungsten-carbide, alloys of these metals, or any material known in the art, including plastics and ceramics. In some embodiments, this projectile 2 will be two pieces and will have a tungsten or Inconel insert. This projectile 2 is armor penetrating. This projectile 2 is designed to go and never quit. Further, the tip 4 is designed to relieve material as it penetrates its target.

Figure 40A:
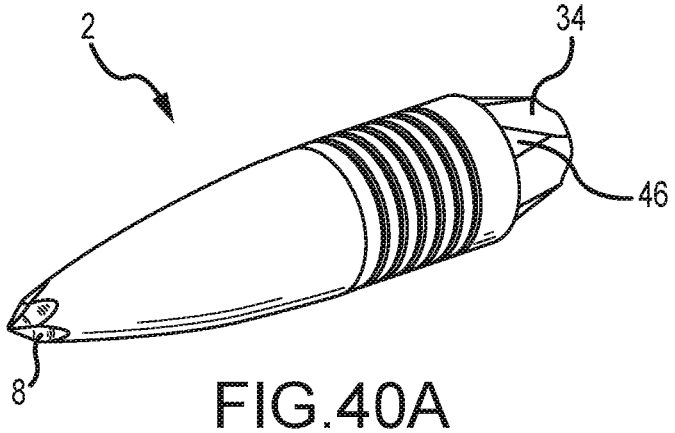
FIGS. 40A-C show a projectile according to a thirty-fourth embodiment of the invention.
Figure 40B:
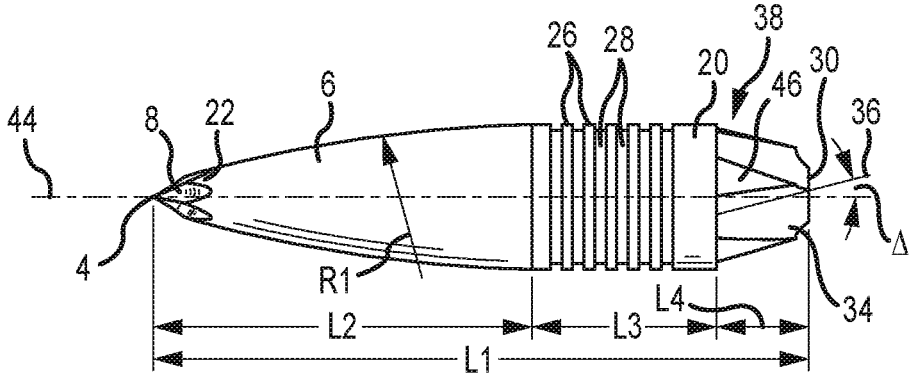
Figure 40C:
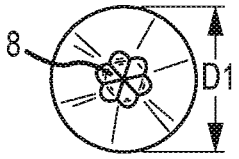

FIGS. 40A-C show a projectile according to a thirty-fourth embodiment of the invention. FIG. 40A is a perspective view of the projectile 2. FIG. 40B is a side elevation view of the projectile 2. FIG. 40C is a top plan view of the projectile 2. Note that FIGS. 40A-C are to scale. Some embodiments may also have angled driving bands and angled relief bands.

The projectile 2 comprises a tip 4 on one end opposite a base 30 on the other end. The projectile 2 comprises a nose portion 6 interconnected to a cylindrical portion 20 interconnected to a boat tail 38. The nose portion 6 includes nose depressions 8 (also called cutouts or troughs) and nose remaining portions 22 between the nose depressions 8, where each nose remaining portion 22 is positioned between two nose depressions 8. The remaining portions 22 are the uncut portions having the projectile's original ogive.

The longitudinal axis 44 of the projectile 2 is shown in FIG. 40B. In one embodiment, the projectile 2 has at least six nose depressions 8. However, the projectile 2 can have more or fewer nose depressions 8.

The diameter D1 of the projectile 2 (also called the caliber) varies according the various embodiments. In one embodiment, the diameter D1 of the projectile 2 is between about 0.138 inches and about 0.538 inches. In a preferred embodiment, the diameter D1 of the projectile 2 is between about 0.238 inches and about 0.438 inches. In the embodiment shown, the diameter D1 of the projectile 2 is about 0.338 inches.

The intended users of the projectile are African big game hunters. The attributes of this projectile are deep straight penetration with transfer of energy. The projectile is comprised of brass, copper, bronze, tungsten-carbide, alloys of these metals, or any material known in the art, including plastics and ceramics.

Figure 41A:
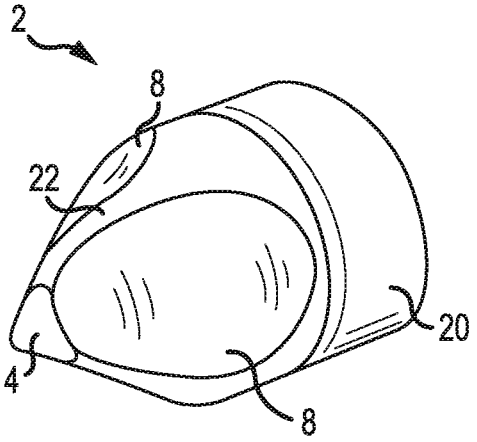
FIGS. 41A-D show a projectile according to a thirty-fifth embodiment of the invention.
Figure 41E:
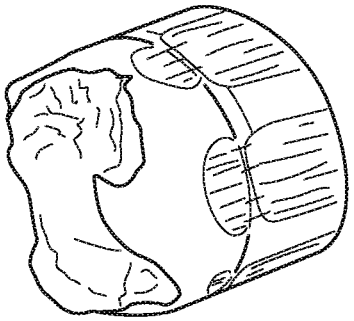
FIG. 41E shows the projectile of FIGS. 41A-D after it has been shot.
Figure 41B:
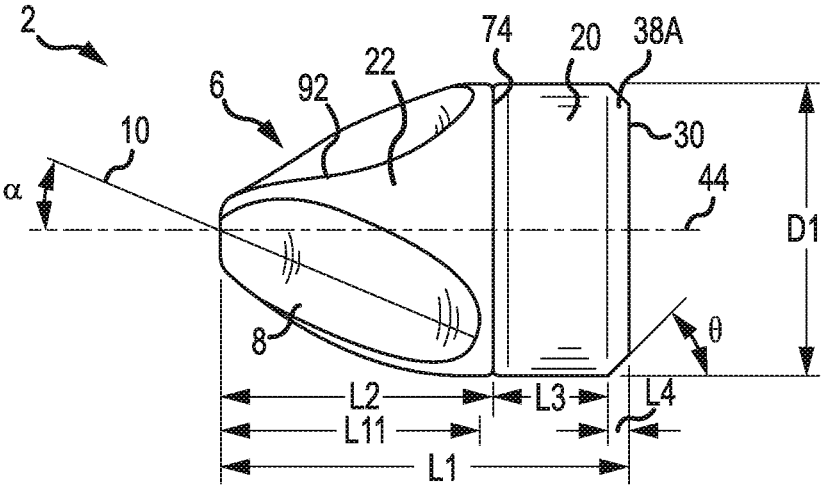
Figure 41C:
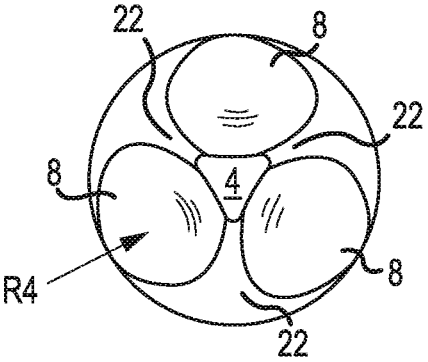
Figure 41D:
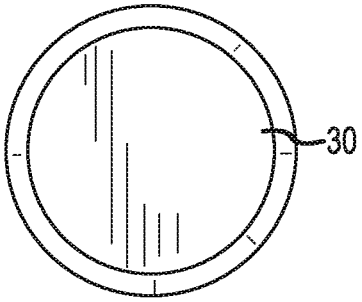

FIGS. 41A-D show a projectile according to a thirty-fifth embodiment of the invention. FIG. 41A is a perspective view of the projectile 2. FIG. 41B is a side elevation view of the projectile 2. FIG. 41C is a top plan view of the projectile 2. FIG. 41D is a bottom plan view of the projectile 2. Note that FIGS. 41A-D are to scale.

FIGS. 41A-D show a pistol projectile that, among other things, provides deep straight penetration. This pistol projectile 2 is homogenous in nature and is intended for straight flight and tissue damage to a soft material target. The projectile 2 comprises a tip 4 on one end opposite a base 30 on the other end. The projectile 2 comprises a nose portion 6, a cylindrical portion 20, and a chamfer 38A. The nose portion 6 includes nose depressions 8 and a nose remaining portion 22 between two nose depressions 8. The remaining portions 22 are the uncut portions having the projectile's original ogive.

In one embodiment, the pistol projectile 2 is comprised of brass. The brass projectile may pierce armor, including Kevlar; therefore, the brass embodiment is intended for government use (e.g., police and military). Other embodiments are comprised of soft copper, which is intended for civilian use because it cannot piece armor, including Kevlar. Due to the direct interface with the barrel, a soft metal can be used. In both embodiments, the projectile stops in soft tissue and creates a lot of cavitation in soft tissue, thus making a wound larger than it would be with a projectile of the prior art. The projectile 2 has twisting troughs or depressions 8 that move media away from the projectile 2 further reducing resistance and maintaining the spin to ensure the projectile 2 penetrates deep and straight. The troughs 8 rapidly move liquids and soft tissue away from the path of the projectile 2 and, therefore, increase the wound channel. Additionally, the troughs 8 project target material away from the projectile at a 90-degree angle relative to the longitudinal axis 44 (compare to FIGS. 21A-23F where the target material is projected away at a 45-degree angle relative to the longitudinal axis 44). This is an unexpected result and permits the projectile to shoot through drywall and continue flying straight and then hit the target and cause maximum damage in the soft tissue of the target. The cavity in a typical hollow-point bullet would fill with drywall and then the bullet would act like a non-hollow-point bullet upon impact rather than a hollow-point bullet upon impact. Thus, this projectile can be shot through drywall, then hit its target, and still perform as desired upon impact.

The unique shape of the front of the projectile 2 includes angled or slightly twisting depressions 8 pointed to the front of the projectile 2. The depressions 8 form troughs, edges 92, and remaining portions 22 between the depressions 8. The depressions 8 possess an angle α or a slight radius off the longitudinal axis 44 of the projectile 2. In some embodiments, the twist angle α of the depressions 8 corresponds to (i.e., is equal to) or is greater than the barrel twist rate (i.e., the twist rate of the rifling in the barrel) and turns in the same direction as the barrel's rifling. In other embodiments, the twist angle α of the depressions 8 is equal to or greater than the barrel twist rate and turns in the opposite direction as the barrel's rifling. If the twist a (angle from centerline 44) of the trough 8 is in the same direction of the rifling, it will increase the penetration in tissue. This angle α is to be equal to or greater than the angle of the rifling. These depressions 8 do not affect the projectile during internal ballistics but they greatly enhance the performance during external and/or terminal ballistics. In some embodiments, the angle α of the depressions 8 vary relative to the longitudinal axis 44. For example, the angle α of the portion of the depression 8 proximate the tip 4 may not be same as the barrel's riffling, but the angle α of the depression 8 proximate the cylindrical portion 20 may be the same or greater than the barrel's riffling angle. Additionally, the angle of the remaining portions 22 may vary along the length of the projectile 2. For example, the remaining portions 22 may be substantially parallel to the longitudinal axis 44 proximate the tip 4 and may be at an angle relative to the longitudinal axis 44 proximate the cylindrical portion 20.

The construction of this projectile 2 may be accomplished using a press or mill and lathe. In one embodiment, the pistol projectile 2 is manufactured via a Swiss Turn machine or the combination of a lathe and mill. Alternatively, the pistol projectile 2 is manufactured via a powdered or gilding metal that is then pressed into a die at great pressure. If the depressions 8 of the projectile 2 are cut using a ball end mill, then the ball end mill cuts into the nose 6 at an angle substantially parallel to the longitudinal axis 44 of the projectile 2 and then stops at the end of the cut. This is different than the projectiles of FIGS. 21A-23F where the ball end mill cuts the depressions at an angle relative to the longitudinal axis and the ball end mill pulls out and away from the projectile such that the depressions are deeper proximate the nose than proximate the cylindrical portion (i.e., the bottom of the depression is closer to the longitudinal axis proximate the nose than proximate the cylindrical portion).

Unlike FIGS. 21A-23F, the nose 6 of this projectile 2 has a blunt end 4. The flat tip 4 may be parallel to the flat base 30 of the projectile. In alternative embodiments, the tip 4 may be curved or rounded instead of flat. In other embodiments, the tip 4 is pointed rather than flat. Thus, this projectile does not have a cutting surface or cutting edges (72 in other figures) where the ridges or depressions 8 meet. Therefore, many embodiments of this projectile 2 cannot pierce armor. Additionally, depending on the angle of the shot and thickness of the barrier material, the projectile may not continue flying straight through hard materials like glass and steel. However, the brass versions of this projectile 2 may piece armor and may continue flying straight through hard materials like glass and steel. If the copper projectile 2 is shot through thin steel, then the projectile will continue flying straight after exiting the steel, which is an unexpected result. It is believed that the copper projectile will continue through thin steel because the pressure per square inch at the tip is high. Further, the remaining portions 22 between the depressions 8 extend all the way to the blunt tip 4 and have a thickness. In one embodiment, the thickness of the remaining portion 22 proximate the tip is between about 0.01 inches and about 0.05 inches. In a preferred embodiment, the thickness of the remaining portion proximate the tip is about 0.03 inches. In another preferred embodiment, the thickness of the remaining portion proximate the tip is about 0.015 inches. It is an unexpected result that the projectile 2 does not cut through armor and it is believed that it will not cut armor due to the shape and thickness of the remaining portions 22. Thus, the remaining portions 22 absorb shock upon impact rather than cut through armor.

In one embodiment, the surface area of the tip 4 is between about 0.001 $in^2$ and about 0.006 $in^2$. In a preferred embodiment, the surface area of the tip 4 is between about 0.002 $in^2$ and about 0.004 $in^2$. In some embodiments, the surface area of the tip 4 is between about 1.0% and about 6.0% of the surface area of the base 30. In a preferred embodiment, the surface area of the tip 4 is between about 3.0% and about 5.0% of the surface area of the base 30. In some embodiments, the surface area of the tip 4 is between about 1.0% and about 5.0% of the surface area of a cross-section taken through the cylindrical portion 20 (i.e., the surface area of a circle having the diameter D1). In a preferred embodiment, the surface area of the tip 4 is between about 2.0% and about 4.0% of the surface area of a cross-section taken through the cylindrical portion 20. In some embodiments, the tip 4 has a triangular shape (see FIG. 41C) with rounded corners. The tip 4 can have other shapes in other embodiments, e.g., a circular shape, a square shape, a rectangular shape, etc. If the projectile 2 has more than three depressions 8, then the shape of the tip 4 will differ. In one embodiment, the height or width of the tip 4 (i.e., height or width as shown in FIG. 41C and measured from corner to corner or top to bottom and measured like D1 in FIG. 41B) is between about 0.03 inches and about 0.15 inches. In a preferred embodiment, the height or width of the tip 4 is between about 0.05 inches and about 0.10 inches. In a preferred embodiment, the height or width of the tip 4 is between about 0.065 inches and about 0.085 inches.

The intersection between the remaining portion 22 and depression 8 forms an edge 92. The edge 92 can be a sharp edge with a sharp corner or the edge can be a rounded curved edge 92. The nose depressions 8 have a curved shape meaning that the trough or bottom of the nose depression 8 is curved and has a radius of curvature R4. In some embodiments, the nose depressions 8 have a constant radius of curvature R4 throughout the entire depression 8. In other embodiments, the radius of curvature R4 varies throughout the depression 8. In one embodiment, the nose depressions of the 9 mm caliber projectile 2 are cut using a 3/16 inch ball end mill. Additionally, the radius of curvature R4 of the nose depressions 8 is between about 0.05 inches and about 0.40 inches. In a preferred embodiment, the radius of curvature R4 of the nose depressions 8 is between about 0.0625 inches and about 0.375 inches. In a preferred embodiment, the radius of curvature R4 of the nose depressions 8 is between about 0.07 inches and about 0.13 inches. In a more preferred embodiment, the radius of curvature R4 of the nose depressions 8 is about 0.09375 inches. In other embodiments, other sized ball end mills are used to cut the nose depressions 8, which means that the radius of curvature R4 of the nose depressions 8 will change with the various ball end mill size. For example, a 1/8 inch, 3/16 inch, 1/4 inch, 5/16 inch, 3/8 inch, 1/2 inch, 5/8 inch, or 3/4 inch ball end mill, or any similarly dimensioned metric unit ball end mill, can be used to cut the nose depressions 8 in projectiles 2 according to embodiments of the present invention. Further, larger or smaller ball end mills can be used for larger or smaller caliber projectiles, which means that the radius of curvature R4 of the nose depressions 8 can vary as the caliber of the projectile varies. The nose depressions 8 extend a length L11 from a rear portion of the nose 6 (i.e., just in front of the front of the cylindrical portion 20) to the tip 4 of the projectile 2. In one embodiment, the length L11 of the nose depressions 8 is between about 0.15 inches and about 0.50 inches. In a preferred embodiment, the length L11 of the nose depressions 8 is between about 0.25 inches and about 0.35 inches. In a more preferred embodiment, the length L11 of the nose depressions 8 is about 0.32 inches.

The longitudinal axis 44 of the projectile 2 is shown in FIG. 41B. Accordingly, the angle α of the nose depressions 8 can be measured relative to the longitudinal axis 44.

In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. In one embodiment, the projectile 2 has at least three nose depressions 8. However, the projectile 2 can have more or fewer nose depressions 8. In one embodiment, the angle α of the nose depressions 8 is between about 0 degrees and about 35 degrees. In a preferred embodiment, the angle α of the nose depressions 8 is between about 5 degrees and about 15 degrees. In a more preferred embodiment, the angle α of the nose depressions 8 is about 8 degrees.

The diameter D1 of the projectile 2 varies according the various embodiments. In one embodiment, the diameter D1 of the projectile 2 is between about 0.200 inches and about 0.500 inches. In a preferred embodiment, the diameter D1 of the projectile 2 is between about 0.300 inches and about 0.450 inches. In the embodiment shown, the diameter D1 of the projectile 2 is about 0.355 inches (about 9 mm). In another preferred embodiment, the diameter D1 of the projectile 2 is about 0.400 inches. If the diameter D1 of the projectile is about 0.400 inches, then the other measurements (e.g., L2, L3, L4, L11, etc.) scale accordingly, except for length L1, which may not scale depending on barrel, chamber, and gun powder constraints. In yet another preferred embodiment, the diameter D1 of the projectile 2 is about 0.450 inches. If the diameter D1 of the projectile is about 0.450 inches, then the other measurements (e.g., L2, L3, L4, L11, etc.) scale accordingly, except for length L1, which may not scale depending on barrel, chamber, and gun powder constraints.

In one embodiment, the length L1 of the projectile 2 is between about 0.40 inches and about 0.65 inches. In a preferred embodiment, the length L1 of the projectile 2 is between about 0.50 inches and about 0.55 inches. In a more preferred embodiment, the length L1 of the projectile 2 is about 0.517 inches. In one embodiment, the length L2 of the nose portion 6 is between about 0.20 inches and about 0.45 inches. In a preferred embodiment, the length L2 of the nose portion 6 is between about 0.30 inches and about 0.40 inches. In a more preferred embodiment, the length L2 of the nose portion 6 is about 0.34 inches. In one embodiment, the length L3 of the cylindrical portion 20 is between about 0.10 inches and about 0.25 inches. In a preferred embodiment, the length L3 of the cylindrical portion 20 is between about 0.13 inches and about 0.20 inches. In a more preferred embodiment, the length L3 of the cylindrical portion 20 is about 0.155 inches. In one embodiment, the length L4 of the chamfer 38A is between about 0.01 inches and about 0.035 inches. In a preferred embodiment, the length L4 of the chamfer 38A is between about 0.02 inches and about 0.025 inches. In a more preferred embodiment, the length L4 of the chamfer 38A is about 0.022 inches. In one embodiment, the angle θ of the chamfer 38A is between about 5 degrees and about 45 degrees. In a preferred embodiment, the angle θ of the chamfer 38A is between about 10 degrees and about 25 degrees. In a more preferred embodiment, the angle θ of chamfer 38A is about 15 degrees.

In some embodiments, the projectile 2 includes a cannelure 74. The cannelure 74 is a groove around the circumference of the projectile 2 and is used for crimping, lubrication, waterproofing, and identification. In one embodiment, the cannelure 74 is the point at which the forward-most portion of the casing interconnects to the projectile 2. The forward-most portion of the casing is crimped to the projectile 2 at the cannelure 74 and the cannelure 74 provides a place for the casing to grip the projectile 2. The projectile 2 can include additional cannelures 74 in additional embodiments. Any embodiment described or shown herein (including the embodiments shown and described in FIGS. 1A-50E) can include one or more cannelures.

FIG. 41E shows the projectile after it has been shot and hits its target. The nose 6 of the projectile 2 folds and deforms to cause further damage to the target material. Ideally, the remaining portions 22 fold over upon impact to deform the projectile's shape and stop the projectile 2 in the target. Because the remaining portions 22 are straighter (rather than angled) proximate the tip 4, the remaining portions 22 fold over easily upon impact. Further, using a soft material (e.g., copper) also allows the nose 6 and remaining portions 22 to fold over and cave inward.

Figure 49:
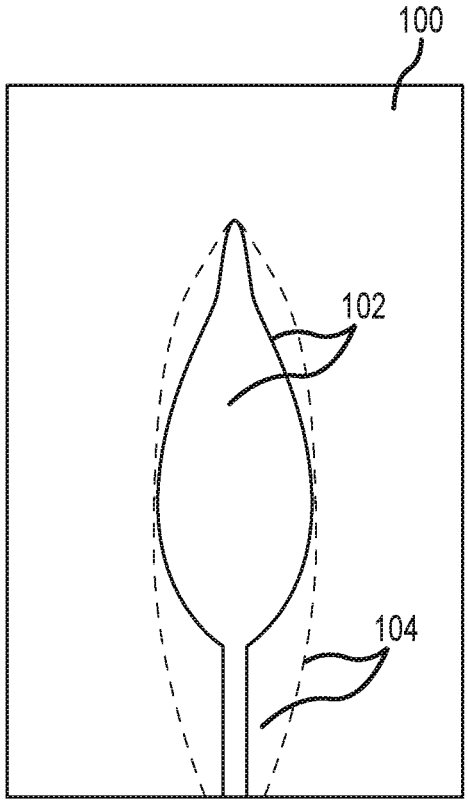
FIG. 49 shows a gel target after being shot by two different projectiles.

The cavitation shape of this projectile is shown in FIG. 49. The cavitation shape is also an unexpected result of this projectile. It was expected that the cavitation shape would be similar to a hollow-point bullet. However, as shown in FIG. 49, the cavitation shape of this projectile is different and it is larger than a hollow-point bullet. Another unexpected result of this projectile is that it acts like a rifle projectile when shot long distances rather than a pistol projectile. It was expected that the depressions 8 would affect the long-distance flight of the projectile. However, experimentation showed that the projectile continued straight and on target even when shot over 300 yards. Additionally, the projectile was still able to create the desired cavitation and wound in its target after being shot 300 yards.

FIGS. 42A-E show a projectile 2 according to a thirty-sixth embodiment of the invention. The projectile 2 of FIG. 42 was originally designed to cut into steel. Thus, this projectile can pierce armor in some embodiments. In other embodiments, the tip 4 is rounded such that the projectile 2 cannot piece armor. Various embodiments of FIGS. 42A-E are designed for military use and/or hunting large game (e.g., elk, moose, boar, buffalo, water buffalo, and other large African game).

Figure 42A:
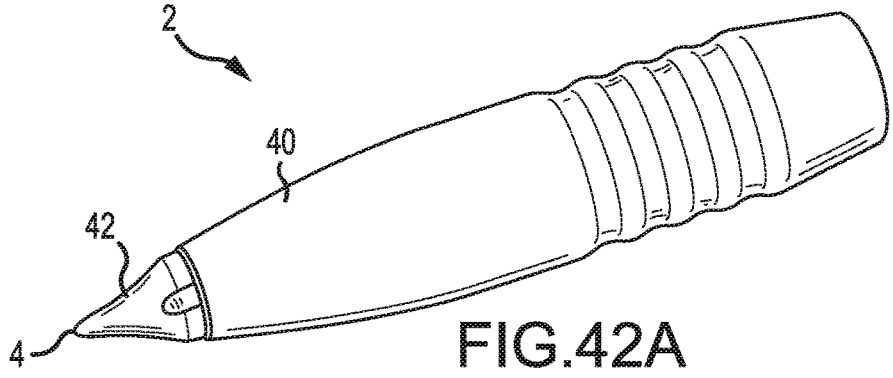
FIGS. 42A-E show a projectile according to a thirty-sixth embodiment of the invention.
Figure 42B:
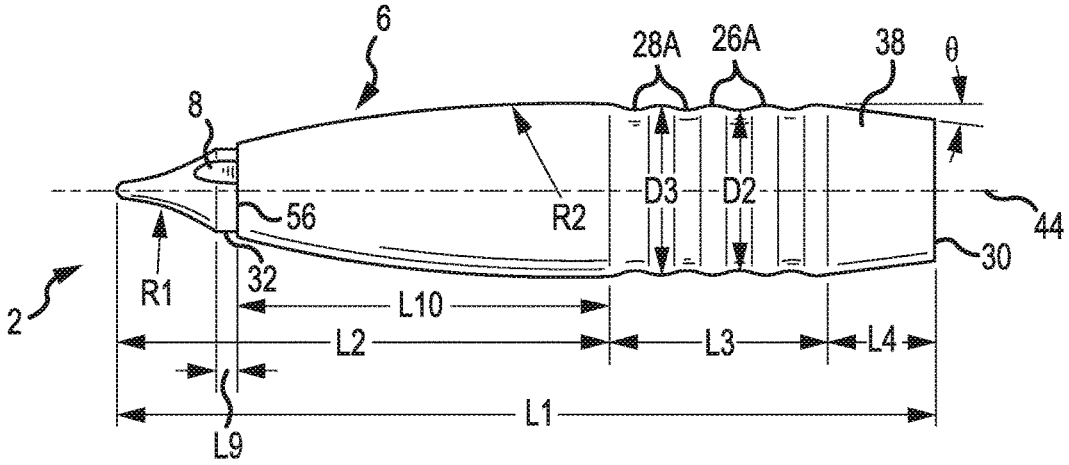
Figure 42C:
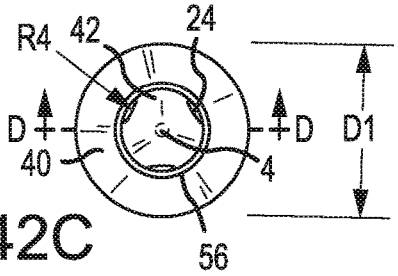
Figure 42D:
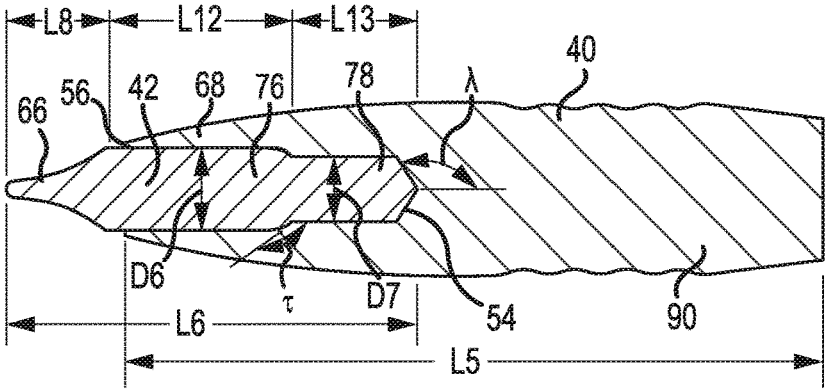
Figure 42E:
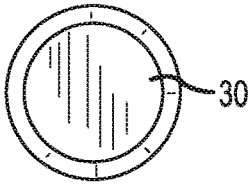
Figure 43A:
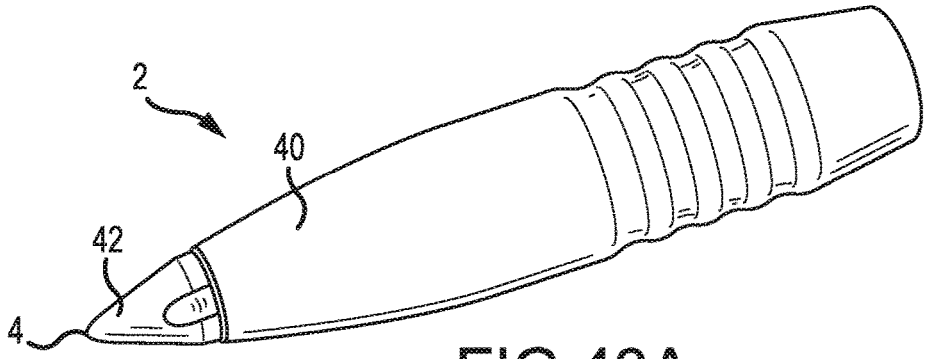
FIGS. 43A-E show a projectile according to a thirty-seventh embodiment of the invention.
Figure 43B:
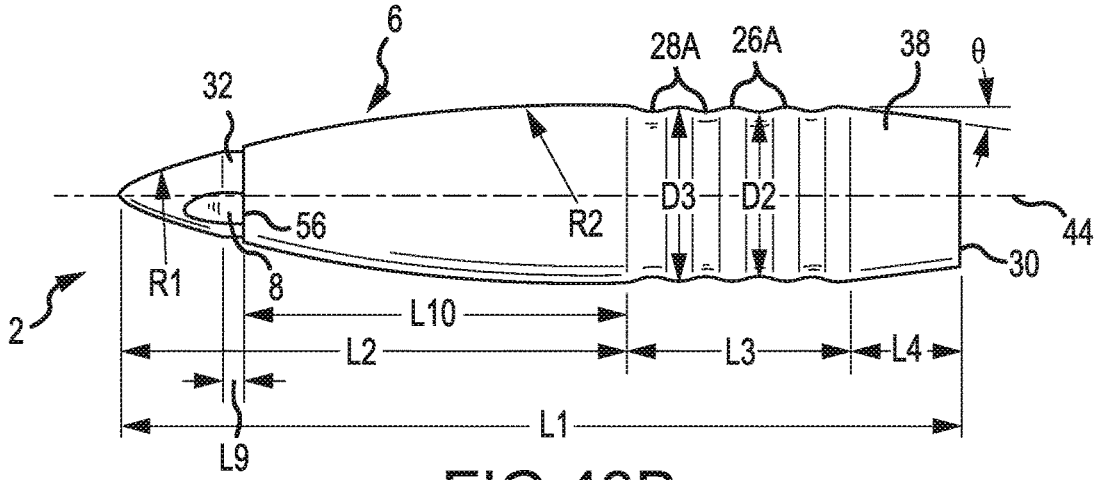
Figure 43C:
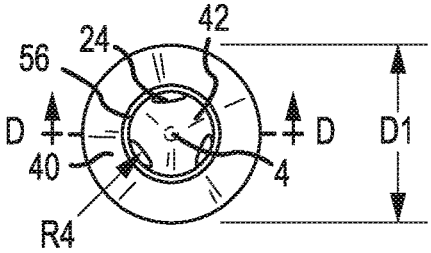
Figure 43D:
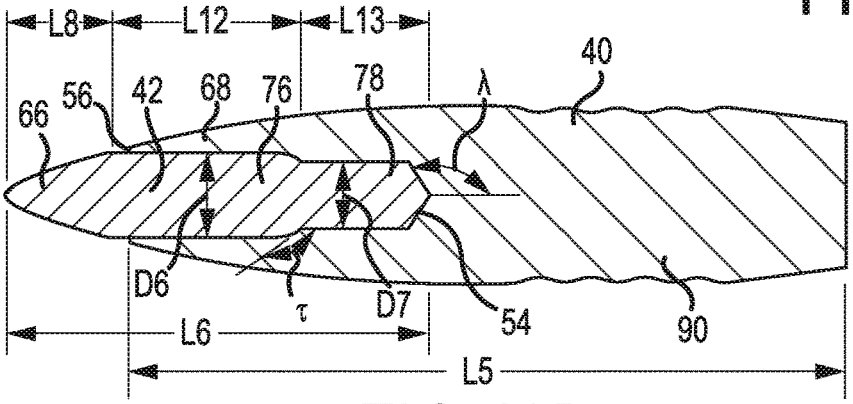
Figure 43E:
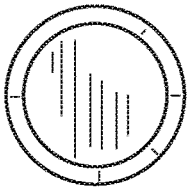

FIG. 42A is a perspective view of the projectile 2. FIG. 42B is a side elevation view of the projectile 2. FIG. 42C is a top plan view of the projectile 2. FIG. 42D is a cross-sectional view. FIG. 42E is a bottom plan view of the projectile 2. Note that FIGS. 42A-E are to scale. The projectile of FIG. 42 is very similar to (and possibly the same as in some embodiments) the projectile of FIG. 35, except that the projectile of FIG. 42 has a differently shaped insert 42 than the insert in FIG. 35. Additionally, the first nose portion 66 of the projectile of FIG. 42 has a concave radius of curvature R1, whereas the first nose portion of the projectile of FIG. 35 has a convex radius of curvature R1 or an angled first nose portion. This concave shape kicks the air up and around the nose 6 of the projectile 2, thus reducing the drag experienced by the projectile 2 in flight. Additionally, the concave shape provides a consistent BC, shot after shot. It was an unexpected result that the concave shape of the first nose portion 66 would cause the projectile 2 to have a non-deviating BC and a zero extreme spread of BC per shot. Most projectiles have a BC that deviates by about 2% per shot. However, a deviating BC reduces accuracy and range. Therefore, this projectile 2 has improved accuracy and range over prior art projectiles.

In some embodiments, the radius of curvature R1 of the first nose portion 66 is between about 0.25 inches and about 5.0 inches. In a preferred embodiment, the radius of curvature R1 of the first nose portion 66 is between about 0.40 inches and about 4.0 inches. In a more preferred embodiment, the radius of curvature R1 of the first nose portion 66 is about 0.5 inches. In another more preferred embodiment, the radius of curvature R1 of the first nose portion 66 is about 3.5 inches. In one embodiment, the radius of curvature R2 of the tangent ogive or the second nose portion 68 is between about 1.0 inch and about 6.0 inches. In a preferred embodiment, the radius of curvature R2 of the tangent ogive or the second nose portion 68 is between about 2.5 inches and about 5.5 inches. In a more preferred embodiment, the radius of curvature R2 of the tangent ogive or the second nose portion 68 is about 5.0 inches. In another more preferred embodiment, the radius of curvature R2 of the tangent ogive is about 3.5 inches.

The longitudinal axis 44 of the projectile 2 is shown in FIG. 42B. The angle α of the nose depressions 8 can be measured relative to the longitudinal axis 44. In some embodiments, all nose depressions 8 have the same angle α. In other embodiments, each nose depression 8 has a different angle α. In still other embodiments, some nose depressions 8 have the same angle α while other nose depressions 8 have different angles α. In the embodiment shown, the nose depressions 8 are right-hand nose depressions 8 because the angle α is positioned to the right of the longitudinal axis 44. Further, when looking at the projectile from a top plan view (FIG. 42C), the nose depressions 8 appear to turn in a counter-clockwise direction. In one embodiment, the projectile 2 has at least three nose depressions 8. However, the projectile 2 can have more or fewer nose depressions 8. The depressions 8 create cavities between the insert 42 and the housing 40 such that when the projectile 2 hits a soft medium target, the cavities 24 fill with the soft medium and the projectile slows down. Additionally, the depressions 8 create a high-pressure area in each depression 8 to move air around the depression 8 and not into the cavity 24 when traveling in air or in hard media. The intersection between the remaining portion 22 and depression 8 forms an edge (92 in other figures). The edge can be a sharp edge with a sharp corner or the edge can be a rounded curved edge.

The depressions 8 in the insert have a curved shape meaning that the trough or bottom of the depression 8 is curved and has a radius of curvature R4. In one embodiment, the depressions 8 are cut using a ⅛ inch ball end mill. In various embodiments, the ball end mill can cut into the projectile 2 to different depths when forming the depressions 8. Because the ball end mill is spherical, the width of the depressions 8 will increase as the ball end mill is cut deeper into the projectile until the ball end mill cuts a depth equal to its radius. The shallower the nose depressions 8, the deeper the projectile will penetrate into a soft target material. Therefore, deeper depressions 8 are used for smaller animals and humans and shallower depressions 8 are used for larger animals. In one embodiment, the radius of curvature R4 of the depressions 8 is between about 0.04 inches and about 0.15 inches. In a preferred embodiment, the radius of curvature R4 of the depressions 8 is between about 0.05 inches and about 0.10 inches. In a more preferred embodiment, the radius of curvature R4 of the depression 8 is about 0.0625 inches. The depressions 8 extend a length from a rear portion of the first nose portion 66 (i.e., just in front of the linear portion 32) to an area of the insert 42 proximate the end of the thick portion 76 of the insert 42. The depressions 8 begin at a point before the linear portion 32 to fill with target material upon impact. Additionally, the location of the depressions 8 and the linear portion 32 enable air to flow around the depressions 8. In one embodiment, the length of the depressions 8 is between about 0.20 inches and about 0.70 inches. In a preferred embodiment, the length of nose depressions 8 is between about 0.35 inches and about 0.55 inches. In a more preferred embodiment, the length of the depressions 8 is about 0.43 inches. The length of the nose depressions 8 may the same as or similar to the length L11 of the depression 8 shown in FIG. 44B. Longer depressions 8 are used for projectiles used on larger animals.

Additionally, if the insert 42 is longer, which is the case in some embodiments, then the thick portion 76 of the insert 42 can be longer and the depressions 8 can be longer. The converse is true if the insert 42 is shorter than the insert shown in FIG. 42D. In one embodiment, the depressions 8 have an angle α between about 3.0 degrees and about 9.5 degrees. In a preferred embodiment, the depressions 8 have an angle α between about 4.5 degrees and about 8.5 degrees. In a more preferred embodiment, the depressions 8 have an angle α of about 7.0 degrees.

In one embodiment, the material of the insert 42 is harder than the material of the housing 40. In some embodiments, the insert 42 is made of steel, tungsten, Inconel, or another hard material. The housing can be made of brass, copper, copper alloys (e.g., a copper nickel alloy, a trillium copper alloy, etc.), an aluminum nanoparticle/nanopowder (nanotechnology) material, or other materials known in the art. In other embodiments, the material of the insert 42 is the same or similar hardness to the material of the housing 40.

Embodiments of this projectile have a hardened forcing cone or insert 42 that separates from the housing 40 upon impact of a soft target material. The insert 42 typically yaws and continues in a different path from the housing 40 once in the soft target material. The housing 40 continues in a direction that is the same as or similar to the trajectory of the projectile upon impact. Depending on the target material and the velocity of the projectile upon impact, the forward portion of the housing 40 can split or flower into six or more pieces in the target or the forward portion of the housing 40 can fragment and break off in the target. If the forward portion fragments and breaks off, then the base portion 90 of the housing keeps going in the target material. The base portion 90 is typically the part of the housing 40 without a cavity, i.e., the portion of the housing 40 in FIG. 42D rearward of the lower portion 54 of the stem 50, 78 of the insert 42. The forward portion of the housing 40 is the portion of the housing 40 with the cavity, i.e., the portion in FIG. 42D forward of the lower portion 54 of the stem 50, 78 of the insert 42. Thus, in some embodiments, the forward portion of the housing 40 fragments in the projectile's target and the base portion 90 of the housing 40 continues through the target. Exactly where the housing 40 fragments and how much of the housing 40 fragments depends on the speed of the projectile as it hits its target and the material of the target. Additionally, the shorter the insert 42 (and the shorter the cavity in the housing 40 for the insert 42), the deeper the base portion 90 penetrates a soft tissue target material.

This projectile 2 includes many novel features, including the fact that the projectile's 2 flight path is not altered by going through glass or other hard materials. The projectile's 2 trajectory stays the same (or very similar) after going through a piece of glass (e.g., a windshield or window). Additionally, the projectile 2 stops in a soft target material and creates large cavitation or wounds in the soft target material. Most projectiles that continue along the same trajectory after going through a hard material are also armor piecing projectiles that do not stop in a soft target material. These prior art projectiles can be dangerous in crowded environments because the projectile can go through the first soft target material (e.g., a person) and then hit another object (e.g., another person). The projectile 2 of FIG. 42 can be shot through glass and then will stop in the first soft target material it impacts, depending on the thickness of the first target. The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.30 inches and about 0.45 inches. In a more preferred embodiment, the diameter D1 of the projectile 2 is about 0.338 inches. In another preferred embodiment, the diameter D1 of the projectile 2 is about 0.308 inches. If the diameter D1 of the projectile is about 0.308 inches, then the other measurements (e.g., L2, L3, L4, L5, L6, L10, L11, etc.) scale accordingly, except for length L1, which may not scale depending on barrel and chamber constraints. In another preferred embodiment, the diameter D1 of the projectile 2 is about 0.40 inches. If the diameter D1 of the projectile is about 0.400 inches, then the other measurements (e.g., L2, L3, L4, L5, L6, L10, L11, etc.) scale accordingly, except for length L1, which may not scale depending on barrel and chamber constraints. In yet another preferred embodiment, the diameter D1 of the projectile 2 is about 0.45 inches. If the diameter D1 of the projectile is about 0.45 inches, then the other measurements (e.g., L2, L3, L4, L5, L6, L10, L11, etc.) scale accordingly, except for length L1, which may not scale depending on barrel and chamber constraints.

In one embodiment, the length L1 of the projectile 2 is between about 1.00 inch and about 2.00 inches. In a preferred embodiment, the length L1 of the projectile 2 is between about 1.50 inches and about 1.80 inches. In a more preferred embodiment, the length L1 of the projectile 2 is about 1.65 inches. In one embodiment, the length L2 of the nose portion 6 is between about 0.50 inches and about 1.50 inches. In a preferred embodiment, the length L2 of the nose portion 6 is between about 0.75 inches and about 1.25 inches. In a more preferred embodiment, the length L2 of the nose portion 6 is about 1.00 inch. In one embodiment, the length L3 of the cylindrical portion 20 is between about 0.10 inches and about 0.80 inches. In a preferred embodiment, the length L3 of the cylindrical portion 20 is between about 0.25 inches and about 0.55 inches. In a more preferred embodiment, the length L3 of the cylindrical portion 20 is about 0.40 inches. In one embodiment, the length L4 of the boat tail 38 is between about 0.10 inches and about 0.40 inches. In a preferred embodiment, the length L4 of the boat tail 38 is between about 0.15 inches and about 0.35 inches. In a more preferred embodiment, the length L4 of the boat tail 38 is about 0.25 inches. In another preferred embodiment, the length L4 of the boat tail 38 is about 0.30 inches.

In one embodiment, the length L6 of the insert 42 is between about 0.50 inches and about 1.20 inches. In a preferred embodiment, the length L6 of the insert 42 is about 0.83 inches. In one embodiment, the length L8 of the first nose portion 66 extending from the tip 4 to the linear portion 32 is between about 0.10 inches and about 0.30 inches. In a preferred embodiment, the length L8 of the first nose portion 66 is between about 0.15 inches and about 0.25 inches. In a more preferred embodiment, the length L8 of the first nose portion 66 is about 0.21 inches. In one embodiment, the length L12 of the thick portion 76 of the insert 42 is between about 0.10 inches and about 0.70 inches. In a preferred embodiment, the length L12 of the thick portion 76 of the insert 42 is between about 0.25 inches and about 0.55 inches. In a more preferred embodiment, the length L12 of the thick portion 76 of the insert 42 is about 0.40 inches. In one embodiment, the length L13 of the thin portion 78 of the insert 42 is between about 0.05 inches and about 0.40 inches. In a preferred embodiment, the length L13 of the thin portion 78 of the insert 42 is between about 0.15 inches and about 0.30 inches. In a more preferred embodiment, the length L13 of the thin portion 78 of the insert 42 is about 0.22 inches. In one embodiment, the diameter D6 of the thick portion 76 of the insert 42 is between about 0.10 inches and about 0.25 inches. In a preferred embodiment, the diameter D6 of the thick portion 76 of the insert 42 is between about 0.15 inches and about 0.20 inches. In a more preferred embodiment, the diameter D6 of the thick portion 76 of the insert 42 is about 0.17 inches. In one embodiment, the diameter D7 of the thin portion 78 of the insert 42 is between about 0.05 inches and about 0.20 inches. In a preferred embodiment, the diameter D7 of the thin portion 78 of the insert 42 is between about 0.10 inches and about 0.15 inches. In a more preferred embodiment, the diameter D7 of the thin portion 78 of the insert 42 is about 0.125 inches. The step between the thick portion 76 and thin portion 78 of the insert 42 has a rounded shape and is positioned at an angle $\tau$ relative to the longitudinal axis of the projectile 2. In some embodiments, the angle $\tau$ is between about 90 degrees and about 150 degrees. In a preferred embodiment, the angle $\tau$ is about 120 degrees. The underside 54 of the insert 42 has a pointed or angled shape such that the underside 54 is positioned at an angle $\lambda$ relative to the longitudinal axis of the projectile 2. In some embodiments, the angle $\lambda$ is between about 90 degrees and about 150 degrees. In a preferred embodiment, the angle $\lambda$ is about 120 degrees. The housing 40 has a cavity that is cut to have a similar shape to the insert 42 such that the cavity in the housing 40 can securely receive the insert 42, i.e., the housing 40 can frictionally engage the insert 42. The cavity can have a cylindrical portion with a larger inner diameter proximate the front 56 of the housing 40 that transitions to a cylindrical portion with a smaller inner diameter. The transition may be angled or curved. Thus, the cavity will have inner diameters similar to the diameter D6 of the thick portion 76 of the insert 42 and the diameter D7 of the thin portion 78 of the insert 42. The bottom of the cavity may be pointed, angled, conical shaped, or flat. Additionally, the cavity in the housing 40 can have similar transition shapes and angles to the insert's 42 shapes and angles, e.g., angle $\lambda$ and angle $\tau$. In some embodiments, the cavity in the housing 40 can have grooves on the inner surface to more tightly grip the insert 42.

Figure 44A:
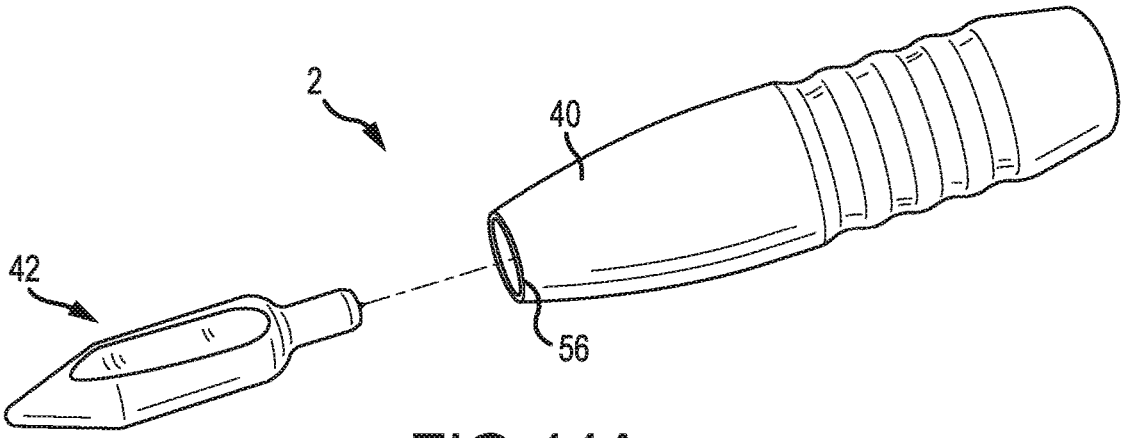
FIGS. 44A-C show a projectile according to a thirty-eighth embodiment of the invention.
Figure 44B:
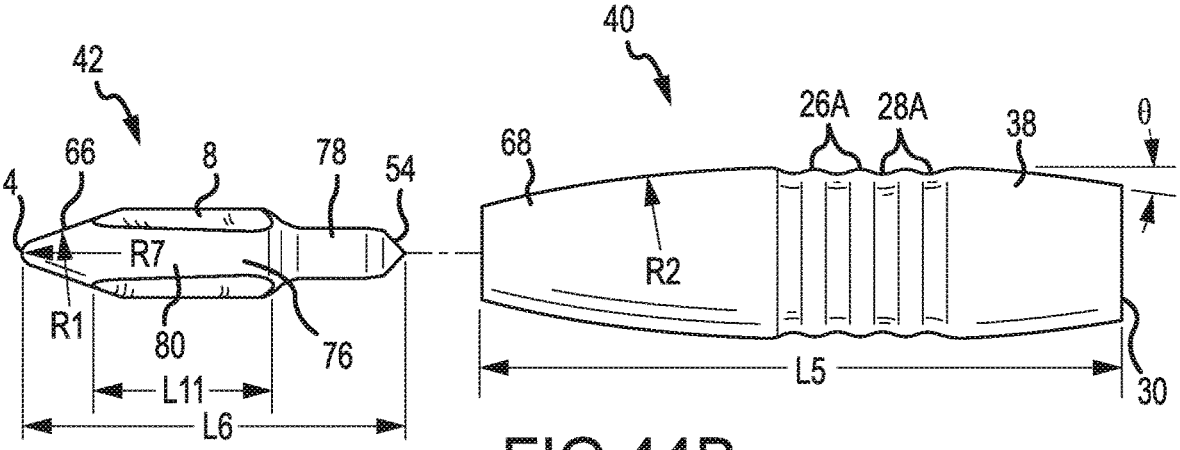

The tip 4 can have a radius of curvature R7 (not shown on FIG. 42B, but shown in FIG. 44B). In one embodiment, the radius of curvature R7 of the tip 4 is between about 0.01 inches and about 0.05 inches. In a preferred embodiment, the radius of curvature R7 of the tip 4 is about 0.025 inches.

In one embodiment, the length L5 of the housing 40 is between about 1.00 inch and about 1.80 inches. In a preferred embodiment, the length L5 of the housing 40 is about 1.41 inches. In one embodiment, the length L9 of the linear portion 32 is between about 0.01 inches and 0.10 inches. In a preferred embodiment, the length L9 of the linear portion 32 is about 0.05 inches. In some embodiments, the length L9 corresponds to 1/10 or 1/12 of the caliber of the projectile. In one embodiment, the length L10 of the second nose portion 68 extending from the front 56 of the housing 40 to the cylindrical portion 20 is between about 0.50 and about 1.00 inch. In a preferred embodiment, the length L10 of the second nose portion 68 is about 0.74 inches.

In one embodiment, the angle θ of the boat tail 38 is between about 5 degrees and about 10 degrees. In a preferred embodiment, the angle θ of the boat tail 38 is between about 6.5 degrees and about 8.5 degrees. In a more preferred embodiment, the angle θ of the boat tail 38 is about 7.5 degrees.

The cylindrical portion 20 comprises angled driving bands 26A and angled relief cuts 28A. The angled driving bands 26A and angled relief cuts 28A create air disturbances that stabilize the projectile 2 in flight allowing the projectile 2 to fly straighter and be less affected by cross winds than projectiles of the prior art. For a close-up view of the angled driving bands 26A and angled relief cuts 28A, see FIG. 35E. In one embodiment, the angled driving bands 26A and angled relief cuts 28A are positioned at an angle σ relative to a horizontal line or the longitudinal axis 44 between about 6 degrees and about 11 degrees. In a preferred embodiment, the angled driving bands 26A and angled relief cuts 28A are positioned at an angle σ relative to a horizontal line or the longitudinal axis 44 between about 7 degrees and about 9 degrees. In a more preferred embodiment, the angled driving bands 26A and angled relief cuts 28A are positioned at an angle σ relative to a horizontal line or the longitudinal axis 44 about 8.5 degrees. In another preferred embodiment, the angled driving bands 26A and angled relief cuts 28A are positioned at an angle σ relative to a horizontal line or the longitudinal axis 44 about 7.5 degrees. In one embodiment, the diameter D2 of the angled relief cuts 28A is between about 0.20 inches and about 0.50 inches. In a preferred embodiment, the diameter D2 of the angled relief cuts 28A is about 0.330 inches. In one embodiment, the diameter D3 of the angled driving bands 26A is between about 0.20 inches and about 0.50 inches. In a preferred embodiment, the diameter D3 of the angled driving bands 26A is about 0.338 inches. In alternate embodiments, the driving bands 26A vary in number, comprising one driving band 26A, a plurality of driving bands 26A, two driving bands 26A, three driving bands 26A, and four or more driving bands 26A.

FIGS. 43A-E show a projectile according to a thirty-seventh embodiment of the invention. The projectile 2 shown in FIG. 43 is very similar to the projectile shown in FIG. 42; therefore, repetitive description will not be repeated here. Only the differences will be discussed. This projectile 2 can be manufactured using a lathe, which creates a projectile with less BC variation than projectiles manufactured using molds.

Additionally, two-part projectiles send a lot of energy laterally into its target and the insert 42 magnifies cavitation. Therefore, the projectile 2 can stop quicker and the projectile 2 creates more cavitation. Further, a user can use a smaller gun and get the same performance as a larger gun with respect to cavitation and wound size.

In some embodiments, the first nose portion 66 of the projectile 2 has a convex radius of curvature R1. In one embodiment, the radius of curvature R1 of the first nose portion 66 is between about 0.5 inches and 5.0 inches. In a preferred embodiment, the radius of curvature R1 of the first nose portion 66 is about 2.5 inches. In other embodiments, the first nose portion 66 is angled or concave.

In one embodiment, the radius of curvature R2 of the tangent ogive is between about 2.0 inches and about 8.0 inches. In a preferred embodiment, the radius of curvature R2 of the tangent ogive is between about 4.5 inches and about 6.5 inches. In a more preferred embodiment, the radius of curvature R2 of the tangent ogive is about 5.5 inches. In another preferred embodiment, the radius of curvature R2 of the tangent ogive is about 3.5 inches.

In one embodiment, the diameter D7 of the thin portion 78 of the insert 42 is between about 0.05 inches and about 0.20 inches. In a preferred embodiment, the diameter D7 of the thin portion 78 of the insert 42 is between about 0.09 inches and about 0.14 inches. In a more preferred embodiment, the diameter D7 of the thin portion 78 of the insert 42 is about 0.115 inches.

The depressions 8 in the insert have a curved shape meaning that the trough or bottom of the depression 8 is curved and has a radius of curvature R4. In one embodiment, the depressions 8 are cut using a 1/8 inch ball end mill. In various embodiments, the ball end mill can cut into the projectile 2 to different depths when forming the depressions 8. The depressions 8 of FIGS. 43A-E are deeper than the depressions 8 of FIGS. 42A-E. Deeper depressions 8 are used for smaller animals and humans; therefore, this embodiment is designed for military use. In one embodiment, the radius of curvature R4 of the depressions 8 is between about 0.04 inches and about 0.15 inches. In a preferred embodiment, the radius of curvature R4 of the depressions 8 is between about 0.055 inches and about 0.10 inches. In a more preferred embodiment, the radius of curvature R4 of the depression 8 is about 0.0625 inches. However, the depressions 8 can be cut using different sized ball end mills, thus making the depressions have different radii of curvature R4.

Figure 44C:
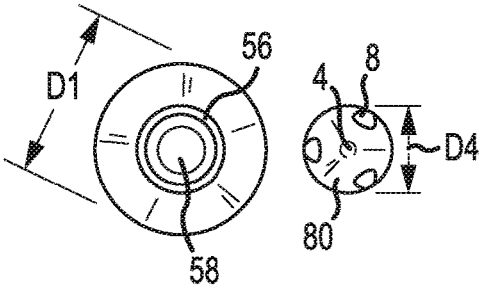

FIGS. 44A-C show an exploded view of a projectile according to a thirty-eighth embodiment of the invention. The projectile 2 shown in FIGS. 44A-C is very similar to the projectiles shown in FIGS. 42A-E and 43A-E; therefore, repetitive description will not be repeated here. Only the differences will be discussed. In some embodiments, the first nose portion 66 of the projectile 2 is angled rather than concave or convex. In other embodiments, the first nose portion 66 has a concave radius of curvature R1. In one embodiment, the radius of curvature R1 of the first nose portion 66 is between about 0.5 inches and 5.0 inches. In a preferred embodiment, the radius of curvature R1 of the first nose portion 66 is about 2.5 inches.

In one embodiment, the length L5 of the housing 40 is between about 0.80 inch and about 1.80 inches. In a preferred embodiment, the length L5 of the housing 40 is between about 1.10 inch and about 1.50 inches. In a more preferred embodiment, the length L5 of the housing 40 is about 1.30 inches. In one embodiment, the diameter of the thin portion 78 of the insert 42 is between about 0.05 inches and about 0.20 inches. In a preferred embodiment, the diameter of the thin portion 78 of the insert 42 is between about 0.10 inches and about 0.15 inches. In a more preferred embodiment, the diameter of the thin portion 78 of the insert 42 is about 0.125 inches.

The insert 42 comprises depressions 8 and remaining portions 80 between the depressions 8. The depressions 8 in the insert have a curved shape meaning that the trough or bottom of the depression 8 is curved and has a radius of curvature R4. In one embodiment, the depressions 8 are cut using a ⅛ inch ball end mill. In various embodiments, the ball end mill can cut into the projectile 2 to different depths when forming the depressions 8. The depressions 8 of FIGS. 44A-C are deeper than the depressions 8 of FIGS. 42A-E and 43A-E. Deeper depressions 8 are used for smaller animals and humans; therefore, this embodiment is designed for military use. In one embodiment, the radius of curvature R4 of the depressions 8 is between about 0.04 inches and about 0.15 inches. In a preferred embodiment, the radius of curvature R4 of the depressions 8 is between about 0.055 inches and about 0.10 inches. In a more preferred embodiment, the radius of curvature R4 of the depression 8 is about 0.0625 inches. In one embodiment, the length L11 of the depressions 8 is between about 0.20 inches and about 0.70 inches. In a preferred embodiment, the length L11 of depressions 8 is between about 0.35 inches and about 0.55 inches. In a more preferred embodiment, the length L11 of the depressions 8 is about 0.43 inches.

Figure 45A:
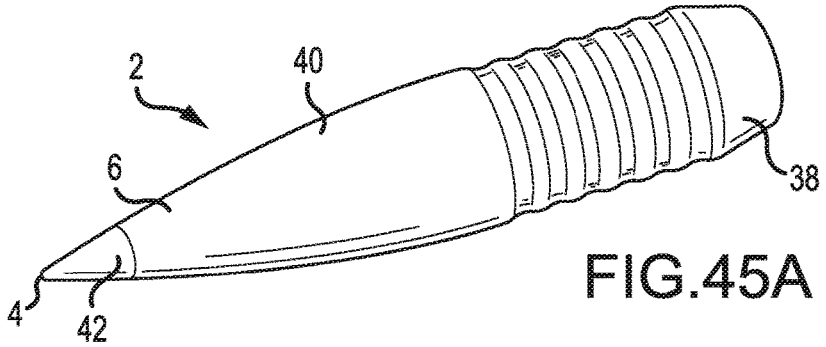
FIGS. 45A-E show a projectile according to a thirty-ninth embodiment of the invention.
Figure 45B:
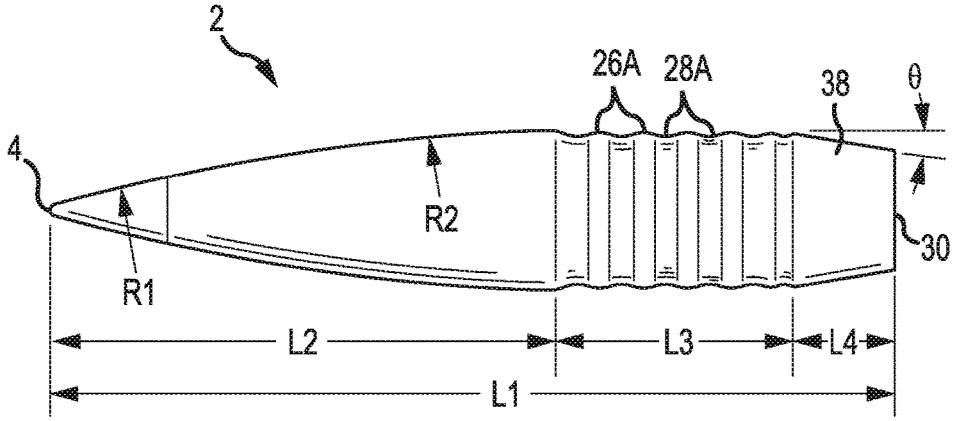
Figure 45C:
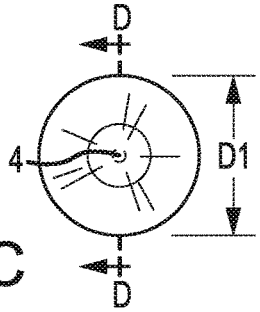
Figure 45D:
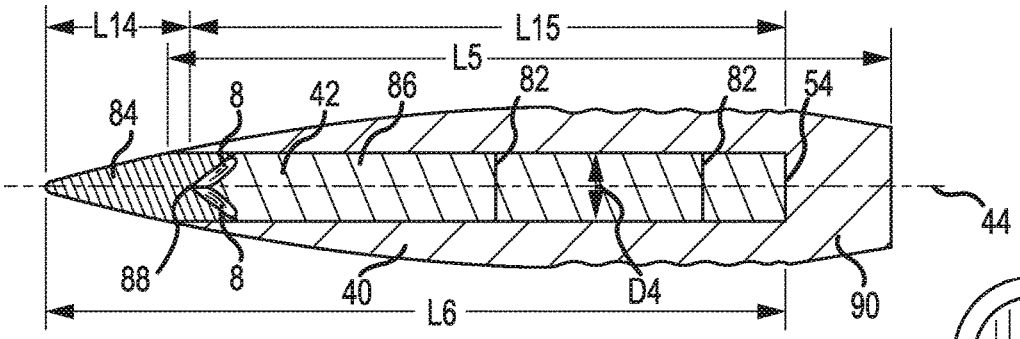
Figure 45E:
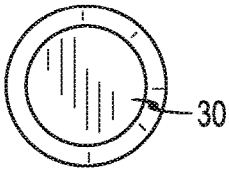
Figure 46A:
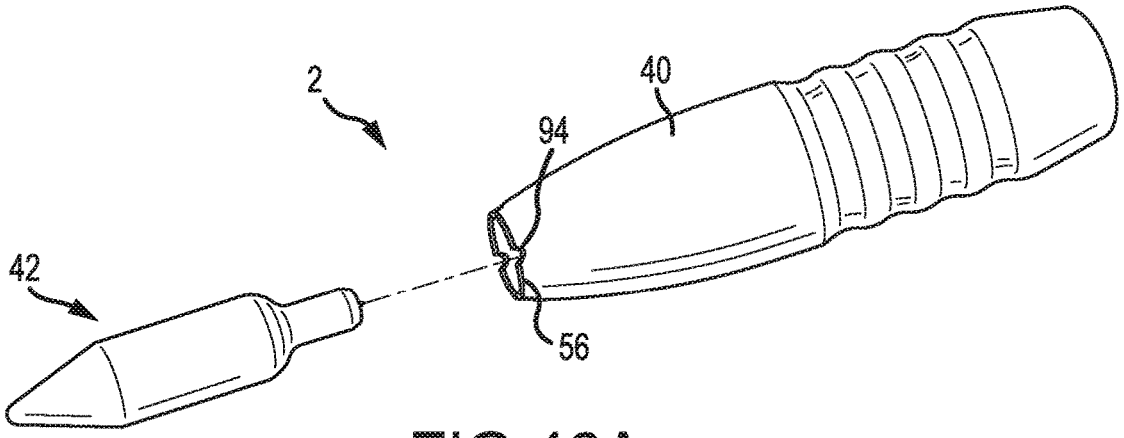
FIGS. 46A-D show a projectile according to a fortieth embodiment of the invention.
Figure 46B:
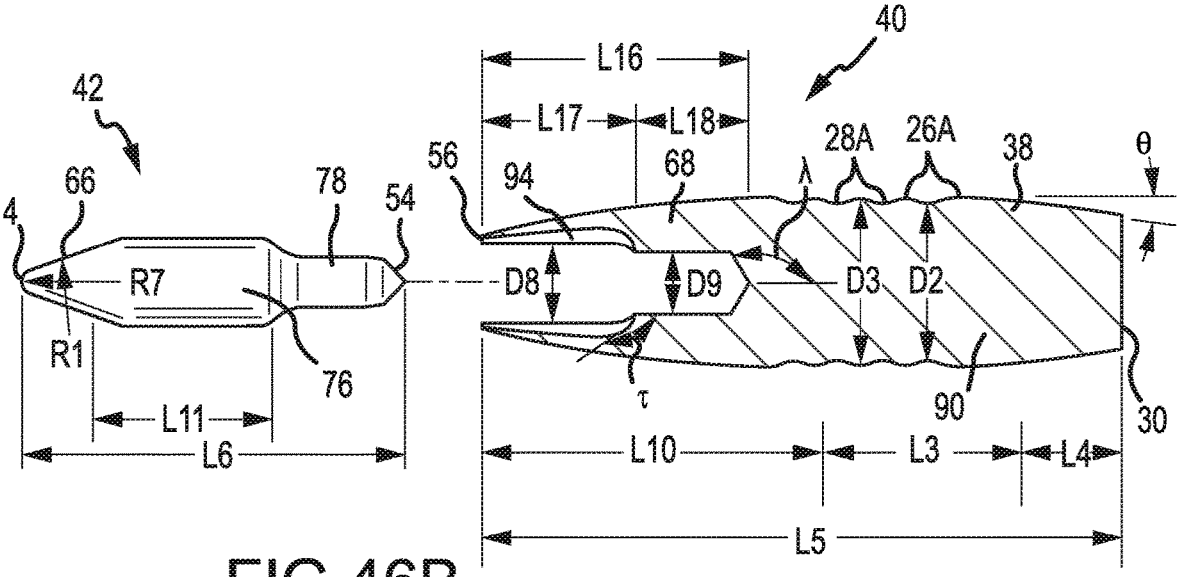
Figure 46C:
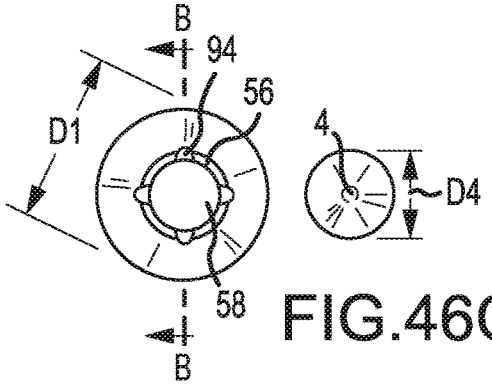
Figure 46D:
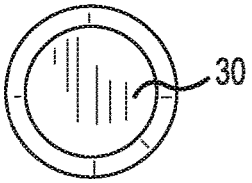

FIGS. 45A-E show a projectile according to a thirty-ninth embodiment of the invention. The projectile 2 comprises an insert 42 and a housing 40. This projectile 2 is designed to cut into steel and pierce armor. FIG. 45A is a perspective view of the projectile 2. FIG. 45B is a side elevation view of the projectile 2. FIG. 45C is a top plan view of the projectile 2. FIG. 45D is a cross-sectional view. FIG. 45E is a bottom plan view of the projectile 2. Note that FIGS. 45A-E are to scale. The projectile of FIG. 45 is similar to the projectile of FIG. 3, except that the projectile of FIG. 45 has a slightly differently shaped body and it includes an insert 42.

The projectile includes an insert 42 and a housing 40. In one embodiment, the insert 42 is comprised of two different materials. In various embodiments, the front portion 84 of the insert 42 is a soft material (e.g., aluminum, plastic, etc.) and the rear portion 86 of the insert 42 is a hard material (e.g., tungsten, steel, tungsten-carbide, Inconel, etc.). The housing 40 can be brass, bronze, copper, copper alloys (e.g., a copper nickel alloy, a trillium copper alloy, etc.), a ceramic material, an aluminum nanoparticle/nanopowder (nanotechnology) material, aluminum alloy, tungsten-carbide, or any other material known in the art. In some embodiments, the rear portion 86 of the insert 42 is a harder material than the housing 40. In other embodiments, the material of the rear portion 86 of the insert 42 is the same or a similar hardness to the material of the housing 40. In one embodiment, the soft metal front portion 84 of the insert 42 acts like a lubricant when the projectile 2 strikes its target, which allows the projectile to smoothly penetrate the target.

In some embodiments, this projectile 2 has a hardened forcing cone or insert 42 that separates from the housing 40 upon impact of a soft target material. The insert 42 typically yaws and continues in a different path from the housing 40 once in the soft target material. The housing 40 continues in a direction that is the same as or similar to the trajectory of the projectile upon impact. Depending on the target material and the velocity of the projectile upon impact, the forward portion of the housing 40 can split or flower into six or more pieces in the target or the forward portion of the housing 40 can fragment and break off in the target. If the forward portion of the housing 40 fragments and breaks off, then the base portion 90 of the housing keeps going in the target material. The base portion 90 is typically the part of the housing 40 without a cavity, i.e., the portion of the housing 40 in FIG. 45D rearward of the lower portion 54 of the insert 42. The forward portion of the housing 40 is the portion of the housing 40 with the cavity, i.e., the portion in FIG. 45D forward of the lower portion 54 of the insert 42. Thus, in some embodiments, the forward portion of the housing 40 fragments in the projectile's target and the base portion 90 of the housing 40 continues through the target. Exactly where the housing 40 fragments and how much of the housing 40 fragments depends on the speed of the projectile as it hits its target and the material of the target. Additionally, the shorter the insert 42 (and the shorter the cavity in the housing 40 for the insert 42), the deeper the base portion 90 penetrates a soft tissue target material.

The diameter D1 of the projectile 2 varies according the various embodiments. In one embodiment, the diameter D1 of the projectile 2 is between about 0.20 inches and about 0.50 inches. In a preferred embodiment, the diameter D1 of the projectile 2 is between about 0.25 inches and about 0.35 inches. In a more preferred embodiment, the diameter D1 of the projectile 2 is about 0.308 inches. In another preferred embodiment, the diameter D1 of the projectile 2 is about 0.338 inches. If the diameter D1 of the projectile is about 0.338 inches, then the other measurements (e.g., L2, L3, L4, L6, L7, L14, L15, etc.) scale accordingly, except for length L1, which may not scale depending on barrel and chamber constraints. In another preferred embodiment, the diameter D1 of the projectile 2 is about 0.40 inches. If the diameter D1 of the projectile is about 0.400 inches, then the other measurements (e.g., L2, L3, L4, L6, L7, L14, L15, etc.) scale accordingly, except for length L1, which may not scale depending on barrel and chamber constraints. In yet another preferred embodiment, the diameter D1 of the projectile 2 is about 0.45 inches. If the diameter D1 of the projectile is about 0.45 inches, then the other measurements (e.g., L2, L3, L4, L6, L7, L14, L15, etc.) scale accordingly, except for length L1, which may not scale depending on barrel and chamber constraints.

In one embodiment, the length L1 of the projectile 2 is between about 1.00 inch and about 2.00 inches. In a preferred embodiment, the length L1 of the projectile 2 is between about 1.40 inches and about 1.70 inches. In a more preferred embodiment, the length L1 of the projectile 2 is about 1.53 inches. In one embodiment, the length L2 of the nose portion 6 is between about 0.50 inches and about 1.50 inches. In a preferred embodiment, the length L2 of the nose portion 6 is between about 0.75 inches and about 1.15 inches. In a more preferred embodiment, the length L2 of the nose portion 6 is about 0.90 inches. In one embodiment, the length L3 of the cylindrical portion is between about 0.10 inches and about 0.70 inches. In a preferred embodiment, the length L3 of the cylindrical portion is between about 0.25 inches and about 0.45 inches. In a more preferred embodiment, the length L3 of the cylindrical portion is about 0.38 inches. In one embodiment, the length L4 of the boat tail 38 is between about 0.10 inches and about 0.40 inches. In a preferred embodiment, the length L4 of the boat tail 38 is between about 0.15 inches and about 0.35 inches. In a more preferred embodiment, the length L4 of the boat tail 38 is about 0.23 inches. In another embodiment, the length L4 of the boat tail 38 is about 0.25 inches.

In one embodiment, the length L6 of the insert 42 is between about 0.50 inches and about 3.00 inches. In a preferred embodiment, the length L6 of the insert 42 is about 1.30 inches. In one embodiment, the length L14 from the tip 4 of the projectile 2 to the tip 88 of the rear portion 86 of the insert 42 is between about 0.10 inches and about 0.50 inches. In a preferred embodiment, the length L14 from the tip 4 of the projectile 2 to the tip 88 of the rear portion 86 of the insert 42 is between about 0.20 inches and about 0.40 inches.

In a more preferred embodiment, the length L14 from the tip 4 of the projectile 2 to the tip of the rear portion 86 of the insert 42 is about 0.30 inches. In one embodiment, the length L15 of the rear portion 86 of the insert 42 is between about 0.50 inches and about 1.50 inches. In a preferred embodiment, the length L15 of the rear portion 86 of the insert 42 is between about 0.75 inches and about 1.25 inches. In a more preferred embodiment, the length L15 of the rear portion 86 of the insert 42 is about 1.00 inch. In one embodiment, the diameter D4 of the insert 42 is between about 0.10 inches and about 0.40 inches. In a preferred embodiment, the diameter D4 of the insert 42 is between about 0.20 inches and about 0.30 inches. In a more preferred embodiment, the diameter D4 of the insert 42 is about 0.26 inches. The insert 42 may also include bands 82 to help hold the insert 42 in the housing 40. Any number of bands 82 can be used in various embodiments. The bands 82 may be steps in the housing 40 and/or insert 42 that increase or decrease in height by between about 0.005 inch and 0.02 inch. The widths of the bands 82 are typically between about 0.01 inch and 0.03 inch. The bands 82 are similar to cannelures in that they are grooves around the circumference of the insert 42 used for crimping and securing the housing 40 to the insert 42. As the projectile is shot through the barrel, the housing 40 gets pushed or squished around the insert 42 and the bands 82 help the housing 40 and insert 42 to spin together at the same rate.

The insert 42 may end proximate to where the boat tail 38 begins. The tip 4 can have a radius of curvature (R7 in other figures). In one embodiment, the radius of curvature R7 of the tip 4 is between about 0.005 inches and about 0.05 inches. In a preferred embodiment, the radius of curvature R7 of the tip 4 is between about 0.015 inches and about 0.035 inches. In a more preferred embodiment, the radius of curvature R7 of the tip 4 is about 0.025 inches.

The rear portion 86 of the insert 42 can have a tip 88 at a forward-most point of the rear portion 86. The forward portion of the insert rear portion 86 can include depressions 8 that form a cutting edge at the tip 88, similar to the cutting edges shown in FIGS. 1A-2C and 20A-23E. The tip 88 and cutting edges can cut through an armor, a steel, or another hard material target. Additionally, the depressions 8 and non-distorted portions or ridges between the depressions create high pressure points that assist the projectile 2 and insert 42 when traveling through the target material. Specifically, the high-pressure points are located along the ridges and the low-pressure points are in the depressions 8. The low pressure in the depressions 8 create a way to move the target material out and away from the projectile. Thus, the depressions 8 act like the grooves in a saw blade that pull the cut material away from the blade. The intersection between the ridge and depression 8 forms an edge (92 in other figures). The edge can be a sharp edge with a sharp corner or the edge can be a rounded curved edge. The angle $\alpha$ of the depressions 8 can be measured relative to the longitudinal axis of the insert 42. In some embodiments, all depressions 8 have the same angle $\alpha$. In other embodiments, each depression 8 has a different angle $\alpha$. In still other embodiments, some depressions 8 have the same angle $\alpha$ while other depressions 8 have different angles $\alpha$. In one embodiment, the insert 42 has at least three depressions 8. However, the insert 42 can have more or fewer depressions 8. In one embodiment, the depressions 8 have an angle $\alpha$ between about 3.0 degrees and about 20.0 degrees. In a preferred embodiment, the depressions 8 have an angle $\alpha$ between about 5.0 degrees and about 15.0 degrees. In a more preferred embodiment, the depressions 8 have an angle $\alpha$ of about 10.0 degrees.

The depressions 8 in the insert 42 have a curved shape meaning that the trough or bottom of the depression 8 is curved and has a radius of curvature R4. In one embodiment, the depressions 8 are cut using a ¼ inch ball end mill. In one embodiment, the radius of curvature R4 of the depressions 8 is between about 0.05 inches and about 0.4 inches. In a preferred embodiment, the radius of curvature R4 of the depressions 8 is between about 0.09 inches and about 0.25 inches. In a more preferred embodiment, the radius of curvature R4 of the depression 8 is about 0.125 inches.

However, the size of the ball end mill, and thus the radius of curvature R4 of the depressions 8, can vary in various embodiments and can vary as the caliber of the projectile 2 and/or diameter D4 of the insert 42 changes. The depth of the ball end mill cuts forming the depressions 8 can vary in various embodiments. Additionally, the depressions 8 can be cut by the ball end mill intersecting the insert 42 at an angle. In some embodiments, that intersection angle is between about 15 degrees and about 75 degrees relative to the longitudinal axis 44 of the insert 42. In a preferred embodiment, that intersection angle is between about 25 degrees and about 45 degrees relative to the longitudinal axis 44 of the insert 42. In a more preferred embodiment, that intersection angle is about 37 degrees relative to the longitudinal axis 44 of the insert 42.

In some embodiments, the radius of curvature R1 of the nose ogive is between about 0.25 inches and about 10.0 inches. In a preferred embodiment, the radius of curvature R1 of the nose ogive is between about 2.5 inches and about 8.0 inches. In a more preferred embodiment, the radius of curvature R1 of the nose ogive is about 5.0 inches. However, the radius of curvature R1 of the nose ogive varies with caliber; therefore, as the caliber increases the radius of curvature R1 of the nose ogive increases and as the caliber decreases the radius of curvature R1 of the nose ogive decreases. In one embodiment, the radius of curvature R2 of the tangent ogive is between about 0.25 inches and about 10.0 inches. In a preferred embodiment, the radius of curvature R2 of the tangent ogive is between about 2.5 inches and about 8.0 inches. In a more preferred embodiment, the radius of curvature R2 of the tangent ogive is about 5.0 inches. Thus, the radius of curvature R2 of the tangent ogive is the same as the radius of curvature R1 of the nose ogive in some embodiments. In other embodiments, the radius of curvature R2 of the tangent ogive is different than (and typically larger than) the radius of curvature R1 of the nose ogive.

In one embodiment, the length L5 of the housing 40 is between about 0.75 inch and about 2.00 inches. In a preferred embodiment, the length L5 of the housing 40 is about 1.30 inches. In one embodiment, the angle $\theta$ of the boat tail 38 is between about 5 degrees and about 10 degrees. In a preferred embodiment, the angle $\theta$ of the boat tail 38 is between about 6.5 degrees and about 8.5 degrees. In a more preferred embodiment, the angle $\theta$ of the boat tail 38 is about 7.5 degrees.

The cylindrical portion of the projectile 2 comprises angled driving bands 26A and angled relief cuts 28A. The angled driving bands 26A and angled relief cuts 28A create air disturbances that stabilize the projectile 2 in flight allowing the projectile 2 to fly straighter and be less affected by cross winds than projectiles of the prior art. For a close-up view of the angled driving bands 26A and angled relief cuts 28A, see FIG. 35E.

In one embodiment, the angled driving bands 26A and angled relief cuts 28A are positioned at an angle σ relative to a horizontal line or the longitudinal axis between about 6 degrees and about 11 degrees. In a preferred embodiment, the angled driving bands 26A and angled relief cuts 28A are positioned at an angle σ relative to a horizontal line or the longitudinal axis between about 7 degrees and about 9 degrees. In a more preferred embodiment, the angled driving bands 26A and angled relief cuts 28A are positioned at an angle σ relative to a horizontal line or the longitudinal axis about 8.5 degrees. In another preferred embodiment, the angled driving bands 26A and angled relief cuts 28A are positioned at an angle α relative to a horizontal line or the longitudinal axis 44 about 7.5 degrees. In one embodiment, the diameter D2 of the angled relief cuts 28A is between about 0.20 inches and about 0.50 inches. In a preferred embodiment, the diameter D2 of the angled relief cuts 28A is about 0.300 inches. In one embodiment, the diameter D3 of the angled driving bands 26A is between about 0.20 inches and about 0.50 inches. In a preferred embodiment, the diameter D3 of the angled driving bands 26A is about 0.308 inches. In alternate embodiments, the driving bands 26A vary in number, comprising one driving band 26A, a plurality of driving bands 26A, two driving bands 26A, three driving bands 26A, and four or more driving bands 26A.

FIGS. 46A-D show a projectile according to a fortieth embodiment of the invention. The projectile 2 of FIGS. 46A-D is similar to the projectiles of FIGS. 42A-44C. Therefore, repetitive description will not be repeated here; only the differences will be discussed. The projectile has an insert 42 and a housing 40. In some embodiments, the first nose portion 66 of the projectile 2 is angled rather than concave or convex. In other embodiments, the first nose portion 66 can be concave or convex.

This projectile has cutouts 94 in the cavity of the housing 40 rather than depressions on the insert 42. Thus, the insert 42 has a substantially smooth outer surface.

The housing 40 has two or more cutouts 94, and in the embodiment shown, the housing 40 has four cutouts 94 that are evenly spaced apart. The cutouts 94 are cut using a broaching process on a mill or lathe. The cutouts 94 cause the housing 40 to flower by creating petals between the cutouts 94 when the projectile hits its target. The petals peel back to slow the projectile in its target and to create larger cavitation in the target. Only a portion of the cutouts 94 are visible in FIG. 46A, but the interior length of the cutouts 94 can clearly be seen in FIG. 46B. The cutouts 94 extend the length L17 of the wide portion of the cavity in the housing 40. In one embodiment, the cutouts 94 extend ⅜ inches into the cavity. In another embodiment, the cutouts 94 extend 0.50 inches into the cavity. In yet another embodiment, the cutouts 94 extend 0.40 inches into the cavity of the housing 40. In one embodiment, the length L17 of the wide portion of the cavity is between about 0.10 inches and about 0.70 inches. In a preferred embodiment, the length L17 of the wide portion of the cavity is between about 0.25 inches and about 0.55 inches. In a more preferred embodiment, the length L17 of the wide portion of the cavity is about 0.40 inches. In one embodiment, the length L18 of the narrow portion of the cavity is between about 0.05 inches and about 0.40 inches. In a preferred embodiment, the length L18 of the narrow portion of the cavity is between about 0.15 inches and about 0.30 inches. In a more preferred embodiment, the length L18 of the narrow portion of the cavity is about 0.22 inches. In one embodiment, the diameter D8 of the wide portion of the cavity is between about 0.10 inches and about 0.25 inches. In a preferred embodiment, the diameter D8 of the wide portion of the cavity is between about 0.15 inches and about 0.20 inches. In a more preferred embodiment, the diameter D8 of the wide portion of the cavity is about 0.17 inches. In one embodiment, the diameter D9 of the narrow portion of the cavity is between about 0.05 inches and about 0.20 inches. In a preferred embodiment, the diameter D9 of the narrow portion of the cavity is between about 0.10 inches and about 0.15 inches. In a more preferred embodiment, the diameter D9 of the narrow portion of the cavity is about 0.125 inches. The step between the wide portion and narrow portion of the cavity has a rounded shape and is positioned at an angle τ relative to the longitudinal axis of the projectile 2. In some embodiments, the angle τ is between about 90 degrees and about 150 degrees. In a preferred embodiment, the angle τ is about 120 degrees. The bottom of the cavity has a pointed or angled shape such that the bottom is positioned at an angle λ relative to the longitudinal axis of the projectile 2. In some embodiments, the angle λ is between about 90 degrees and about 150 degrees. In a preferred embodiment, the angle λ is about 120 degrees.

This projectile 2 can be made or copper, brass, or any other known material. Additionally or alternatively, skivings can be added to the exterior of the housing proximate the cutouts 94 to further help the housing 40 peel backward and flower out.

Figure 47A:
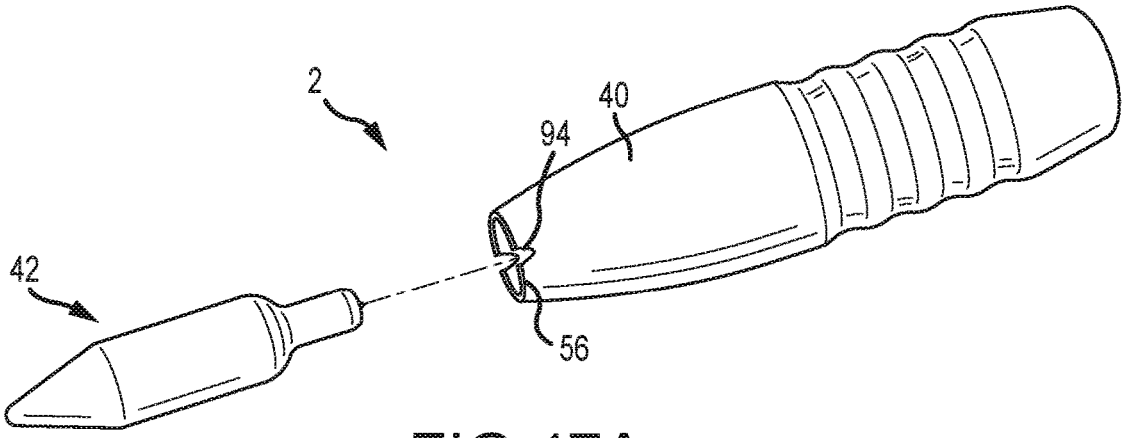
FIGS. 47A-C show a projectile according to a forty-first embodiment of the invention.
Figure 47B:
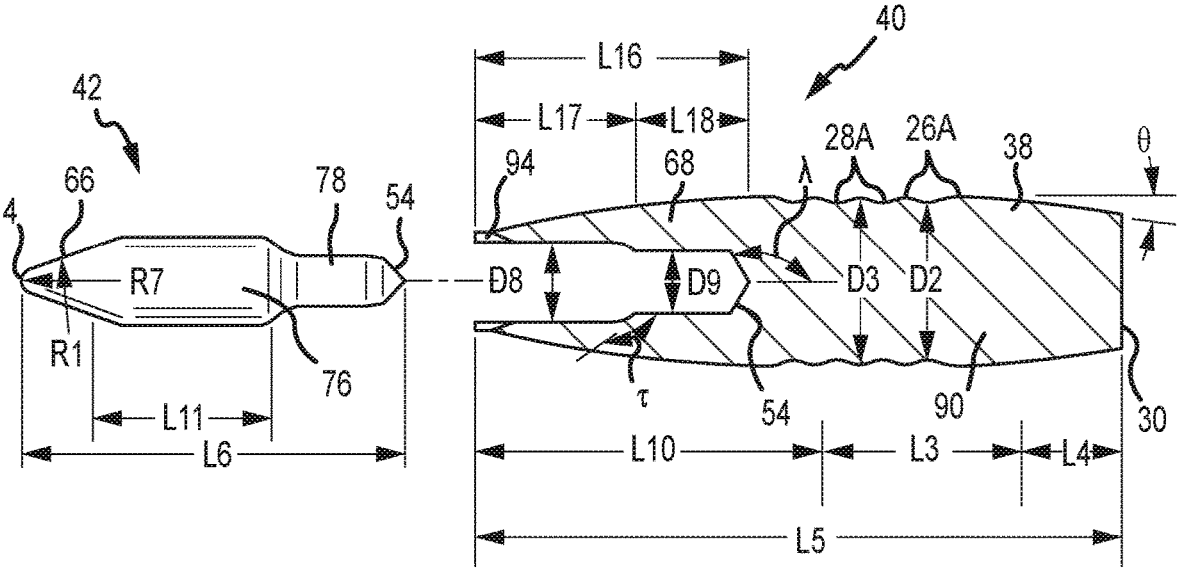
Figure 47C:
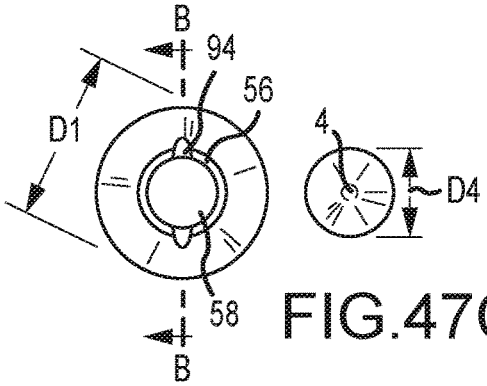

FIGS. 47A-C show a projectile according to a forty-first embodiment of the invention. The projectile 2 of FIGS. 47A-C is similar to the projectile of FIGS. 46A-D. Therefore, repetitive description will not be repeated here; only the differences will be discussed. Here, the projectile 2 is manufactured using injection molding or other molding process. Thus, the cutouts 94 are formed as a part of the mold. Additionally, the cutouts 94 do not extend down and into the cavity of the housing 40. Rather, the cutouts 94 extend from the exterior surface of the housing 40 to the cavity. In one embodiment, the length of the cutouts 95 as measured from the front 56 of the housing 40 is between about 0.01 inches and about 0.03 inches. In a preferred embodiment, the length of the cutouts 95 as measured from the front 56 of the housing 40 is about 0.015 inches. In another preferred embodiment, the length of the cutouts 95 as measured from the front 56 of the housing 40 is about 0.02 inches. In this embodiment, the projectile 2 includes two cutouts 94. However, the housing 40 can have more or fewer cutouts in other embodiments. Like the cutouts in FIGS. 46A-D, the cutouts 94 of the present projectile 2 cause the housing 40 to flower by creating petals between the cutouts 94 when the projectile hits its target. The petals peel back to slow the projectile in its target and to create larger cavitation in the target.

Figure 48A:
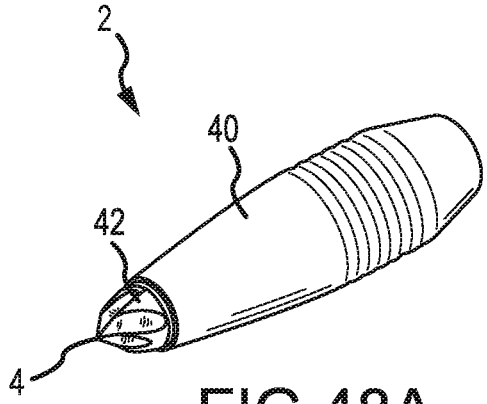
FIGS. 48A-E show a projectile according to a forty-second embodiment of the invention.
Figure 48B:
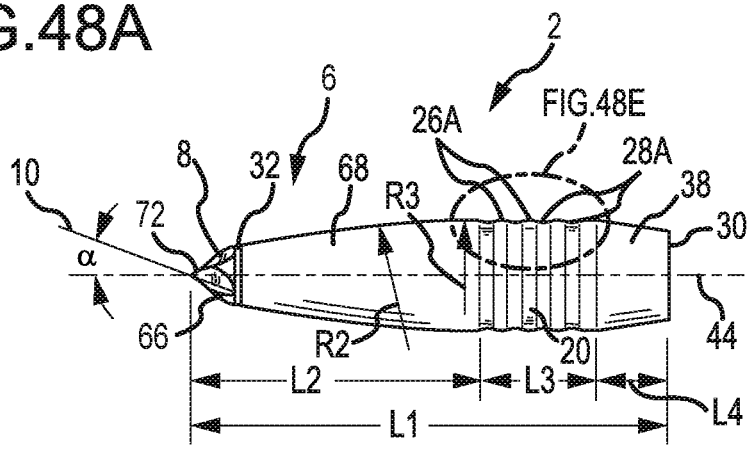
Figure 48C:
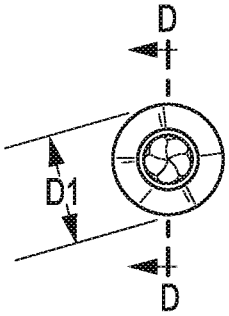
Figure 48D:
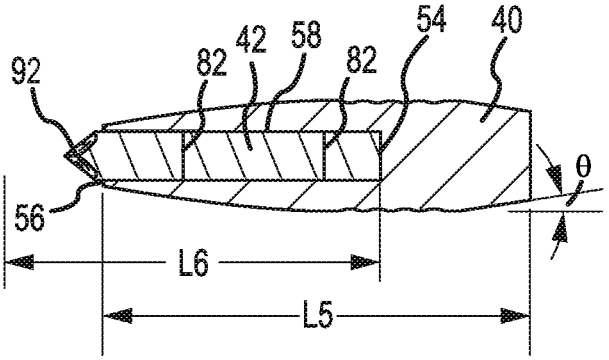
Figure 48E:
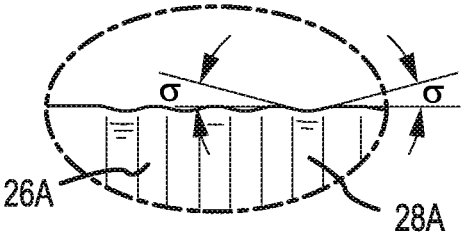

FIGS. 48A-E show a projectile according to a forty-second embodiment of the invention. The projectile 2 of FIGS. 48A-E is similar to the projectile of FIGS. 35A-E. Therefore, repetitive description will not be repeated here; only the differences will be discussed. FIG. 48A is a perspective view of the projectile 2. FIG. 48B is a side elevation view of the projectile 2. FIG. 48C is a top plan view of the projectile 2. FIG. 48D is a cross-sectional view. FIG. 48E is a close-up view. Note that FIGS. 48A-E are to scale. Here, the projectile 2 has a housing 40 and an insert 42. The insert 42 has a different first nose portion 66 than the insert of FIGS. 35A-E. This insert 42 has depressions 8 that intersect to form cutter edges 72. Additionally, the first nose portion 66 has five depressions. The depressions 8 create high and low pressure areas that allow the projectile 2 to penetrate better than prior art projectiles. The insert 42 is made of a hard material such as tungsten, steel, Inconel, titanium, nickel, iron, or other hard material. By the insert 42 having cutter edges 72 and being a hard material, the projectile can penetrate armor even when shot at an angle. Thus, this embodiment is intended for military or government use. The housing 40 is typically a softer material than the insert 42, for example, brass or copper. The depressions 8 create a high-pressure area in the depressions 8 to move air around the depression 8 and not into the cavity 24 when traveling through air or in hard media.

The insert 42 may also include bands 82 to help hold the insert 42 in the housing 40. Any number of bands 82 can be used in various embodiments. The bands 82 may be steps in the housing 40 and/or insert 42 that increase or decrease in height by between about 0.005 inch and 0.02 inch. The widths of the bands 82 are typically between about 0.01 inch and 0.03 inch. The bands 82 are similar to cannelures in that they are grooves around the circumference of the insert 42 used for crimping and securing the housing 40 to the insert 42. As the projectile is shot through the barrel, the housing 40 gets pushed or squished around the insert 42 and the bands 82 help the housing 40 and insert 42 to spin together at the same rate.

The projectile 2 is designed to fly at subsonic speeds, but can still penetrate armor, which is an unexpected result because typically the higher speed the projectile the better it penetrates armor.

FIG. 49 shows a gel target 100 after being shot by two different projectiles. The solid line and area within the solid line show the target area affected by a hollow-point bullet 102. As shown, the hollow-point bullet enters the target and travels a distance before mushrooming out to cause greater cavitation. The dotted line and area within the dotted line show the target area affected 104 by the projectile of FIG. 41. As shown, the projectile of FIG. 41 starts deforming upon impact to cause increased cavitation immediately. Further, the area affected 104 by the projectile of FIG. 41 is larger than the area affected 102 by a hollow-point bullet.

Figure 50A:
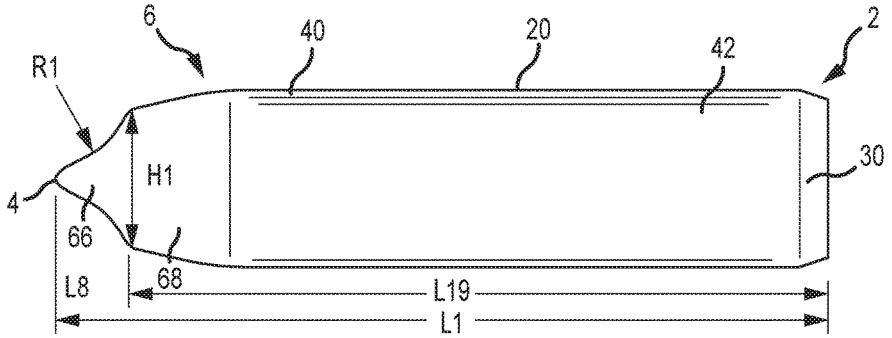
FIGS. 50A-E show a projectile according to a forty-third embodiment of the invention.
Figure 50B:
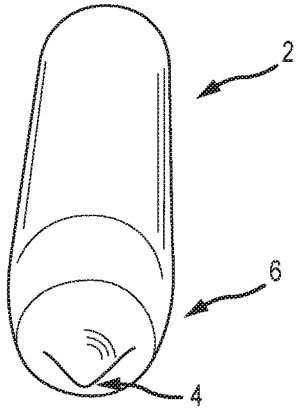
Figure 50D:
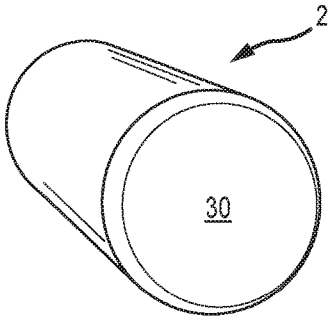
Figure 50C:
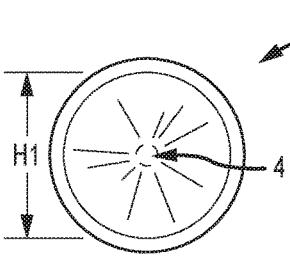
Figure 50E:
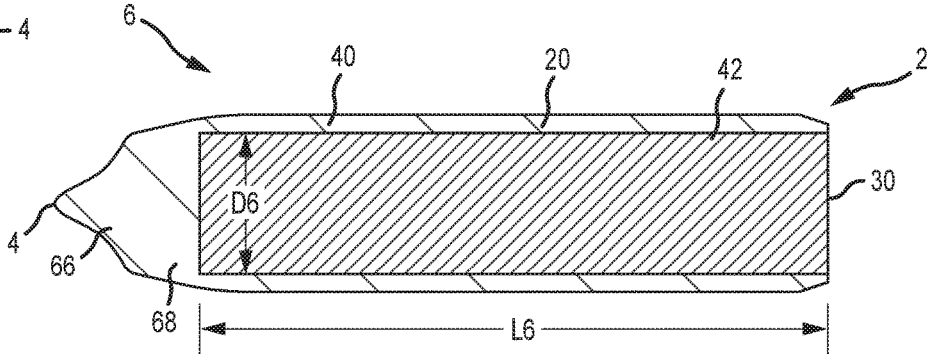

FIGS. 50A-E show a projectile according to a forty-third embodiment of the invention. FIG. 50A is a side elevation view of the projectile 2. FIG. 50B is a side front perspective view of the projectile 2. FIG. 50C is a top plan view of the projectile 2. FIG. 50D is a rear view. FIG. 50E is a rear perspective view.

The projectile 2 comprises a housing 30 made of a soft material such as copper, brass, or a copper alloy and an insert 42 made of a hard material such as tungsten or steel. The projectile has a tip 4 on one end opposite a base 30 on the other end. The projectile 2 also includes a nose portion 6 with a first nose portion 66 and a second nose portion 68. The first nose portion 66 has a concave radius of curvature R1. In one embodiment, the radius of curvature R1 of the first nose portion 66 is between about 0.25 inches and about 3.0 inches. In a preferred embodiment, the radius of curvature R1 of the first nose portion 66 is between about 0.35 inches and about 2.0 inches. In a more preferred embodiment, the radius of curvature R1 of the first nose portion 66 is between about 0.40 inches and about 0.50 inches. In one embodiment, the radius of curvature R2 of the ogive of the second nose portion 68 is between about 1.0 inch and about 5.0 inches. In a preferred embodiment, the radius of curvature R2 of the ogive of the second nose portion 68 is between about 1.5 inches and about 3.0 inches. In a more preferred embodiment, the radius of curvature R2 of the ogive of the second nose portion 68 is about 2.0 inches.

In one embodiment, the length L1 of the projectile 2 is between about 0.75 inches and about 2.0 inches. In a preferred embodiment, the length L1 of the projectile 2 is between about 1.0 inch and about 1.5 inches. In a more preferred embodiment, the length L1 of the projectile 2 is about 1.3 inches. In one embodiment, the diameter D1 of the projectile 2 is between about 0.20 inches and about 0.50 inches. In a preferred embodiment, the diameter D1 of the projectile 2 is between about 0.25 inches and about 0.40 inches. In a more preferred embodiment, the diameter D1 of the projectile 2 is about 0.308 inches.

The insert 42 is cylindrical shaped with a diameter D6 and a length L6. In one embodiment, the length L6 of the insert 42 is between about 0.50 inches and about 1.5 inches. In a preferred embodiment, the length L6 of the insert 42 is between about 0.75 inches and about 1.25 inches. In a more preferred embodiment, the length L6 of the insert 42 is about 1.0 inch. In one embodiment, the diameter D6 of the insert 42 is between about 0.10 inches and about 0.35 inches. In a preferred embodiment, the diameter D6 of the insert 42 is between about 0.15 inches and about 0.30 inches. In a more preferred embodiment, the diameter D6 of the insert 42 is about 0.25 inches.

In one embodiment, the length L19 of the portion of the projectile 2 after the first nose portion 66 is between about 0.50 inches and about 2.0 inches. In a preferred embodiment, the length L19 of the portion of the projectile 2 after the first nose portion 66 is between about 1.0 inch and about 1.5 inches. In a more preferred embodiment, the length L19 of the portion of the projectile 2 after the first nose portion 66 is about 1.175 inches. In one embodiment, the length L8 of the first nose portion 66 is between about 0.05 inches and about 0.25 inches. In a preferred embodiment, the length L8 of the first nose portion 66 is between about 0.10 inches and about 0.20 inches. In a more preferred embodiment, the length L8 of the first nose portion 66 is about 0.125 inches. In one embodiment, the height H1 of the rear portion of the first nose portion 66 is between about 0.10 inches and about 0.35 inches. In a preferred embodiment, the height H1 of the rear portion of the first nose portion 66 is between about 0.15 inches and about 0.30 inches. In a more preferred embodiment, the height H1 of the rear portion of the first nose portion 66 is about 0.25 inches. The base 30 is substantially flat. In one embodiment, the radius of curvature R7 of the tip 4 is between about 0.01 inches and about 0.05 inches. In a preferred embodiment, the radius of curvature R7 of the tip 4 is between about 0.015 inches and about 0.03 inches. In a more preferred embodiment, the radius of curvature R7 of the tip 4 is about 0.02 inches.

The projectiles described herein can be comprised of brass, copper, copper alloys (e.g., copper nickel alloy, trillium copper alloy, etc.), an aluminum nanoparticle/nanopowder (nanotechnology) material, bronze, tungsten-carbide, alloys of these metals, or any material known in the art, including plastics and ceramics.

Additionally, various features/components of one embodiment may be combined with features/components of another embodiment. For example, features/components of one figure can be combined with features/components of another figure or features/components of multiple figures. To avoid repetition, every different combination of features has not been described herein, but the different combinations are within the scope of this disclosure. Additionally, if details (including angles, dimensions, etc.) about a feature or component are described with one embodiment or one figure, then those details can apply to similar features of components in other embodiments or other figures.

Moreover, the dimensions listed herein for specific figures or embodiments are the ideal dimensions for the caliber (diameter D1) shown in that figure. However, each embodiment and figure can be manufactured in various calibers and the dimensions scale with the caliber. For example, if the figure shows a 9 mm caliber projectile and the dimensions of various features for that 9 mm caliber projectile are provided herein, then a similar projectile can be manufactured with a different caliber having different—but similar—dimensions, e.g., the projectile can also be manufactured in a .40 caliber (i.e., 0.40 inch diameter) projectile with dimensions of various features that are scaled to be larger than the preferred dimensions herein for the 9 mm caliber projectile. Specifically, the length (L1) of the projectile will typically increase with an increased caliber, but the length (L1) does not always increase proportionally to the diameter because other constraints exist, such as chamber length and the amount of gun powder needed to shoot the projectile. Additionally, other lengths (e.g., L2, L3, . . . L15) will increase with an increased caliber projectile. In some embodiments, the radii of curvature (e.g., R1, R2, . . . R8) also increases with an increased caliber projectile. In the interest of brevity, every dimension for every possible caliber of every embodiment described or shown herein is not included herein due to the repetitive nature of the dimensions and the length of description that would be required. Additionally, repetitive discussion of features/components is not included for similar embodiments or for embodiments with similar features/components. Common small arms calibers range from 0.17 inch to 0.51 inch caliber projectiles. Common pistol projectile calibers include: 3 mm (0.12 inch), 0.172 inch, 5 mm (0.2 inch), 0.32 inch, 9 mm (0.354 inch), 0.357 inch, 0.380 inch, 10 mm (0.39 inch), 0.40 inch, 0.44 inch, 0.45 inch, and 0.50 inch. Common rifle projectile calibers include: 0.17 inch, 0.22 inch, 0.243 inch, 0.270 inch, 7 mm (0.276 inch), 0.30 inch, 0.308 inch, 0.338 inch, 0.357 inch, 0.375 inch, 0.444 inch, and 0.45 inch.

In some embodiments, the angle of the depressions, troughs, or cutout portions can be oriented or measured with respect to the longitudinal axis of the projectile or the ogive of the remaining portion. In various embodiments, the angle of the depression's centerline or the lowest point of the trough relative to the projectile's ogive is constant. Thus, the angle of the depression's centerline or the lowest point of the trough relative to the projectile's centerline may not be a constant angle; rather the angle may actually be a multitude of angles because the line of the trough follows the ogive and, therefore, is parabolic relative to the projectile's centerline.

In some embodiments, the radius of curvature of the depressions are constant throughout the depression. This is especially true if the depressions are formed by cutting the projectile with a ball end mill. However, the radius of curvature of the depressions may vary throughout the depressions if the projectile and depressions are formed by casting or injection molding. Further, the depths—and thus the widths—of the depressions may vary even if the depressions are cut with the same size ball end mill. The depths and widths of the depressions may be constant for all depressions or may vary throughout the depressions or each depression may be different. Additionally, one embodiment can have depressions cut with a specific size ball end mill and a second embodiment may have depressions cut with the same size end mill but the depressions are cut deeper in the second embodiment, thus the depressions of the second embodiment are deeper and wider than the depressions of the first embodiment. For example, a ⅛ inch, 3⁄16 inch, ¼ inch, 5⁄16 inch, ⅜ inch, ½ inch, ⅝ inch, or ¾ inch ball end mill, or any similarly dimensioned metric unit ball end mill, can be used to cut the depressions in projectiles according to embodiments of the present invention.

In various embodiments, the shape of the depression may be curved throughout. In other embodiments, the bottom surface of the depression may come to a point such that the depression is V-shaped.

In some embodiments, the end of the nose depression opposite the nose is curved and has the same radius of curvature as the radius of curvature of the depression. This is likely the case when the nose depression is cut with a ball end mill. Alternatively, the lower end of the depression (the end opposite the nose) can have a flat, angled, or pointed (V-shaped) shape. These shapes are possible if the depression is cut with a flat end mill or the projectile is molded or casted.

Additionally, in various embodiments the intersection between the remaining portion (ridge) and depression (trough) forms an edge that can be a sharp edge with a sharp corner in various embodiments or the edge can be a rounded curved edge in other embodiments.

In some embodiments, the nose portion of the projectile has one or more skivings extending from a portion of the projectile proximate the nose. The one or more skivings can extend a length between about 0.10 inches and 1.00 inch. Skivings are typically used in embodiments with a housing and an insert because the skiving helps the housing to peel backward and expand upon target impact.

The cylindrical portion can comprise sections that are equal to the diameter of the rifle barrel's grooves (driving bands) and alternate with a diameter equal to the diameter of lands in the rifle's bore (relief cuts). The angle of transition between these driving bands and relief cuts is 7.5-8.5 degrees in one embodiment.

Table 1

Table 1 provides a design chart for alpha angles for given barrel rates of twist and calibers. For example, for a .308 caliber bullet fired from a barrel having a barrel rate of twist of 10 (i.e., 1 bullet rotation every 10 inches of barrel travel), the alpha angle is 5.526794 degrees. The alpha angle designs provided are representative of embodiments that have a perfect correlation to the rate of twist.

Experimental Results

The rifled projectiles have exhibited excessive velocity with no apparent gain in pressure. This is an unexpected result, as under normal circumstances this should be impossible. This unexpected result may be due to less friction within the barrel. The twisting depressions are twisting the bullet in the barrel and reducing friction when the projectile engages with the rifling. This occurs when pressures exceed roughly 50,000 PSI. As the barrel warms slightly and pressures increase, the velocity increases exponentially. The greatest increase recorded was 1400 ft/s over the standard rifle projectile. This is substantial because it represents a 40% increase over normal velocity.

Also, the barrel heats at a slower rate and heats differently than with traditional bullets, lending further evidence of reduced friction in the barrel. Under normal circumstances, the greatest heat in a barrel is experienced an inch or two after the chamber. In contrast, with respect to the projectiles disclosed herein, the barrel gets hottest near the muzzle. The high pressures are helping to twist the projectile through the rifling and thus lowering friction. When the pressures drop near the muzzle, the heat and the friction return to the barrel.

There are many benefits of these results. With lower friction and less heating, barrels will last substantially longer. A lower rate of heating would have an impact on the manufacturing of machine guns, e.g., they could have lighter barrels that would last longer. Cyclic rates could be raised; longer bursts and sustained fire would be possible. Greater velocities mean flatter trajectories with the same case and similar weight projectiles. For a given projectile weight and caliber, a much smaller case could be employed. This means smaller lighter actions and more ammunition could be supplied for a given weight weapon system.

The functional aspects of the projectile may eliminate the sound of the bullet in flight, i.e., the whistle associated with a projectile in flight. The supersonic crack of the bullet passing is still audible but lessened. In one series of tests, a bullet flew at supersonic velocity without a supersonic crack until destabilizing, after which a yaw resulted and whistling began. Thus, a lower sound signature is provided.

These projectiles fly flatter than traditional ones, i.e., they have a higher ballistic coefficient. The fact they do not make a whistle means there is less friction as they slide through the atmosphere.

The penetration exhibited by these projectiles is greater than standard projectiles, and penetrate straighter than normal. Also, the projectiles of the invention have righted themselves after glancing off an object. The shape lends itself to reestablishing the spin after the projectile has struck an object. When a normal projectile begins to yaw, penetration decreases rapidly. With the subject projectiles, the spin ensures that yaw does not result.

The shape of the front of the projectile provides the capability to produce secondaries and enlarging wound channels. This will increase the size cavity of a wound inflicted by this projectile. The rapid sideways movement of media upon impact with this projectile may also explain the extra penetration that has been shown.

In one embodiment of a method of manufacture, a projectile is manufactured comprising steps as follows: the basic projectile shape, i.e. the nose and profile, is cut using a lathe; depressions are cut using a combination CNC Swiss screw machine (broadly, a combination CNC and lathe machine), Swiss screw machine and/or CNC turning machine. The projectile is rotated as the mill machine is cutting the material (one turns the front half or the back half of the projectile as appropriate, that is, depending on which portion of projectile is being worked). The forward-most portion of the projectile is contacted while the projectile is rotating. A mill is used to cut depressions in a straight line while the projectile turns. Then, cut any required driving bands; cut a radius on the back of the projectile as required; cut off back of projectile at base as required; and cut tail depression(s) as required (alternately, one can start tail portion of projectile and end with the nose portion of the projectile).

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A projectile for use in a handheld weapon, comprising:

a cylindrical body with a first end, a longitudinal axis, a second end, and a first length extending from said first end to said second end; and a nose integrally interconnected at a junction to said second end of said cylindrical body, said nose having a tip on a forward-most portion and a second length between said tip and said junction, wherein said second length is longer than said first length of said cylindrical body, said nose further comprising:

(a) a plurality of cutout portions originating at said tip of said nose and terminating proximate said junction, wherein each cutout portion in said plurality of cutout portions forms a curved trough with a distinct radius of curvature, wherein a centerline of each of said troughs is positioned at a predetermined angle greater than 2 degrees with respect to said longitudinal axis of said cylindrical body such that said cutout portions twist about said longitudinal axis, and wherein said predetermined angle is constant;

(b) a plurality of non-distorted nose portions, wherein each non-distorted nose portion is positioned between two of said cutout portions, and wherein said plurality of non-distorted nose portions extends to said tip of said nose portion; and (c) wherein said tip of said nose portion has a flattened leading edge oriented substantially perpendicular to said longitudinal axis of said cylindrical body.

2. The projectile of claim 1, wherein each non-distorted nose portion has a substantially triangular shape with a narrow portion of said substantially triangular shape positioned proximate to said tip and a wide portion of said substantially triangular shape positioned proximate to said junction.

3. The projectile of claim 1, wherein each cutout portion in said plurality of cutout portions has a third length as measured along said longitudinal axis that is slightly less than or equal to said second length.

4. The projectile of claim 1, wherein each cutout portion in said plurality of cutout portions has a radius of curvature of between 0.05 inches and 0.25 inches.

5. The projectile of claim 1, further comprising a chamfer portion extending from said first end of said cylindrical body to a point on said cylindrical body, wherein said chamfer is positioned at an angle relative to said longitudinal axis.

6. The projectile of claim 5, wherein said chamfer is positioned at an angle between 10 degrees and 25 degrees relative to said longitudinal axis.

7. The projectile of claim 1, wherein said cutout portions have either a right twist or a left twist with respect to said longitudinal axis of said projectile.

8. The projectile of claim 1, wherein said plurality of cutout portions comprises three cutout portions and said plurality of non-distorted nose portions comprises three non-distorted nose portions.

9. The projectile of claim 1, wherein said first length of said cylindrical body is between 0.11 and 0.285 inches and said second length of said nose is between 0.20 and 0.45 inches.

10. The projectile of claim 1, wherein each cutout portion in said plurality of cutout portions is oriented at an angle of between 2 degrees and 15 degrees with respect to said longitudinal axis of said cylindrical body.

11. A projectile for use in a handheld weapon, comprising:

a cylindrical body with a first end, a second end opposite the first end, a longitudinal axis, and a first length extending from said first end to said second end;

a base positioned proximate said first end of said cylindrical body, said base oriented substantially perpendicular to said longitudinal axis; and a nose integrally interconnected at a junction to said second end of said cylindrical body, said nose having a tip on a forward-most portion and a second length between said tip and said junction, wherein said second length is longer than said first length, said nose further comprising:

(a) a plurality of cutout portions extending into a surface of said nose and originating at said tip of said nose and terminating proximate said junction, wherein each cutout portion in said plurality of cutout portions forms a curved trough with a radius of curvature, and wherein a lowermost portion of each of said troughs is positioned at a predetermined angle with respect to said longitudinal axis of said cylindrical body such that said cutout portions twist about said longitudinal axis;

(b) a plurality of non-distorted nose portions, wherein each non-distorted nose portion is positioned between two of said cutout portions, and wherein said plurality of non-distorted nose portions extends to said tip of said nose portion; and (c) wherein said tip of said nose portion is substantially flat and oriented substantially parallel to said base and has a triangular shape with rounded corners when viewed from a top plan view.

12. The projectile of claim 11, wherein each non-distorted nose portion has a substantially triangular shape with a narrow portion of said substantially triangular shape proximate said tip and a wide portion of said substantially triangular shape proximate said junction.

13. The projectile of claim 11, wherein each cutout portion in said plurality of cutout portions has a third length as measured along said longitudinal axis that is slightly less than or equal to said second length.

14. The projectile of claim 11, wherein each cutout portion in said plurality of cutout portions has a radius of curvature of between 0.05 inches and 0.25 inches.

15. The projectile of claim 11, further comprising a chamfer portion extending from said first end of said cylindrical body to said base, wherein said chamfer is positioned at an angle relative to said longitudinal axis.

16. The projectile of claim 11, wherein said cutout portions have either a right twist or a left twist with respect to said longitudinal axis of said projectile.

17. The projectile of claim 11, wherein said plurality of cutout portions comprises three cutout portions and said plurality of non-distorted nose portions comprises three non-distorted nose portions.

18. The projectile of claim 11, wherein said first length of said cylindrical body is between about 0.11 and 0.285 inches and said second length of said nose is between 0.20 and 0.45 inches.

19. The projectile of claim 11, wherein each cutout portion in said plurality of cutout portions is oriented at an angle of between 2 degrees and 15 degrees with respect to said longitudinal axis of said cylindrical body.

20. The projectile of claim 11, further comprising a cannelure at said junction.

* * * * *